US007174695B2

(12) United States Patent
Porter et al.

(10) Patent No.: US 7,174,695 B2
(45) Date of Patent: Feb. 13, 2007

(54) DE-PACKAGING MACHINE

(76) Inventors: Dan C. Porter, 2011 Lamberton Creek Lane NE., Grand Rapids, MI (US) 49505; Larry R. Magnuson, 3886 Nassau, Muskegon, MI (US) 40441; Robert J. Schafer, 95 N. Whites Bridge Rd., Belding, MI (US) 48809

( * ) Notice: Subject to any disclaimer, the term of this patent is extended or adjusted under 35 U.S.C. 154(b) by 85 days.

(21) Appl. No.: 10/858,888

(22) Filed: Jun. 2, 2004

(65) Prior Publication Data

US 2004/0250670 A1 Dec. 16, 2004

Related U.S. Application Data

(60) Provisional application No. 60/475,611, filed on Jun. 4, 2003, provisional application No. 60/475,610, filed on Jun. 4, 2003.

(51) Int. Cl.
*B65B 43/00* (2006.01)

(52) U.S. Cl. ..... 53/381.2; 53/399; 53/492

(58) Field of Classification Search ..... 53/399, 53/465, 492, 587, 588, 381.2, 210, 211
See application file for complete search history.

(56) References Cited

U.S. PATENT DOCUMENTS

| | | | | |
|---|---|---|---|---|
| 2,729,885 | A | | 1/1956 | Wahl et al. |
| 2,732,619 | A | | 1/1956 | Labine |
| 3,175,288 | A | | 3/1965 | Garwick et al. |
| 3,263,843 | A | | 8/1966 | Grahn et al. |
| 3,638,695 | A | * | 2/1972 | Grotewald et al. ..... 99/563 |
| 3,889,442 | A | | 6/1975 | Grahn et al. |
| 3,922,778 | A | * | 12/1975 | Aalpoel ..... 53/381.2 |
| 3,926,322 | A | * | 12/1975 | Scott ..... 53/381.2 |
| 4,050,223 | A | | 9/1977 | Steeg et al. |
| 4,107,905 | A | | 8/1978 | Grocke et al. |
| 4,344,268 | A | * | 8/1982 | Wakamatsu et al. ..... 53/381.2 |
| 4,390,313 | A | | 6/1983 | Hoehn |
| 4,457,123 | A | | 7/1984 | Hoehn |
| 4,696,615 | A | | 9/1987 | Ettischer et al. |
| 4,997,329 | A | | 3/1991 | Hanamoto et al. |

(Continued)

FOREIGN PATENT DOCUMENTS

| | | |
|---|---|---|
| DE | 3822837 | 1/1990 |

(Continued)

*Primary Examiner*—Louis Huynh
(74) *Attorney, Agent, or Firm*—Price, Heneveld, Cooper, DeWitt & Litton, LLP

(57) ABSTRACT

A de-packaging system for removing film and bands from packages includes a first conveyor configured to move packages. The de-packaging system also includes a loading station for loading packages onto the conveyor, and a film cutting station associated with the first conveyor. The film cutting station includes a cutter having an elongated cutting element that can be heated to cut film on packages. A band cutting station includes a cutter for cutting bands wrapped around packages. A clamp device includes a clamp configured to clamp bands on packages for removal of the bands. The de-packaging system further includes a second conveyor having an upstream end adjacent a downstream end of the first conveyor. A device applies force to packages to move packages from the first conveyor to the second conveyor, and at least one friction member strips film from packages as they are moved from the first conveyor to the second conveyor.

13 Claims, 52 Drawing Sheets

U.S. PATENT DOCUMENTS

| | | | | |
|---|---|---|---|---|
| 5,048,267 | A | 9/1991 | Kudo et al. | |
| 5,059,082 | A | 10/1991 | Tanttu et al. | |
| 5,069,594 | A | 12/1991 | Bott et al. | |
| 5,101,703 | A | 4/1992 | Tanaka et al. | |
| 5,148,651 | A | 9/1992 | Masuda et al. | |
| 5,275,524 | A | 1/1994 | Ishiwata | |
| 5,282,346 | A | 2/1994 | Masuda et al. | |
| 5,371,938 | A | 12/1994 | Martin | |
| 5,419,095 | A | 5/1995 | Yohe | |
| 5,423,649 | A | 6/1995 | Maeda et al. | |
| 5,425,219 | A | 6/1995 | Tanaka et al. | |
| 5,442,895 | A | 8/1995 | Linson | |
| 5,447,009 | A * | 9/1995 | Oleksy et al. | 53/399 |
| 5,454,683 | A | 10/1995 | Marom et al. | |
| 5,463,841 | A | 11/1995 | Hayakawa et al. | |
| 5,725,349 | A | 3/1998 | Garvey et al. | |
| 5,727,747 | A | 3/1998 | Hannen et al. | |
| 5,752,359 | A | 5/1998 | Oord | |
| 5,758,362 | A | 6/1998 | Focke et al. | |
| 5,779,026 | A * | 7/1998 | Hosch et al. | 198/817 |
| 5,911,666 | A | 6/1999 | Lancaster, III et al. | |
| 6,625,954 | B2 * | 9/2003 | Forrest | 53/399 |
| 6,766,630 | B2 * | 7/2004 | Rutten | 53/381.2 |
| 2002/0162303 | A1 | 11/2002 | Skrak et al. | |

FOREIGN PATENT DOCUMENTS

| | | |
|---|---|---|
| EP | 0142846 | 6/1988 |
| EP | 0587051 | 3/1994 |
| JP | 1037333 | 2/1989 |
| JP | 1111642 | 4/1989 |
| JP | 2152643 | 6/1990 |
| JP | 5139426 | 6/1993 |

* cited by examiner

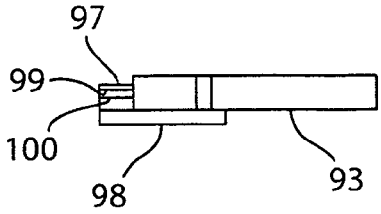
FIG. 9A
FIG. 9
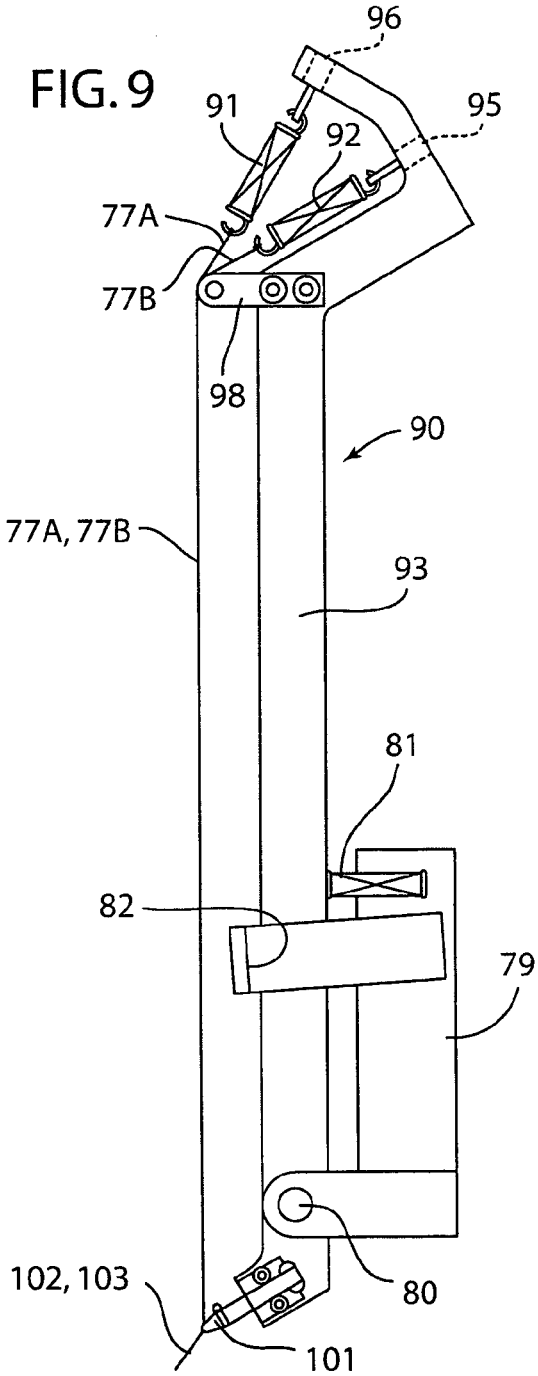
FIG. 10
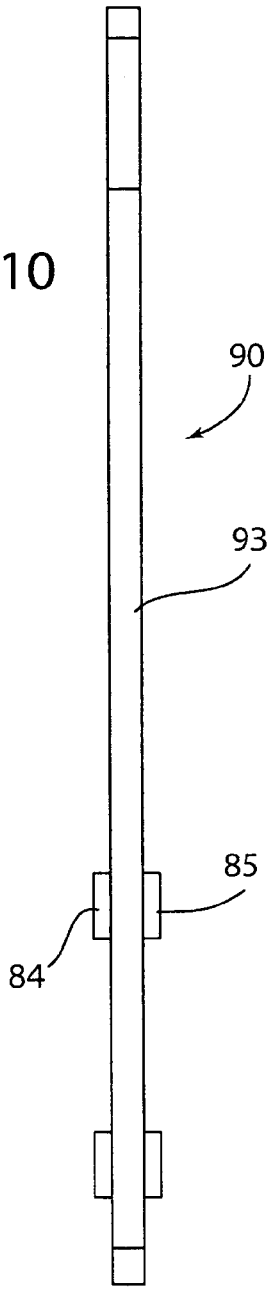

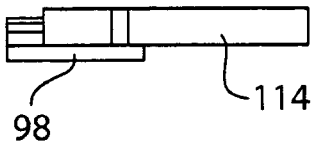
FIG. 11A
FIG. 11
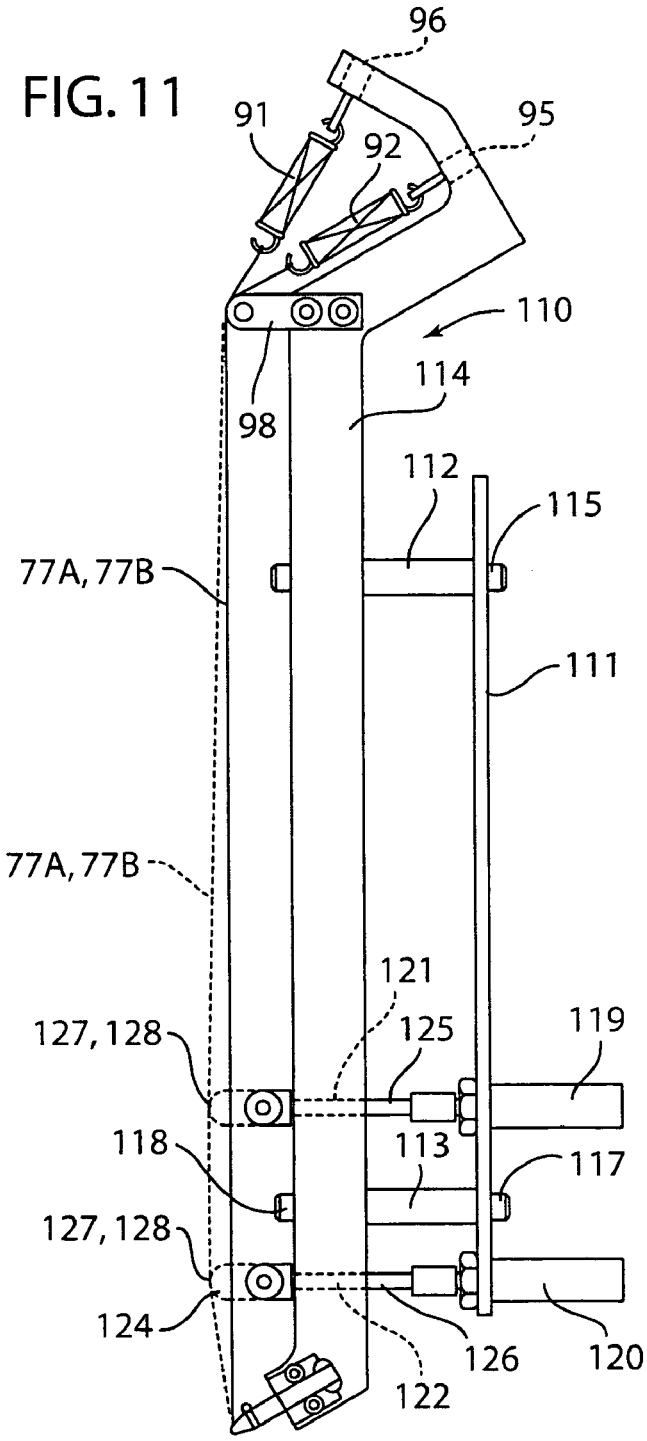
FIG. 12
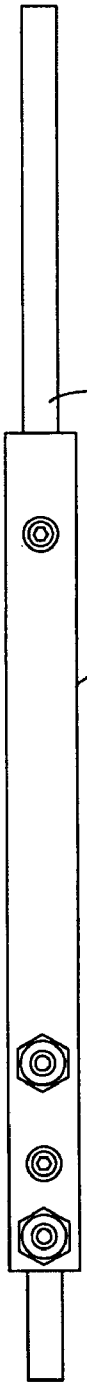

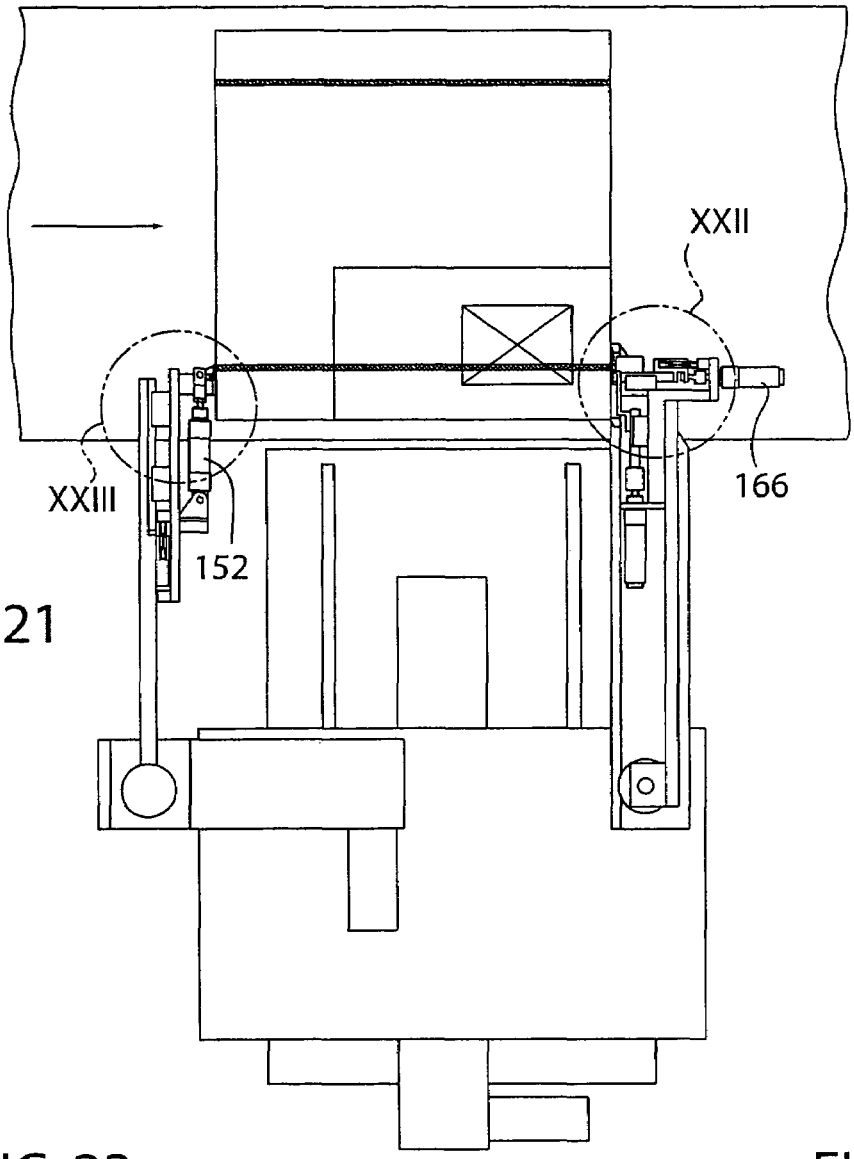
FIG. 21
FIG. 23
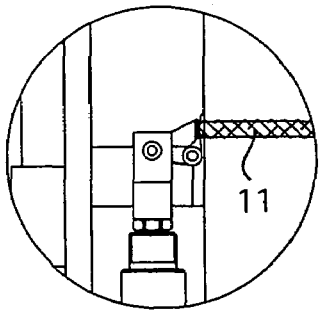
FIG. 22
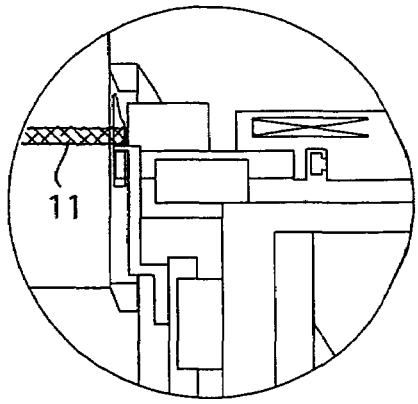

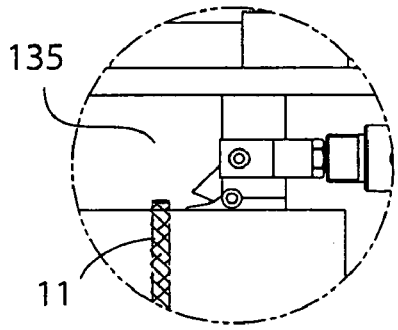
FIG. 33
FIG. 31
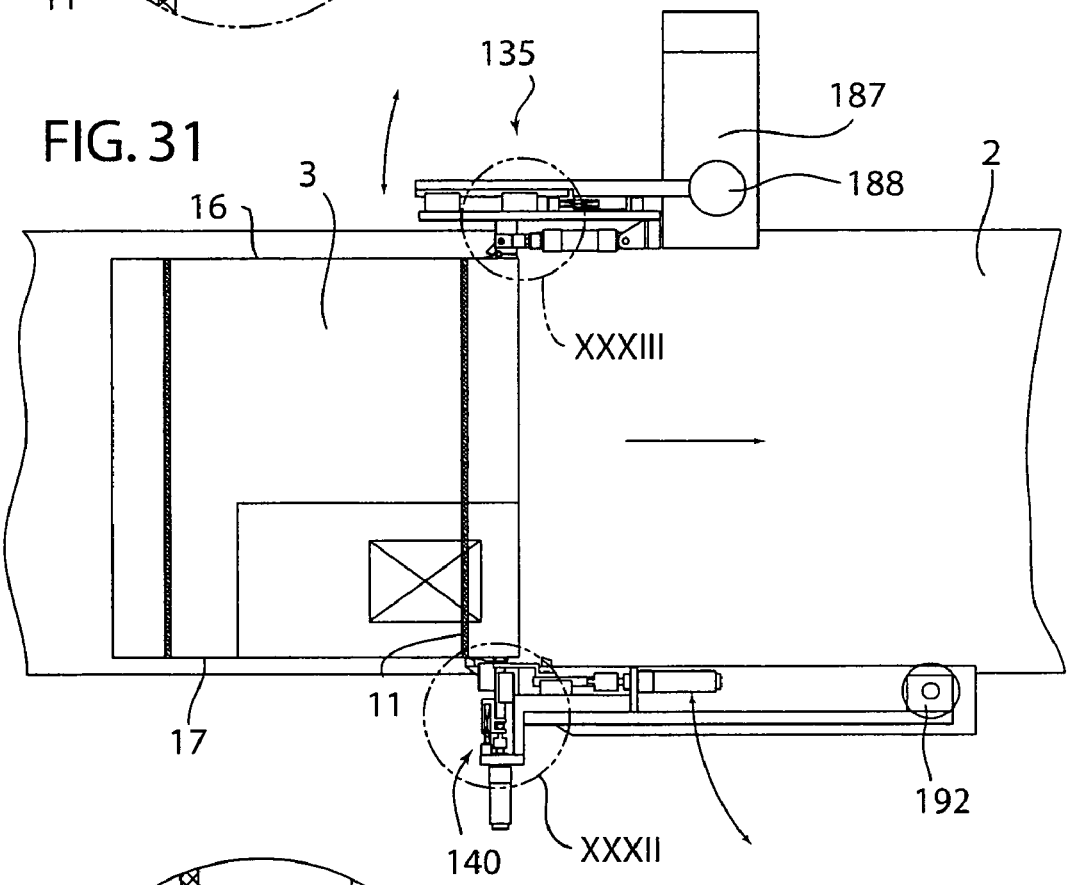
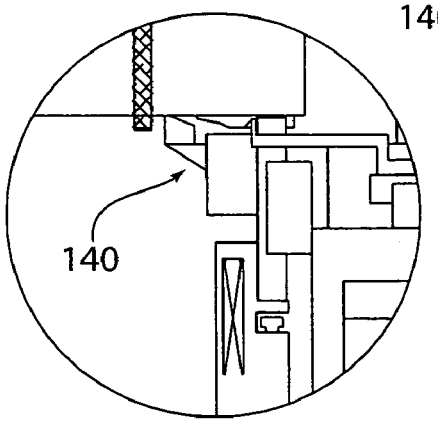
FIG. 32

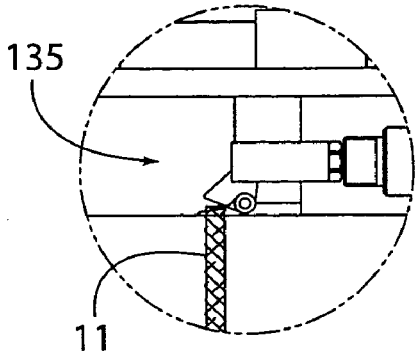
FIG. 36
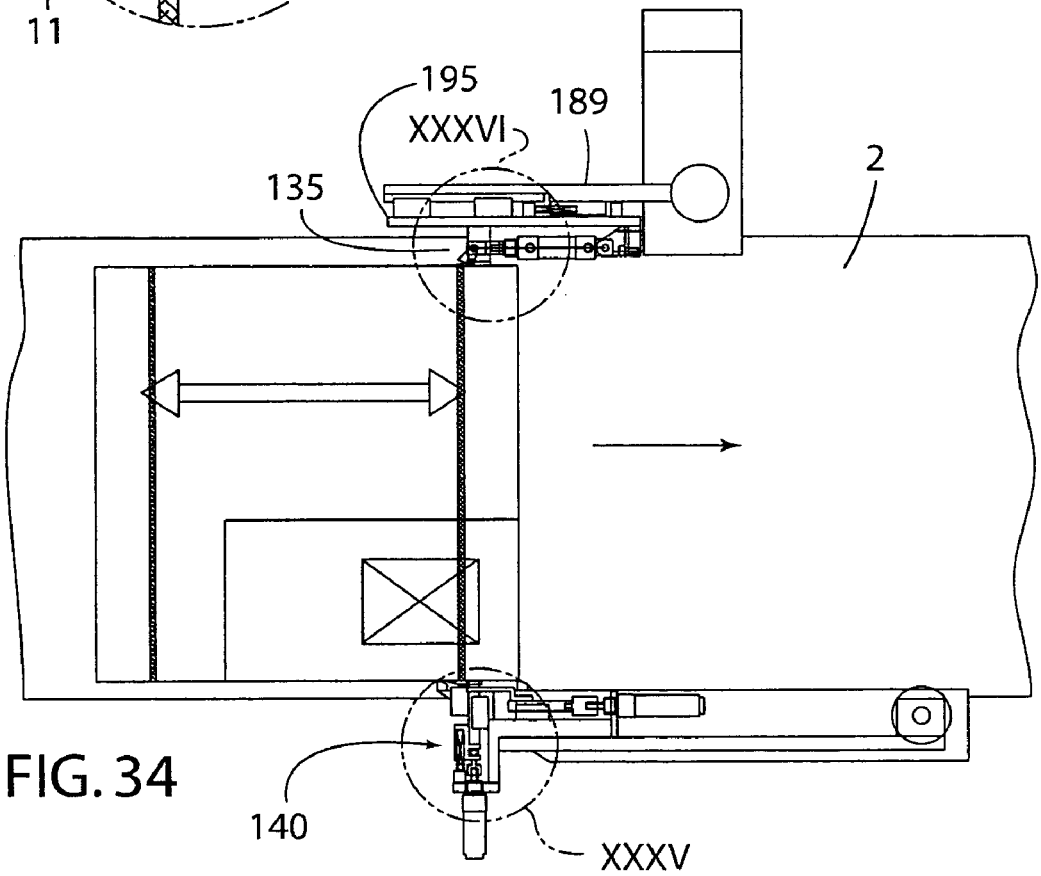
FIG. 34
FIG. 35
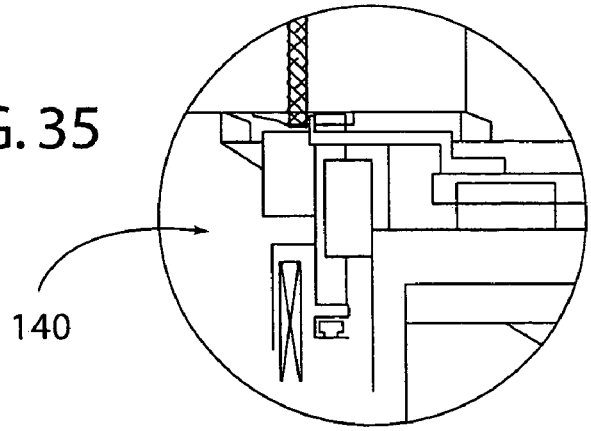

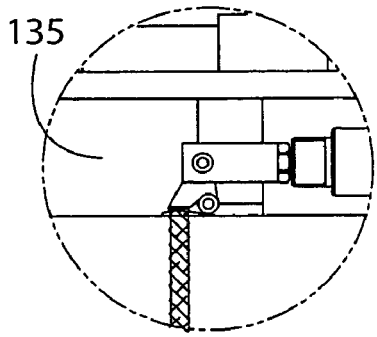
FIG. 39
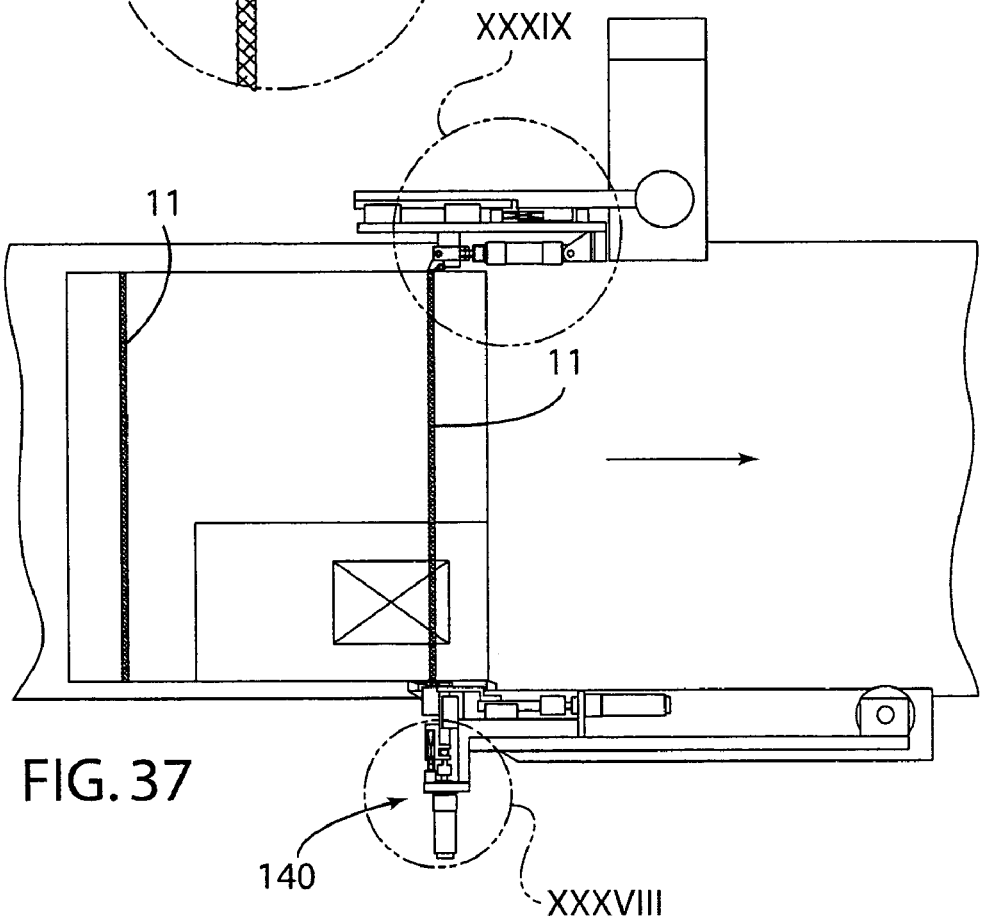
FIG. 37
FIG. 38
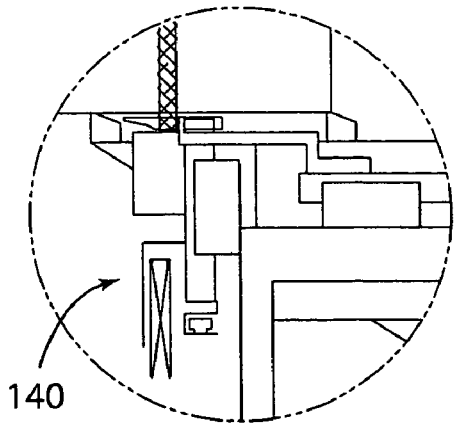

FIG. 44
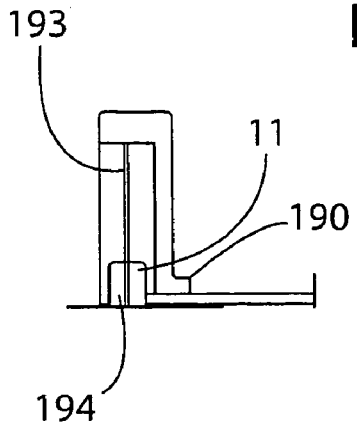
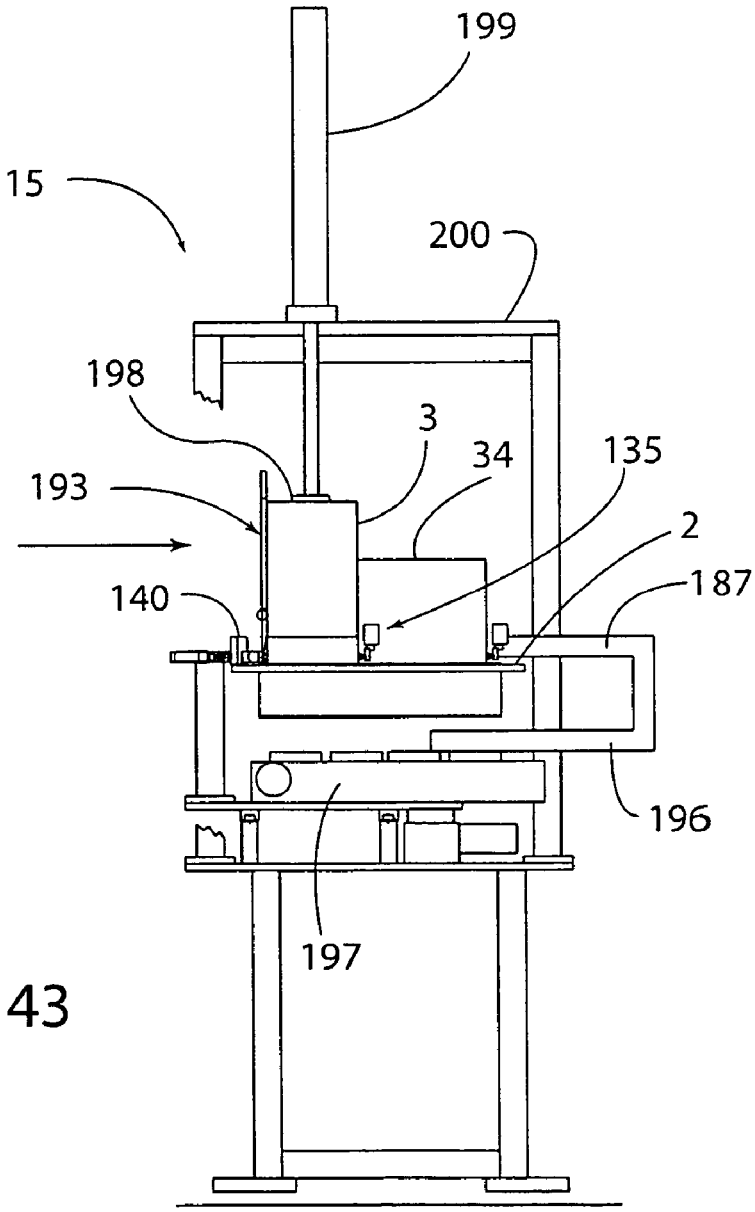
FIG. 43

FIG. 45
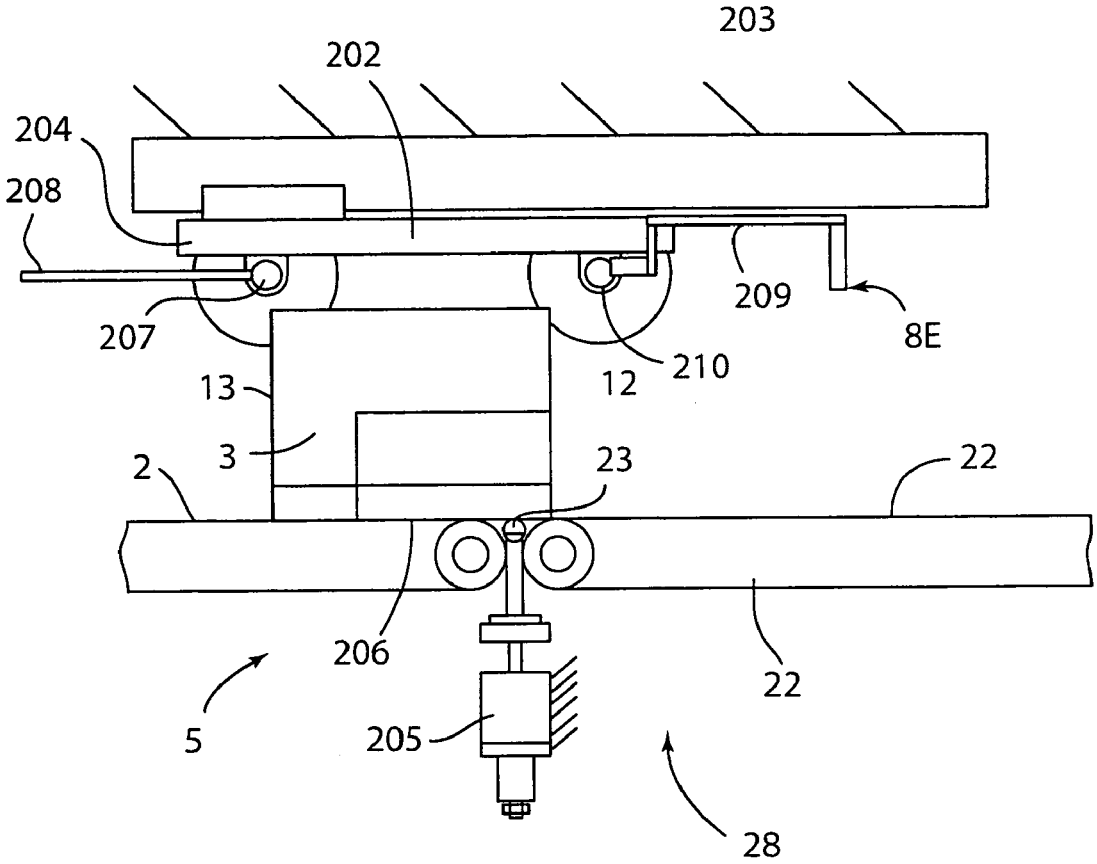
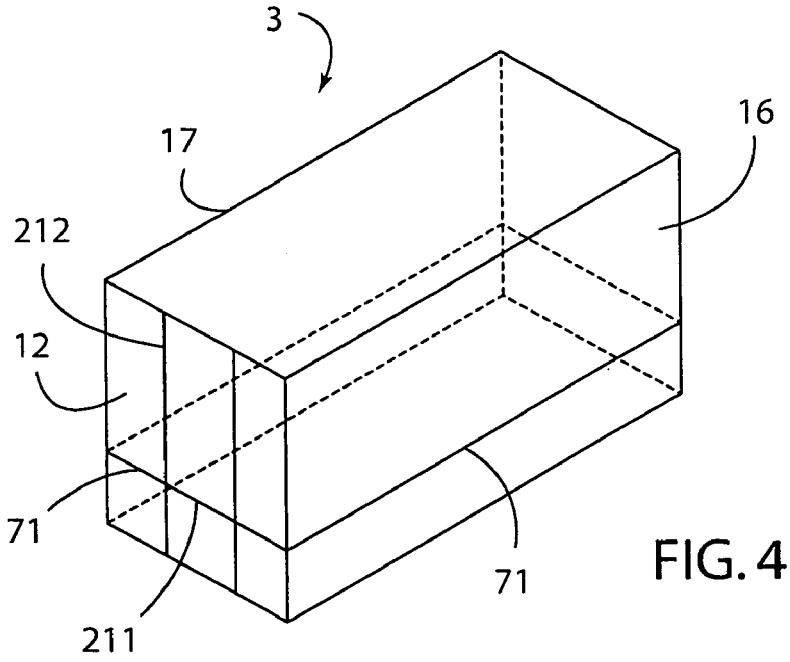
FIG. 45A

FIG. 68
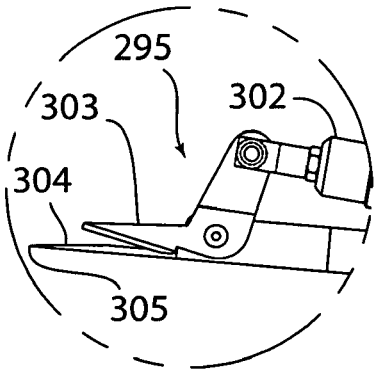
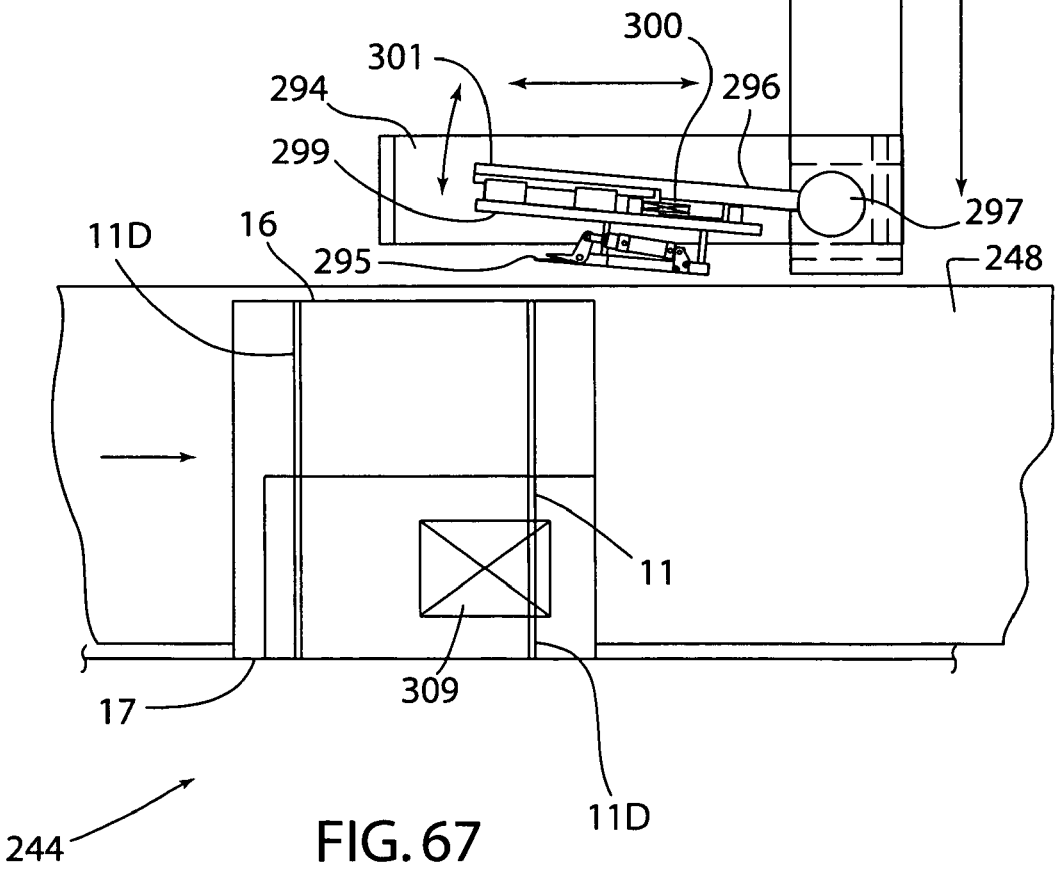
FIG. 67

DE-PACKAGING MACHINE

CROSS-REFERENCE TO RELATED APPLICATIONS

The present application claims the benefit of U.S. Provisional Application No. 60/475,610, filed on Jun. 4, 2003, and of U.S. Provisional Application No. 60/475,611, filed on Jun. 4, 2003, the entire contents of each of which are hereby incorporated by reference.

BACKGROUND OF THE INVENTION

1. Field of the Invention

The present invention relates to de-packaging machines, and in particular to a de-packaging machine that can remove plastic film wrap and/or bands from packages.

2. Description of the Related Art

Magazines or the like may be shipped in bundles including numerous stacks of magazines forming relatively large rectangular packages. The bundles may be wrapped in a plastic film such as stretch or shrink wrap, and/or plastic bands. Removal of the plastic film and/or bands has been done manually during the shipping or mailing process. Such manual removal is labor intensive, and also causes a "bottleneck" in the package sorting process which is otherwise highly automated.

SUMMARY OF THE INVENTION

One aspect of the present invention is a de-packaging system for removing film and bands from packages. The de-packaging system includes a first conveyor configured to move packages along the de-packaging system. The de-packaging system also includes a loading station associated with the first conveyor for loading packages onto the conveyor, and a film cutting station associated with the first conveyor. The film cutting station includes a cutter having an elongated cutting element that can be heated to cut film on packages. A band cutting station associated with the first conveyor includes a cutting blade for cutting bands wrapped around packages. A stripper associated with the first conveyor has a clamp configured to clamp bands on packages for removal of the bands. The de-packaging system further includes a second conveyor having an upstream end adjacent a downstream end of the first conveyor. A device applies force to packages to move packages from the first conveyor to the second conveyor, and at least one friction member positioned adjacent the first and second conveyors strips film from packages as they are moved from the first conveyor to the second conveyor.

Another aspect of the present invention is a de-packaging system for removing film from packages. The de-packaging system includes a conveyor configured to move packages along the de-packaging system, and first and second horizontal hot wire cutters that make horizontal cuts in film on opposite sides of packages. First and second vertical hot wire cutters make vertical cuts on a front side of packages. The de-packaging system also includes a third horizontal hot wire cutter that makes horizontal cuts across a front side of packages at substantially the same height as the first and second horizontal hot wire cutters. At least one friction member engages film on the bottoms of packages to pull the film off the bottom of the packages.

Yet another aspect of the present invention is a de-packaging machine for removing bands from packages. The de-packaging machine includes a conveyor for moving banded packages, and a cutter device including a first base, a cutter head movably mounted to the first base, and a first powered actuator that moves the cutter head between a retracted position and an engaged position adjacent the conveyor. The cutter device includes a pair of cutting blades and a second powered actuator operably coupled to at least a first one of the cutting blades and providing powered movement thereof relative to a second one of the cutting blades. The de-packaging machine also includes a clamp device including a second base, a clamp head, and a third powered actuator that moves the clamp head between a retracted position and an engaged position adjacent the conveyor. The clamp head includes first and second clamp members, and a fourth powered actuator operably connected to at least one of the clamp members to move the at least one clamp member and clamp bands between the first and second clamp members to pull bands from packages.

These and other features, advantages, and objects of the present invention will be further understood and appreciated by those skilled in the art by reference to the following specification, claims, and appended drawings.

BRIEF DESCRIPTION OF THE DRAWINGS

FIG. 9 is a front view of a hot wire cutter including two wires according to another aspect of the present invention;

FIG. 9A is an end view of the hot wire cutter of FIG. 9;

FIG. 10 is a side view of the hot wire cutter of FIG. 9;

FIG. 11 is a front view of a hot wire cutter including actuators that push against the wires to form a concave shape;

FIG. 11A is a top plan view of the hot wire cutter of FIG. 11;

FIG. 12 is a side view of the hot wire cutter of FIG. 11;

FIG. 21 is a fragmentary, partially schematic plan view of the de-banding station of FIG. 13 showing the cutter cutting the band, and the clamp shoe clamping the band;

FIG. 22 is an enlarged view of the clamp shoe of FIG. 21;

FIG. 23 is an enlarged view of the cutter of FIG. 21;

FIG. 31 is a fragmentary, partially schematic plan view of the de-banding station showing the clamp shoe and cutter directly adjacent a package;

FIG. 32 is an enlarged view of the clamp shoe of FIG. 31;

FIG. 33 is an enlarged view of the cutter of FIG. 31;

FIG. 34 is a fragmentary, partially schematic plan view of the de-banding station showing the clamp shoe and cutter engaging a band just prior to cutting of the band;

FIG. 35 is an enlarged view of the clamp shoe of FIG. 34;

FIG. 36 is an enlarged view of the cutter of FIG. 34;

FIG. 37 is a fragmentary, partially schematic plan view of the de-banding station showing the clamp shoe clamping the band, and the cutter cutting the band;

FIG. 38 is an enlarged view of the clamp shoe of FIG. 37 showing the clamp shoe clamping a band;

FIG. 39 is an enlarged view of the cutter of FIG. 37 showing the cutter cutting a band;

FIG. 43 is a partially schematic side elevational view of the de-banding station showing the front side of a package that is being de-banded;

FIG. 44 is an enlarged view of the fence of the de-banding station of FIG. 43;

FIG. 45 is a fragmentary, partially schematic side elevational view showing the front horizontal hot wire cutter and push mechanism that pushes the packages from the first conveyor to the second conveyor across friction points to strip film from the package;

FIG. 45A is a plan view of a package showing the horizontal and vertical cuts in the film immediately prior to removal of the film from the package;

FIG. 67 is a plan view of the fourth station of the de-packaging machine of FIG. 59, wherein the view is taken perpendicular to the main conveyor;

FIG. 68 is an enlarged view of the band cutter of FIG. 67;

DETAILED DESCRIPTION OF PREFERRED EMBODIMENT

Figure 1:
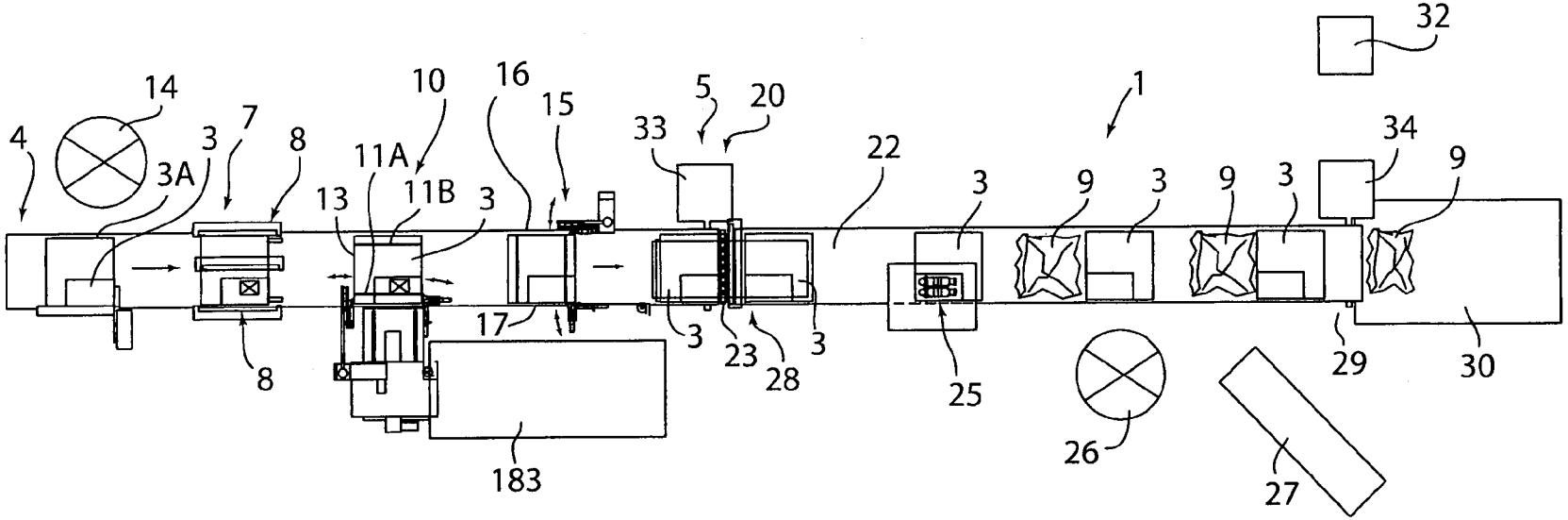
FIG. 1 is a partially schematic plan view of a de-packaging machine for de-banding and removal of shrink wrap material according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a de-packaging machine or system 1 includes a first conveyor 2 configured to move packages 3 along the de-packaging system 1. The packages 3 are wrapped in plastic shrink wrap or stretch wrap, and have a rectangular shape that can vary in size from a relatively large package indicated by the outer perimeter 3A, or may have a small size indicated by the rectangle 3B. It will be understood that the de-packaging system 1 may be utilized to remove a wide variety of films and the like from packages. Also, the packages 3 may have a single band 11 extending around front face 12 of package 3 and rear face 13 of package 3. Although the position of band 11 may vary, it will fall within the range indicated by the bands 11A and 11B. Alternately, a band 11 may extend around sides 16 and 17 of package 3 within the range indicated by bands 11C and 11D. The first conveyor 2 defines an upstream end 4, and a downstream end 5. A loading station 6 provides for loading packages 3 on the first conveyor 2 by a first operator 14. After the packages 3 are loaded onto the conveyor 2, they are moved to a film cutting station 7. As described in more detail below, film cutting station 7 includes a plurality of hot wire cutters 8 that melt and cut the shrink wrap material on the packages 3. After the film on the package is cut at film cutting station 7, the packages 3 are moved by the conveyor 2 to a first band cutting station 10. As described in more detail below, the first band cutting station cuts bands 11 that are wrapped around the package 3 and extend across the front side 12 and rear side 13 of packages 3. The conveyor 2 then moves the packages 3 to a second band cutting station 15 for removal of bands 11 that are oriented in such a manner that they extend across the sides 16 and 17 of packages 3. It will be understood that the packages 3 normally have only a single band 11 that is located somewhere within the range shown by the two spaced apart bands 11. The single band 11 is oriented to wrap around either front and rear sides 12, 13, or to wrap around sides 16, 17 of packages 3.

After the de-banding operation (if required) at the second band cutting station 15, the first conveyor 2 then moves packages 3 to a film removal device 20. As also described in more detail below, the film removal device 20 pushes the packages 3 from the first conveyor 2 to a second conveyor 22. Second conveyor 22 includes an upstream end 28 adjacent downstream end 5 of first conveyor 2, and also includes a downstream end 29. As the packages 3 are pushed from the first conveyor 2 to the second conveyor 22, one or more pop-up friction pads 23 contact the bottom of the packages 3 to thereby pull the film from the underside of the package 3. The packages 3 are then transported to a pinch mechanism 25 (described in more detail below) that pinches the film and lifts it upwardly, thereby removing it from the package 3. The conveyor then moves the packages 3, and the pinch mechanism 25 is released to drop the shrink wrap 9 on the second conveyor 22 behind the package 3 that has just had the film 9 removed therefrom. A second operator 26 then removes the package 3 and places it on a cart 27 for transport to the next stage of the shipping process. The second conveyor 22 then transports the film 9 to the downstream end 29 of second conveyor 22 where it falls into a bin 30. A controller 32 is operably connected to a first drive mechanism 33 that powers the first conveyor 2, and controller 32 is also operably coupled to a second drive mechanism 34 that powers the second conveyor 22. The first and second drive mechanisms 33 and 34 utilize known electrical servo drive motors that start and stop the conveyors 2 and 22 to move the packages 3 from station to station.

Figure 2:
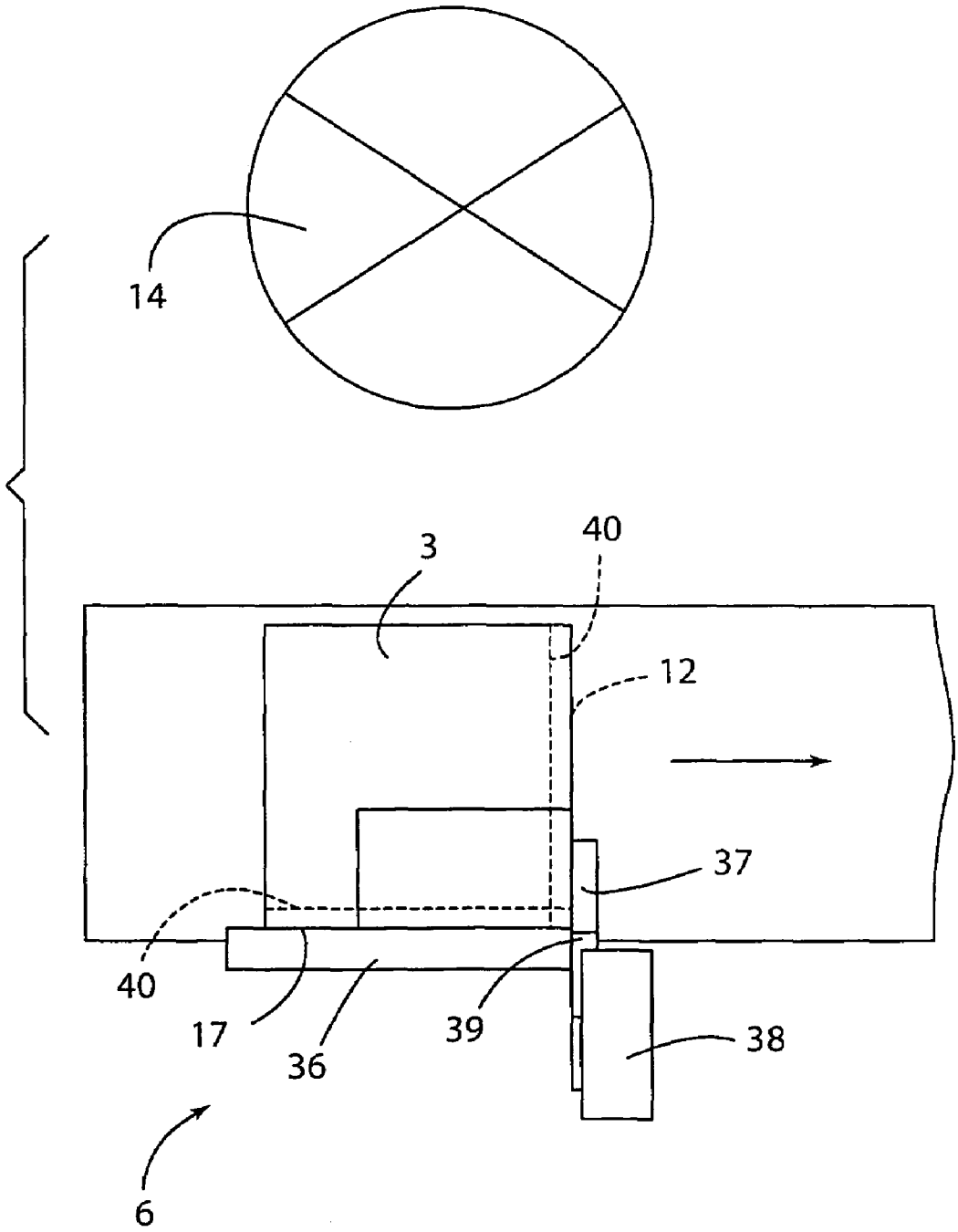
FIG. 2 is a fragmentary, partially schematic plan view of the loading station of the de-packaging machine of FIG. 1.

With further reference to FIG. 2, loading station 6 includes a fixed stop 36 and a retracting stop 37. The operator places the package 3 on the first conveyor 2, with the stop 37 in the extended position, with the front side 12 of package 3 contacting stop 37, and with side 17 of package 3 contacting fixed stop 36 to thereby position the package 3 on the conveyor 2. Retracting stop 37 includes a powered actuator 38 that retracts the stop 37 to the position 39 to provide clearance to allow the package 3 to move along conveyor 2 after loading. The loading station 6 may include a plurality of sensors to determine the length and width of package 3, and this information is provided to the controller 32 to control the various stations in the de-packaging system. For example, a plurality of fiber optic light beams 40 could be spaced at ½ inch intervals to determine the length, width, and height of the package 3. The vertical dimension could be determined by placing such fiber optic sensors vertically along the fixed stop 37 or other suitable structure. It will be readily understood that a wide variety of sensors could be utilized to measure the dimensions of the package 3.

Figure 3:
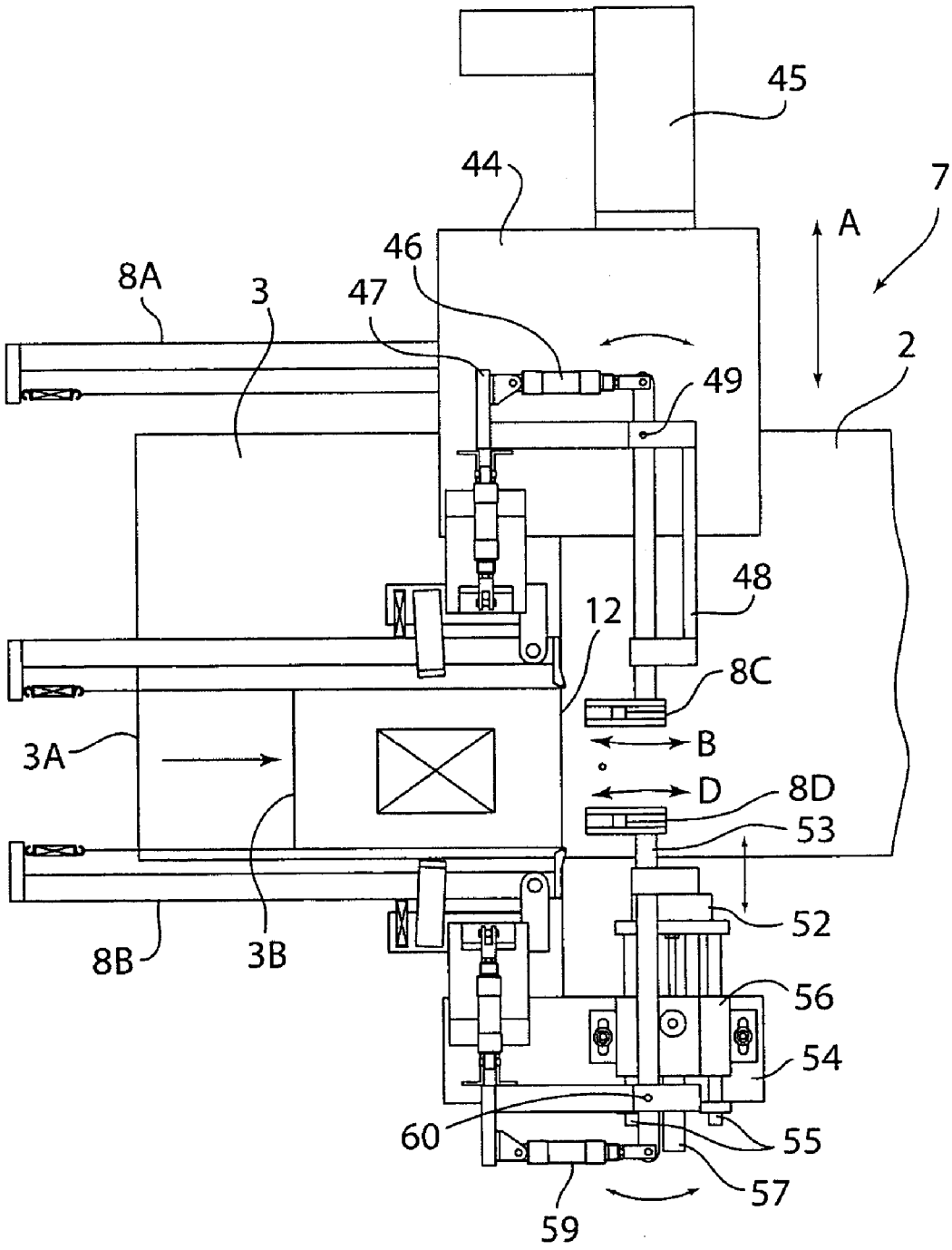
FIG. 3 is a partially schematic plan view of the wire cutting station of the de-packaging machine of FIG. 1.
Figure 4:
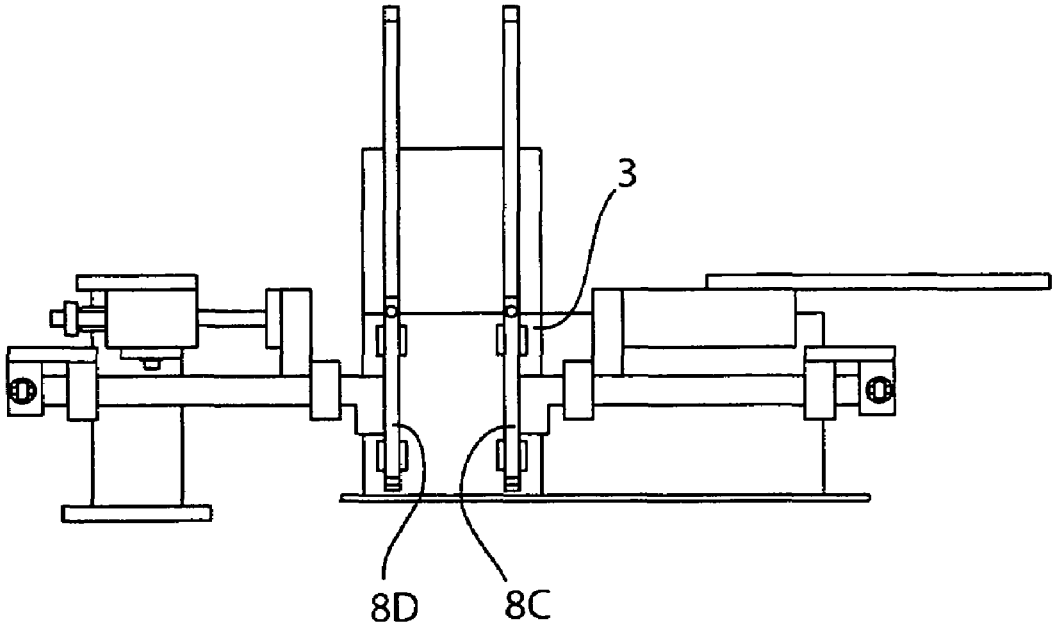
FIG. 4 is a partially schematic side elevational view of the wire cutting machine of FIG. 1 showing the front side of a package.
Figure 5:
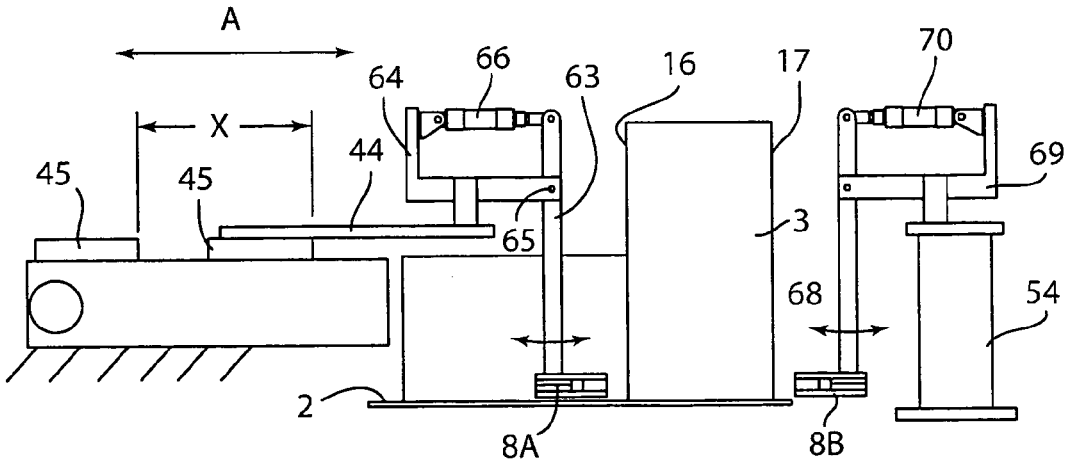
FIG. 5 is a partially schematic plan view of the wire cutting station of the de-packaging machine of FIG. 1 showing the rear side of a package.

With reference to FIGS. 3–5, after the packages 3 are loaded at loading station 6, conveyor 2 transports the packages 3 to the film cutting station 7, and the controller 32 then stops the conveyor while the film on the packages 3 is cut. Film cutting station 7 includes a first horizontal hot wire cutter 8A, and a second horizontal hot wire cutter 8B. Wire cutter 8A is mounted to a movable base 44, and shifts horizontally in the direction of the arrow "A" to accommodate packages of sizes 3A, 3B or any package size between the sizes 3A and 3B based upon information from the sensors at loading station 6. An electrical servo drive 45 is operably coupled to the controller 32, and shifts the base 44 the required distance for the particular package size. The base 44 may be mounted on any suitable linear guide of the type well-known to those skilled in the relevant art. In addition to the first and second horizontal hot wire cutters 8A and 8B, film cutting station 7 also includes a first vertical hot wire cutter 8C and a second vertical hot wire cutter 8D that cut film on the front side 12 of package 3. The first vertical hot wire cutter 8C is mounted on base 44, and shifts horizontally with hot wire cutter 8A in the direction of the arrow "A" to accommodate different sized packages. An actuator such as a pneumatic cylinder 46 is mounted to the base 44 by a bracket structure 47, and rotates support arm 48 about pivot 49 to thereby shift vertical hot wire cutter 8C into contact with film on front side 12 of package 3. The vertical hot wire cutter 8C is thereby moved into and out of contact with the front side 12 of package 3 as indicated by the arrow "B". The pneumatic cylinder 46 is controlled by controller 32 utilizing known electrically powered valves and the like (not shown). All of the pneumatic cylinders, servo motors, and other powered actuators of the de-packaging system 1 may be operably coupled to the controller 32 in a known manner.

A powered actuator such as pneumatic cylinder 59 rotates the vertical hot wire cutter 8D about a pivot 60 relative to the fixed base 54 to thereby shift the vertical hot wire cutter 8D into and out of contact with front side 12 of package 3 as indicated by the arrow "D". Second vertical hot wire cutter 8D is mounted to a movable base 52 via a short support arm 53. The movable base 52 is movably mounted to a fixed base 54 via rods 55 and pillow blocks 56 or other suitable linear guide. A linear actuator such as pneumatic cylinder 57 provides for extension and retraction of the vertical hot wire cutter 8D as indicated by the arrow "C". The vertical hot wire cutter 8D may thereby be retracted after cutting film on the package 3 to permit the package to move to the next station. Similarly, electrical servo drive 45 retracts base 44 and vertical hot wire cutter 8C after cutting to provide clearance to move the package 3 through to the next station 30.

Figure 6:
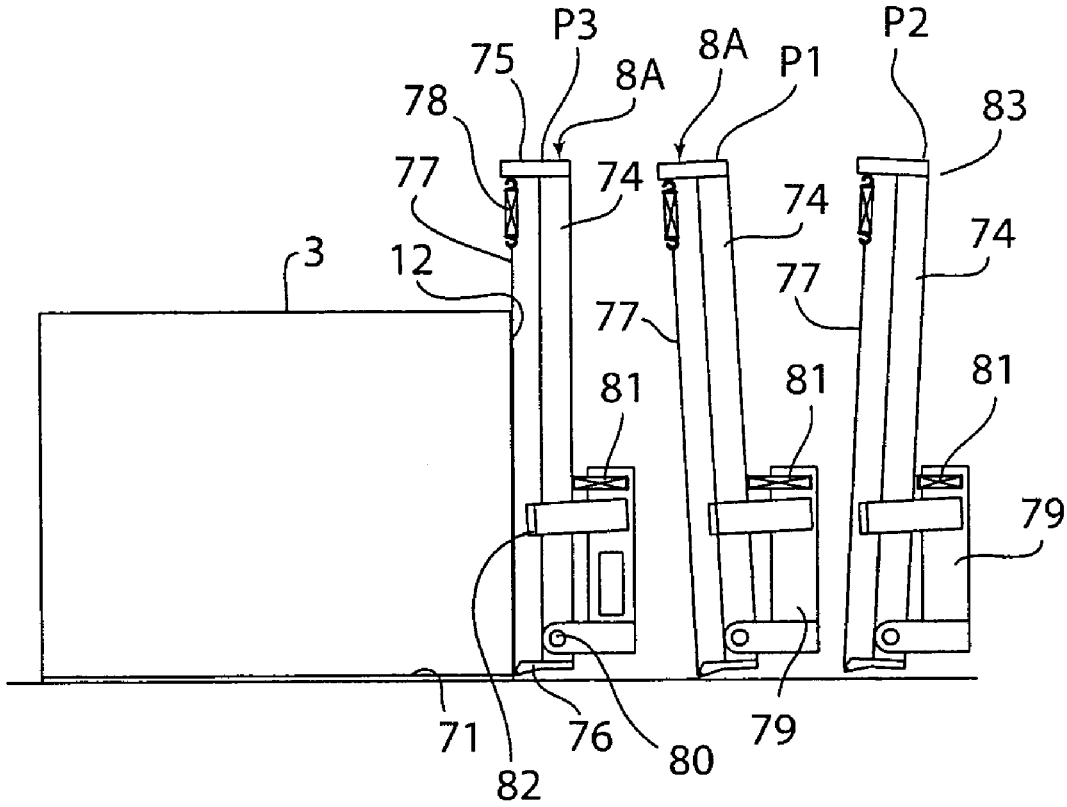
FIG. 6 is a partially schematic side elevational view showing the rotation of the vertical hot wire cutters.

With reference to FIG. 5, first horizontal hot wire cutter 8A is mounted on a vertically extending support arm 63 that is pivotably mounted to a bracket structure 64 at pivot 65. The bracket structure 64 is fixed to the movable base 44 and shifts in the direction of the arrow A a distance "X". A powered actuator such as pneumatic cylinder 66 is operably connected to the controller 32 and provides for powered rotation of support arm 63 and first horizontal hot wire cutter 8A about pivot 65 to thereby move the first horizontal hot wire cutter 8A into and out of contact with the lower portion of side 16 of package 3 to cut the film on package 3. Second horizontal hot wire cutter 8B is movably mounted to a fixed base 54 via vertically extending support arm 68, bracket structure 69, and pneumatic cylinder 70 for providing a horizontal cut in film 71 (see also FIG. 6) along the lower portion of side 17 of package 3. Support arm 68 rotates about pivot 67 upon actuation of cylinder 70.

As discussed above, the packages 3 may include stacks of magazines or the like. The individual magazines or other items in the package may slide relative to one another, such that the packages 3 may form a parallelogram shape or may have other irregularities in the side surfaces. To accommodate such irregularities, each of the hot wire cutters 8 may be rotatably mounted. For example, with reference to FIG. 6, first vertical hot wire cutter 8A includes an elongated support structure 74 with transverse wire supports 75 and 76 to which a wire 77 is secured. The wire is tensioned by a spring 78. Support structure 74 is pivotably mounted to a bracket 79 at a pin 80, and a compression spring 81 biases the support structure 74 in the counter-clockwise direction. A stop 82 limits the rotation of the support structure 74 to the position P1 when the wire 77 is not in contact with an object. If wire 77 contacts an object near the upper end 83 of hot wire cutter 8A, the support structure 74 will rotate until support structure 74 contacts bracket 79 in the position P2. Thus, as the wire cutter 8A is brought into contact with front side 12 of package 3, it rotates from the position P1 to the vertical position designated P3 wherein wire 77 is in full contact with front side 12 of package 3, even if front side 12 is not perfectly vertical.

Figure 7:
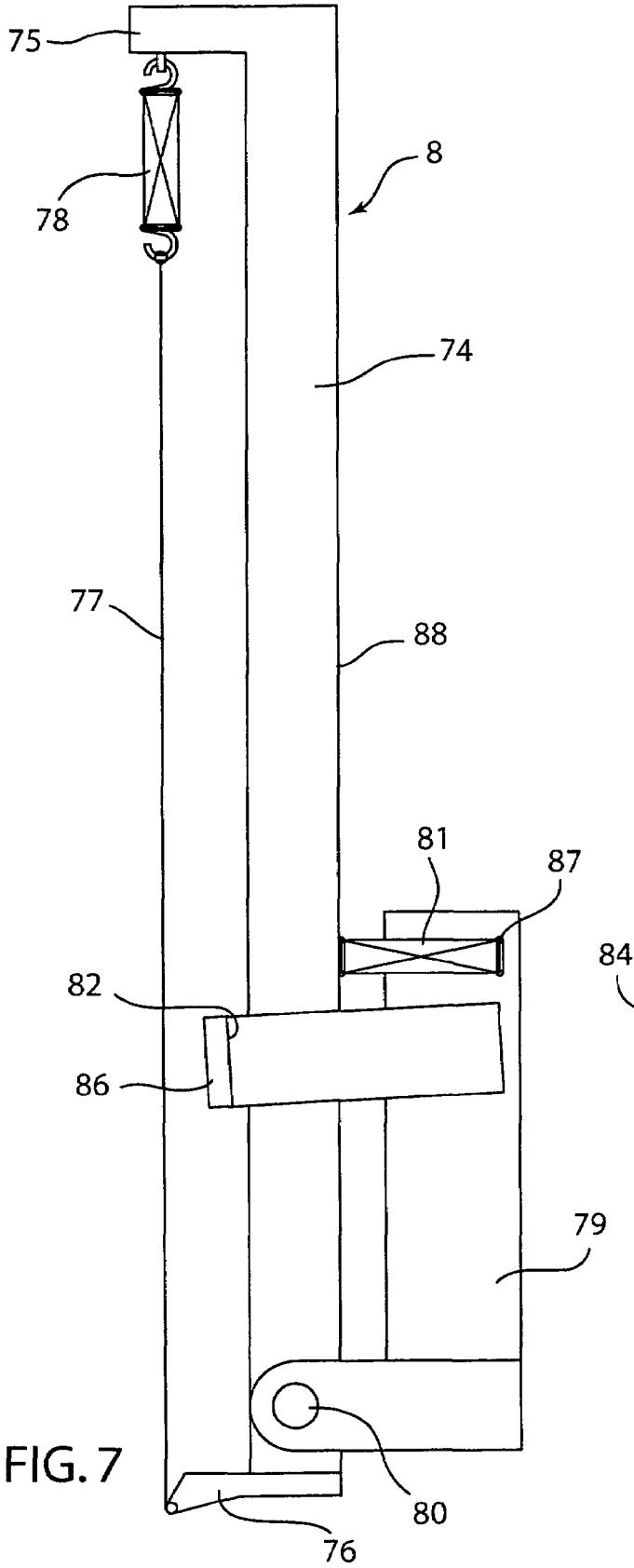
FIG. 7 is a front view of a hot wire cutter for the de-packaging machine of FIG. 1.
Figure 8:
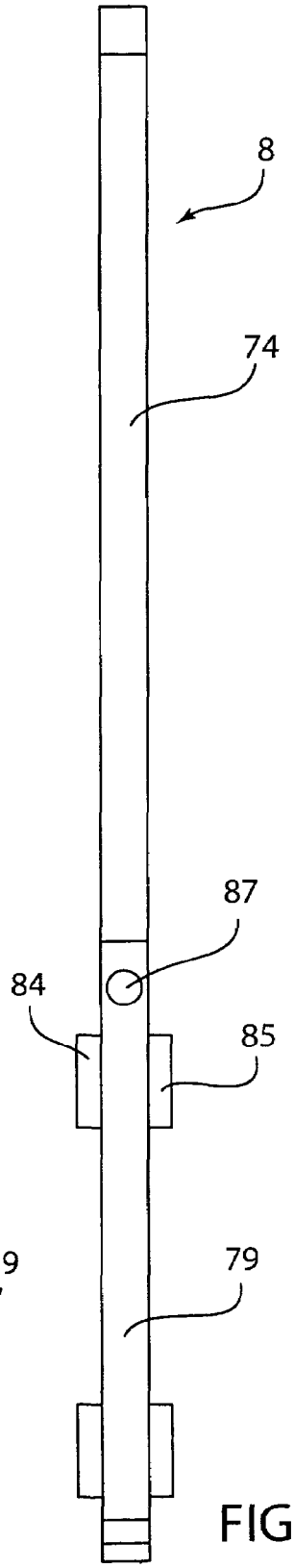
FIG. 8 is a side view of the hot wire cutter of FIG. 7.

With further reference to FIGS. 7 and 8, the hot wire cutters 8 include a pair of guides 84 and 85 that are secured to the bracket 79, and extend around the elongated support structure 74. Transverse ends 86 of guides 84 and 85 form stops 82. Compression spring may be mounted in a bore 87 in bracket 79 or may be mounted by other suitable means to bear on side edge 88 of elongated support structure 74. The compression spring 81 preferably provides about 5 pounds of force acting on elongated support structure 74. The wire 77 is preferably a 0.0159 inch diameter wire made of a CHROME® C alloy, and extension spring 78 preferably provides about 10 pounds of tension in wire 77. In general, the plastic film melts at around 300° F., and cuts or parts well at 350–400° F. The wire 77 in the illustrated example has a length of 1.67 feet, and about 1.3 amps will provide a wire temperature in the range of 400° F. In the illustrated example, this requires about 6.2 volts. Although the paper will begin to turn brown at around 550° F., a higher voltage may be applied to the wire 77 to provide a temperature of up to 700° F. At this temperature, the film can be cut without damaging the paper packaging if the time and contact with the shrink is limited to 1–2 seconds.

With further reference to FIGS. 9 and 10, a second embodiment 90 of the hot wire cutters may include a pair of hot wires 77A and 77B that are tensioned by springs 91 and 92 to provide about 10 pounds tension. Wire cutter 90 is rotatably biased in substantially the same manner as the hot wire cutter 8 described above in connection with FIGS. 7 and 8. The hot wires 77A and 77B are preferably 0.015 diameter nichrome wires that are spaced about 0.125 inches apart. Hot wire cutter 90 includes an elongated support structure 93 having an upper end 94 with connectors 95 and 96 for securing springs 91 and 92. Hot wires 77A and 77B extend over a ceramic wire guide 97 that is secured to the structure 93 via a bracket member 98. The ceramic wire guide 97 preferably has a cylindrical shape, with a pair of grooves 99 and 100 that are spaced 0.125 inches apart to provide for the proper spacing of the hot wires 77A and 77B. Similarly, a connector 101 also includes a pair of grooves 102 and 103 that are spaced apart 0.125 inches to provide for the proper spacing of the wires 77A and 77B. By utilizing a pair of closely spaced wires, the hot wire cutter 90 helps ensure that the film is cut completely. Because the film melts as it comes in contact with the wires 77A and 77B, the portion of the film between the wire 77A and 77B melts away, thereby providing a wide cut in the film and ensuring that portions of the film do not remain connected.

With further reference to FIGS. 11 and 12, another embodiment 110 of the hot wire cutters includes a support structure and hot wires 77A and 77B that are mounted in substantially the same manner as described above in connection with the hot wire cutter 90 of FIGS. 9 and 10. The hot wire cutter 110 includes an elongated plate member 111 that is secured to the structure 93 via cylindrical members 112, 113, and fasteners 115, 116, 117, and 118. Powered actuators such as pneumatic cylinders 119 and 120 are secured to the plate member 111. Ceramic contact members 123 and 124 are mounted to rods 125 and 126 that extend through elongated support structure 114 and connect to the pneumatic cylinders 119 and 120. The ceramic members 123 and 124 may include grooves 127, 128 that are spaced apart 0.125 inches to maintain the proper spacing between wires 77A and 77B. As discussed above, the various objects, such as magazines, in packages 3 may shift relative to one another, thereby creating a non-planar side surface on the packages 3. If the packages 3 have a concave side surface, the ceramic members 123 and 124 can be shifted to move the wires 77A and 77B outwardly to conform to the concave shape of the package and thereby ensure the film is cut.

Figure 13:
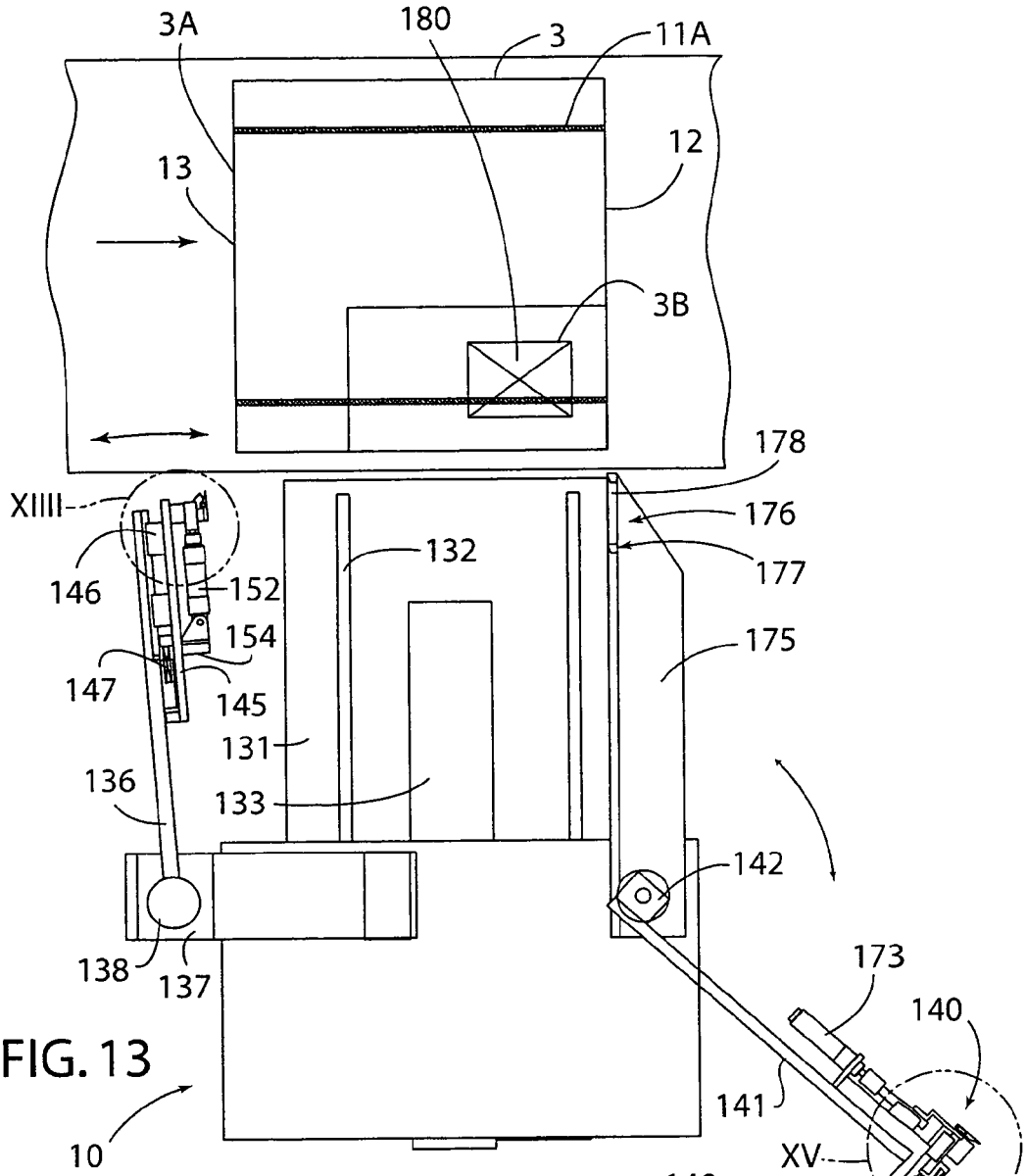
FIG. 13 is a fragmentary, partially schematic plan view of a second de-banding station of the de-packaging machine of FIG. 1 for removing bands that are oriented to extend across the front and rear sides of the package.
Figure 14:
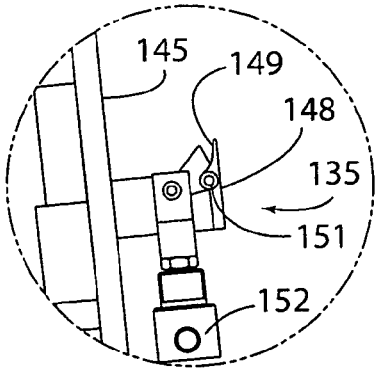
FIG. 14 is an enlarged view of the cutter of FIG. 13.

With further reference to FIG. 13, after the film is cut at the film cutting station 7, the conveyor 2 transports the packages 3 to the first band cutting station 10. As discussed above, the packages 3 may have a size in the range between the two outlines labeled 3A and 3B. Also, the packages 3 will normally only have a single band 11 that is positioned on the package 3 between the bands labeled 11A and 11B, or "sideways" between the bands labeled 11C and 11D (see also FIG. 28). Therefore, it should be understood that although two bands 11A and 11B are shown for purposes of illustrating one of the range of positions that the bands may fall within, an actual package will only have a single band 11 positioned in the range illustrated by the bands 11A and 11B (or 11C and 11D). The band cutting station 10 includes a movable base 130 that is movably mounted on a fixed base 131 via linear guides 132 or the like that slidably support movable base 130. A powered actuator 133 such as a pneumatic cylinder or electric servo motor shifts the movable base 130 horizontally, in a direction that is generally transverse to the first conveyor 2. A cutter head 135 is mounted on a support arm 136 that is rotatably connected to a cutter base 137 via a powered rotary actuator 138. The rotary actuator 138 may be a pneumatic rotary actuator such as a vane-type rotary actuator or a rack and pinion pneumatic mechanism or other rotary powered actuator known to those in the art. A clamp head 140 is mounted on a support arm 141 that is rotatably mounted to the movable base 130 by a powered rotary actuator 142 for rotary movement. As described in more detail below, once a package 3 is moved into position in the first band cutting station 10, the movable base 130 is shifted horizontally, and the cutter head 135 and clamp head 140 are rotated into position along the front side 12 and rear side 13 of package 3.

Cutter head 135 is mounted on a plate 145. Plate 145 is movably mounted to the support arm 136 via a linear guide 146. Linear guide 146 may be a linear guide of the type available from THK Co., Ltd of Tokyo, Japan. Because such commercially known linear guides are known to those in the art, they will not be described in further detail herein. A spring 147 biases the plate 145 outwardly, towards the end of support arm 136, and a sensor or switch (not shown) detects movement of plate 145 relative to support arm 136. During operation, as the movable base 130 is shifted horizontally, the cutter head will contact a band 11, causing the plate 145 to compress spring 147 and shift relative to support arm 136, thereby generating a signal to the controller 32. The controller 32 then turns off linear actuator 133 to stop movable base 130. The cutter head includes a shoe 148 having a tapered cutting edge 149 that slides under the bands 11 as the cutter head is moved into contact with the bands 11. A movable cutter blade 150 is pivotably interconnected with the shoe 148 at pivot 151, and is also pivotably connected to a powered actuator such as pneumatic cylinder 152 at pivot 153. Pneumatic cylinder 152 is connected to the plate 145 by a bracket 154, such that actuation of the pneumatic cylinder 152 causes the blade 150 to pivot, thereby cutting bands 11 that are positioned between cutting blade 150 and shoe 148.

Figure 15:
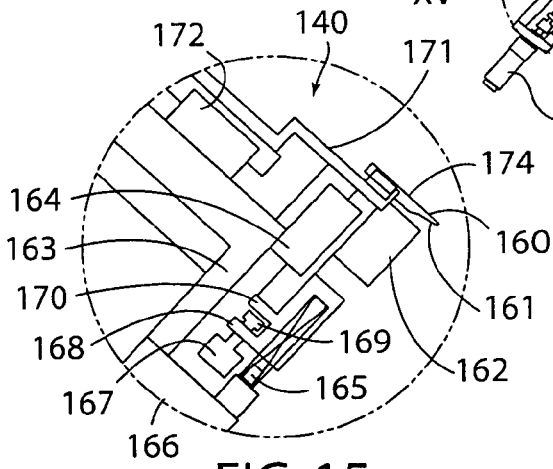
FIG. 15 is an enlarged view of the clamp shoe of FIG. 13.

With reference to FIG. 15, clamp head 140 includes a clamp shoe 160 having a tapered surface 161 configured to slide under bands 11 as clamp head 140 is horizontally shifted into engagement with the bands 11. A clamp member 162 is movably mounted to a bracket 163 by a linear guide 164. A compression spring 165 is secured to bracket 163 and biases clamp member 162 into clamping engagement with clamp shoe 160. A powered actuator 166 is operably coupled to the clamp member 162 by a connecting member 167 that is movably interconnected with a first extension 168. The range of motion of connector member 167 relative to clamp member 162 is limited by contact between the end 169 of connecting member 167 and first extension 168 and second extension 170. As the pneumatic cylinder 166 is retracted, end 169 contacts first extension 168, and thereby pulls the clamp member 162 away from clamp shoe 160. When actuator 166 is extended, clamp member 162 contacts a band or clamp shoe 160, and compression spring 165 provides a clamping force. However, when cylinder 166 is fully extended, end 169 does not contact second extension 170, such that the clamping force is only due to the spring 165. In this way, the clamping force can be controlled and kept relatively constant despite variations in the thickness of the band and travel distance of cylinder 166. Clamp head 140 also includes a stripper member 171 that is movably mounted to the bracket 168 via a linear guide 172. A powered actuator such as pneumatic cylinder 173 shifts the stripper 171, such that tines 174 extending on either side of clamp shoe 160 strip bands from the clamp head 140.

A structural extension member 175 is secured to the movable base 130, and includes a fence 176 formed by a vertically extending plate 177 having an opening 178 therethrough. As described in more detail below, a clamp 180 clamps down on the upper side of package 3 to hold it in position during the de-banding operation.

Figure 16:
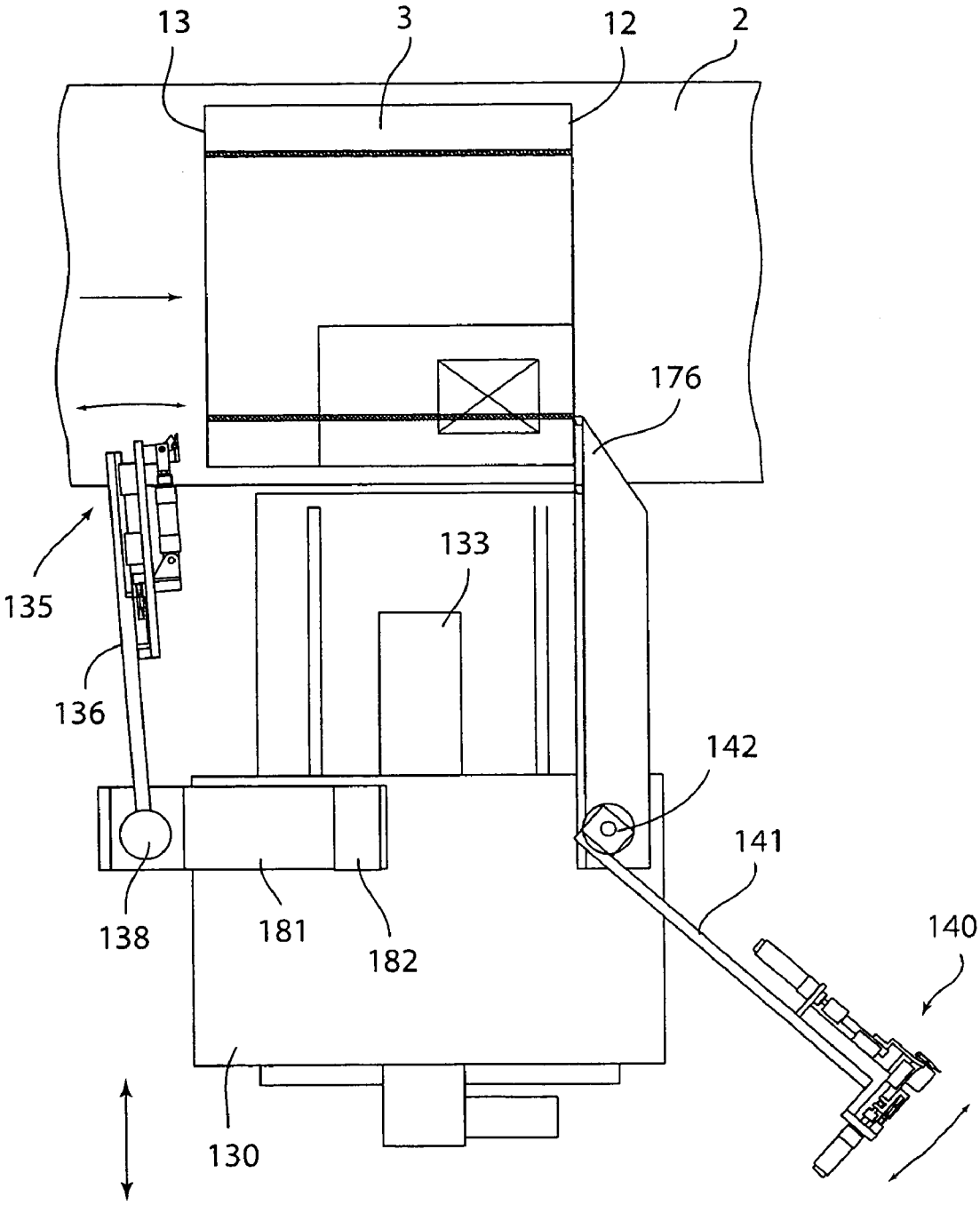
FIG. 16 is a fragmentary, partially schematic plan view of the de-banding station of FIG. 13 showing the clamp shoe and cutter in a horizontally shifted position.
Figure 17:
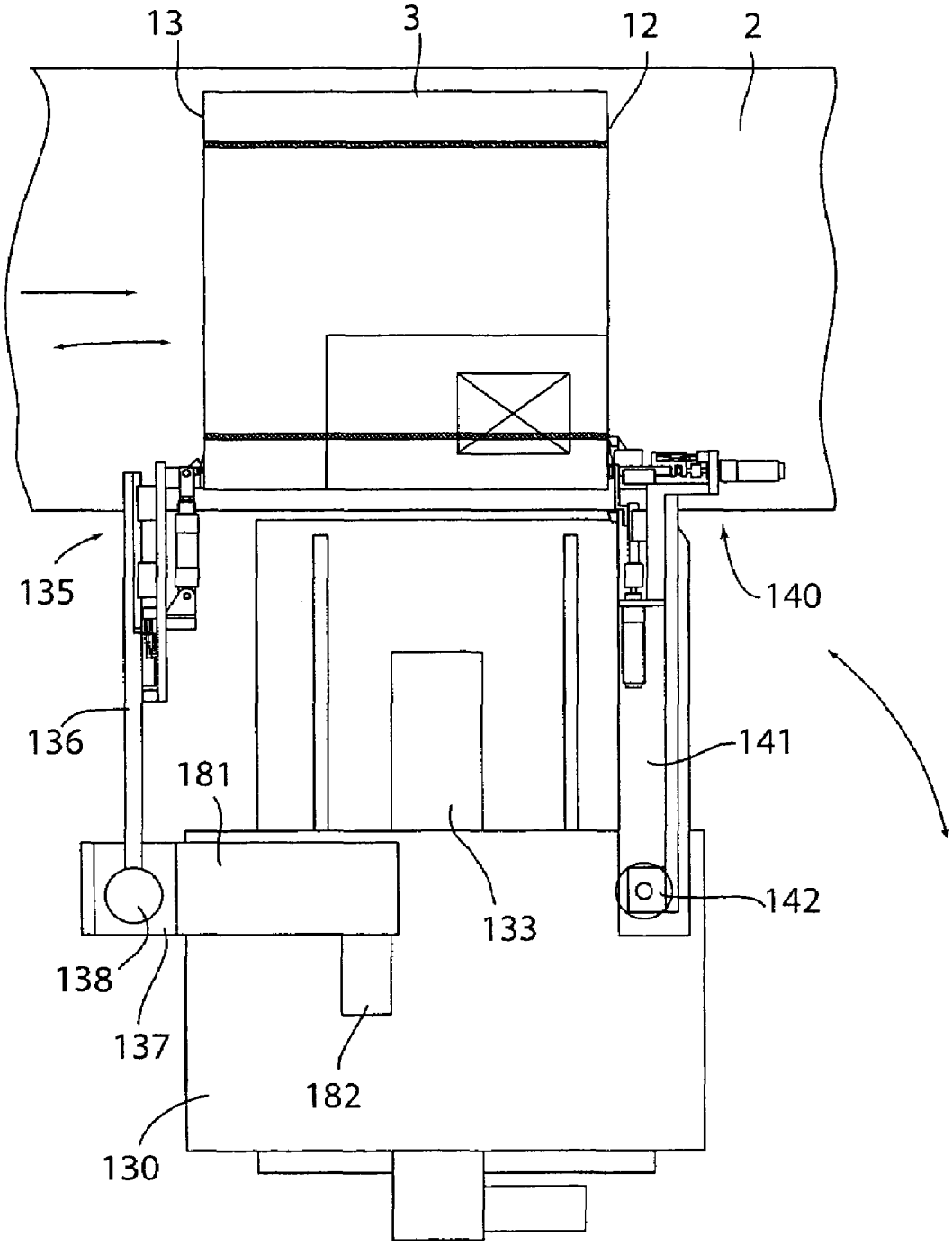
FIG. 17 is a fragmentary, partially schematic plan view of the de-banding machine of FIG. 13 showing the cutter and the clamp shoe rotated into engagement with the package.

With further reference to FIG. 16, during operation, the movable base 130 is first shifted horizontally by linear actuator 133, thereby moving fence 176 into a position adjacent front side 12 of package 3. With further reference to FIG. 17, powered actuator 138 then rotates cutting head 135 until it contacts rear side 13 of package 3, and powered actuator 142 rotates clamp head 140 until it contacts front side 12 of package 3. Powered actuators 138 and 142 provide a biasing force keeping the cutter head 135 and clamp head 140 in contact with the package 3 despite minor variations in the size and/or shape of the package 3. The clamp shoe 160 extends through opening 178 in fence 176. Cutter base 137 is movably mounted to base 130 by a linear guide 181 and linear actuator 182, such that the cutter head 135 can be horizontally translated to accommodate packages having different front-to-rear dimensions.

Figure 18:
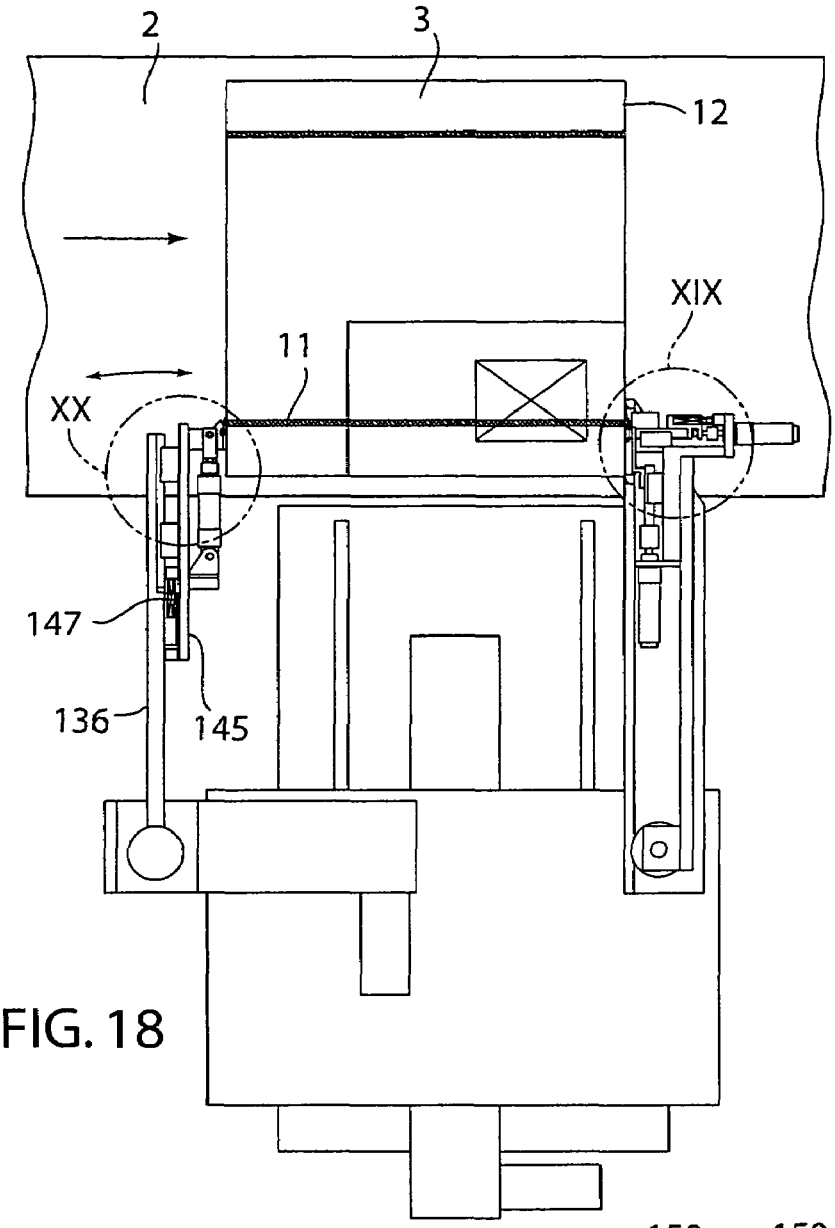
FIG. 18 is a fragmentary, partially schematic plan view of the de-banding machine of FIG. 13 showing the cutter and clamp shoe engaging a band immediately prior to cutting and clamping of the band.
Figure 20:
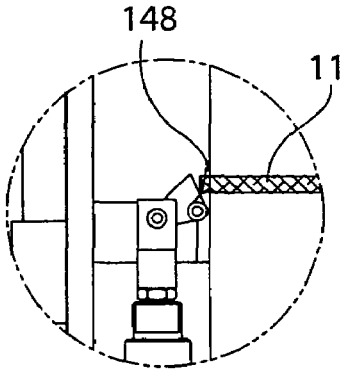
FIG. 20 is an enlarged view of the cutter of FIG. 18.
Figure 19:
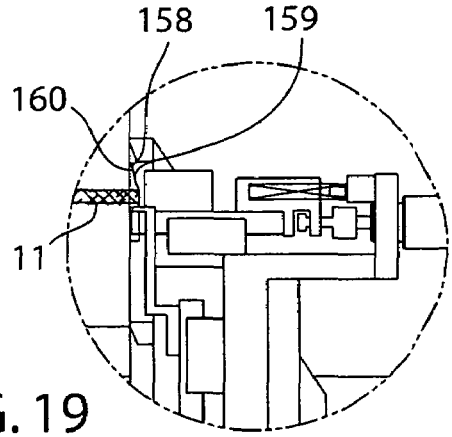
FIG. 19 is an enlarged view of the clamp shoe of FIG. 18.

With further reference to FIGS. 18–20, after clamp shoe 160 is brought into contact with front side 12 of package 3, and cutter shoe 148 is brought into contact with the rear side 13 of package 3 in the position illustrated in FIG. 17, the base 130 translates horizontally, thereby bringing the band 11 into contact with cutter shoe 148, and also bringing the clamp shoe 160 into contact with the band 11. As discussed above, as the base 130 moves, plate 145 will start to move relative to support arm 136, thereby compressing spring 147 and generating a signal to the controller 32. The controller 32 then stops translation of base 130. Clamp shoe 160 preferably includes a tapered cutting edge 159, and the tip 158 is radiused outwardly slightly away from front side 12 of package 3 to form a shape somewhat like the tip of a ski to prevent the clamp shoe 160 from digging into the magazines or other material in package 3. As the clamp shoe 160 slides across the side 12 of package 3, the tip 158 will slide under band 11. If film is wrapped over band 11, tip 158 will pierce the film, and edge 158 will cut the film to ensure that shoe 160 becomes positioned under band 11. If the shoe 160 encounters a vertical cut in the film on the front side 12 of package 3 prior to engagement with band 11, the tip 158 may go under the film, and cutting edge 159 will then cut the film until the shoe 160 encounters the band 11. Alternately, the tip 158 may go over the vertical cut in the film, and travel along the outer side of the film until the protrusion caused by band 11 is encountered, at which time the tip 158 will cut through the film and guide the shoe 160 under the band 11.

Figure 24:
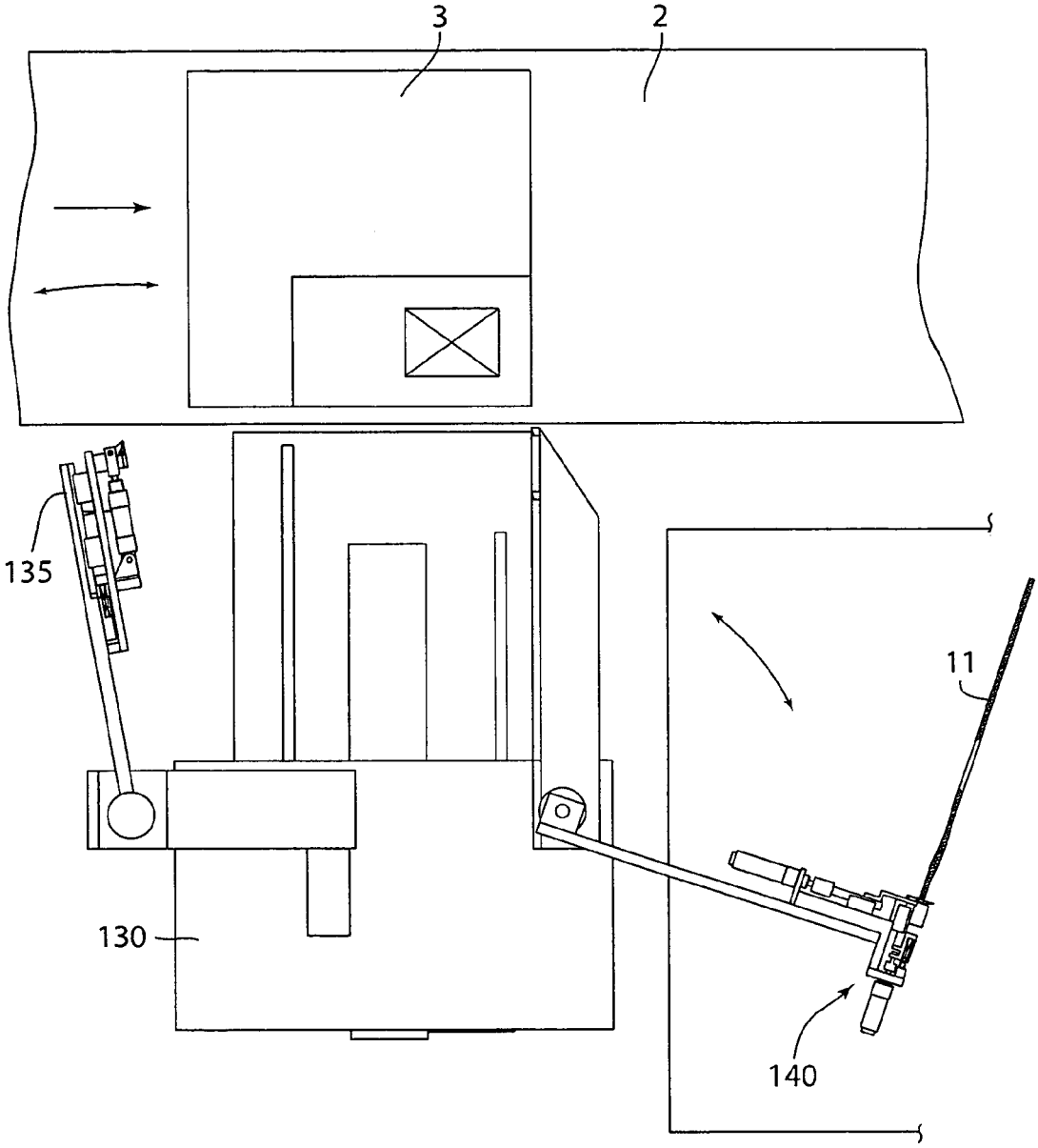
FIG. 24 is a fragmentary, partially schematic plan view of the de-banding station of FIG. 13 showing the cutter and clamp shoe horizontally shifted away from the conveyor and rotated to the retracted positions away from the package.

With further reference to FIGS. 21–23, after the cutter head and the clamp head engage a band 11, pneumatic cylinder 152 is then actuated to cut band 11, and pneumatic cylinder 166 is extended to clamp the band 11 in clamp head 140. The band 11 is preferably clamped before it is cut. With further reference to FIG. 24, after the band 11 is clamped and cut, clamp head 140 is rotated outwardly away from package 3 to strip the band 11 from the package 3, and cutter head 135 is rotated away from the package 3. The band 11 is pulled through fence 176 formed by opening 178 in plate 177. Fence 176 holds the film in place, and ensures that the film is not inadvertently pulled off with the band 11. The base 130 is then shifted away from package 3 so it can be moved to the next station by conveyor 2.

Figure 25:
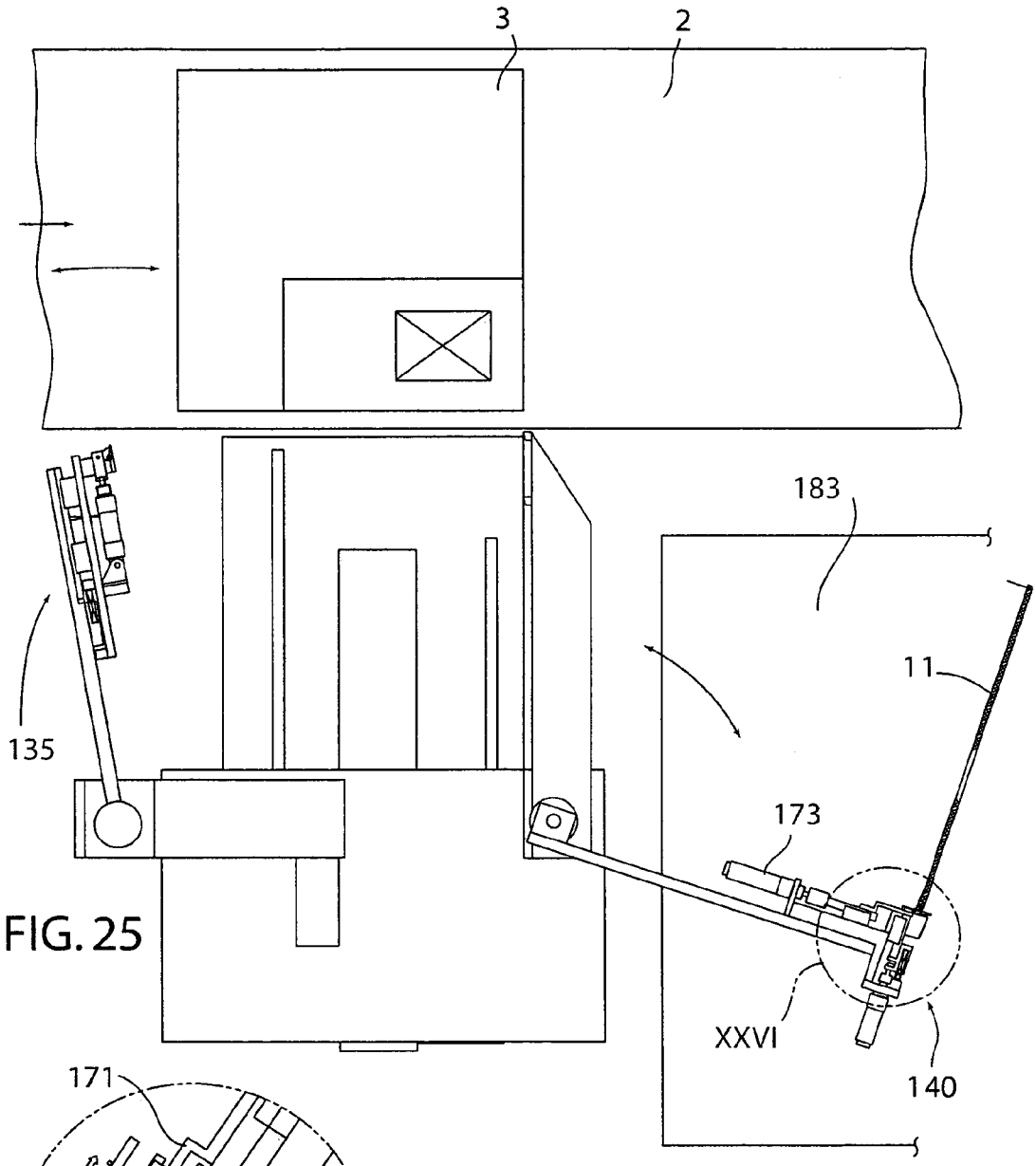
FIG. 25 is a fragmentary, partially schematic plan view of the de-banding station of FIG. 13 showing the clamp shoe stripping the band.
Figure 26:
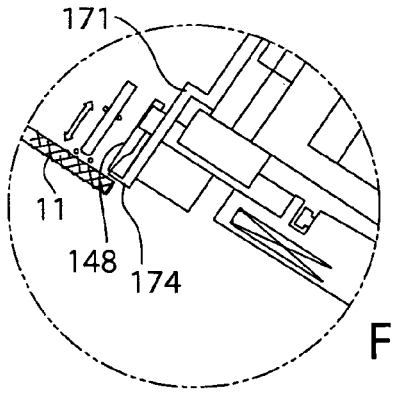
FIG. 26 is an enlarged view of the clamp shoe of FIG. 25.

With further reference to FIGS. 25 and 26, cylinder 173 is then actuated to extend the strip member 171, such that tines 174 push the band 11 off the shoe 148, causing the band 11 to drop into a bin 183.

Figure 27:
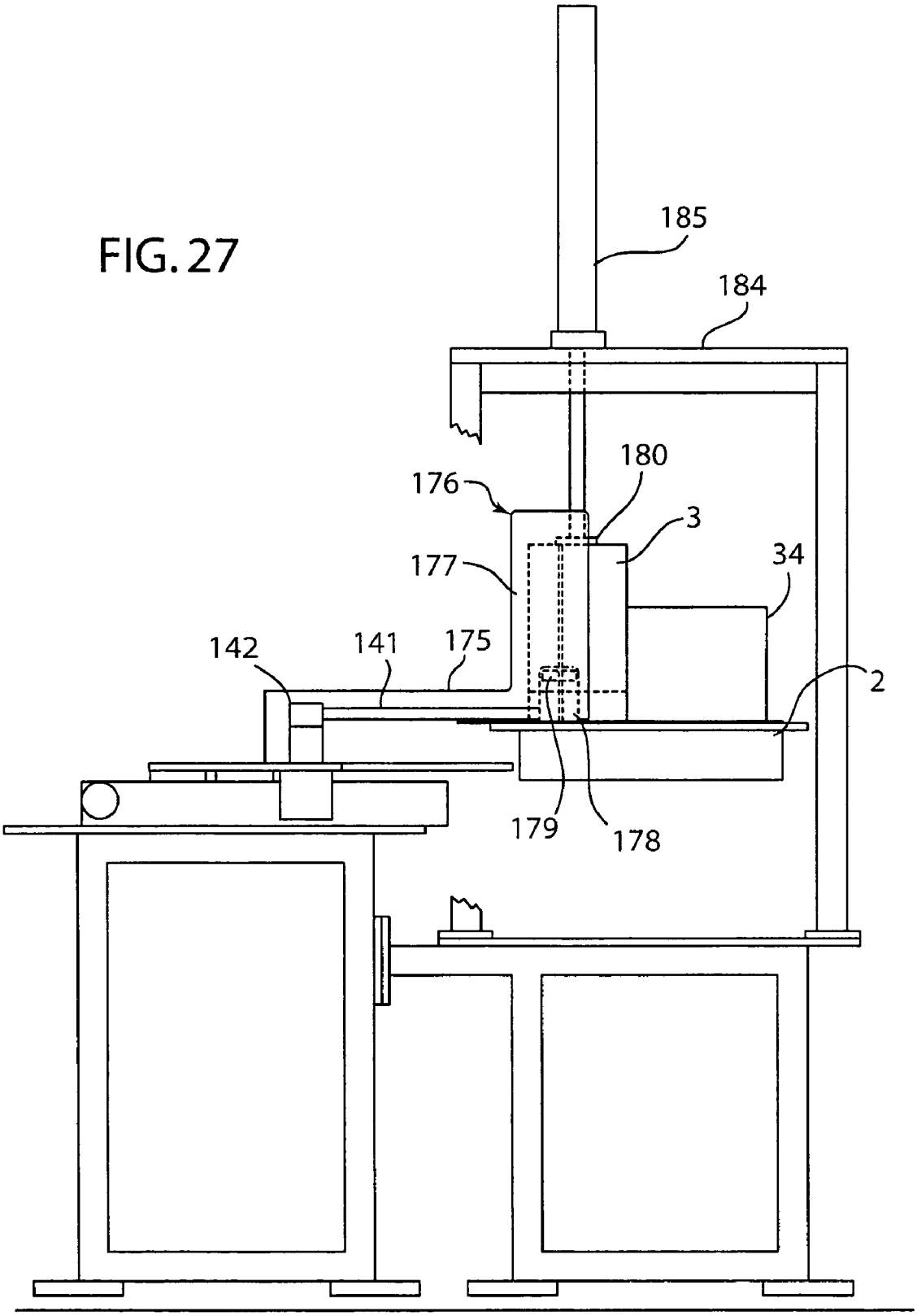
FIG. 27 is a fragmentary, partially schematic side elevational view of the de-banding station of FIG. 13 showing the front side of a package.

With further reference to FIG. 27, a powered actuator such as a pneumatic cylinder 185 is mounted to a support structure 184 to position the clamp 180 above a package 3 positioned on conveyor 2. As also seen in FIG. 27, fence 176 may include a roller 179 positioned adjacent a top edge of opening 178. Opening 178 is preferably formed by a U-shaped cutout in plate 177. The fence 176 retains the film against package 3 while the band 11 is pulled out through the opening 178.

Figure 30:
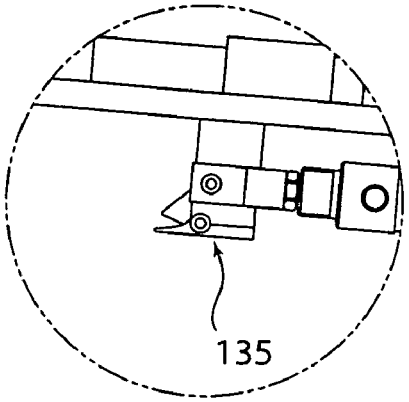
FIG. 30 is an enlarged view of the cutter of FIG. 28.
Figure 28:
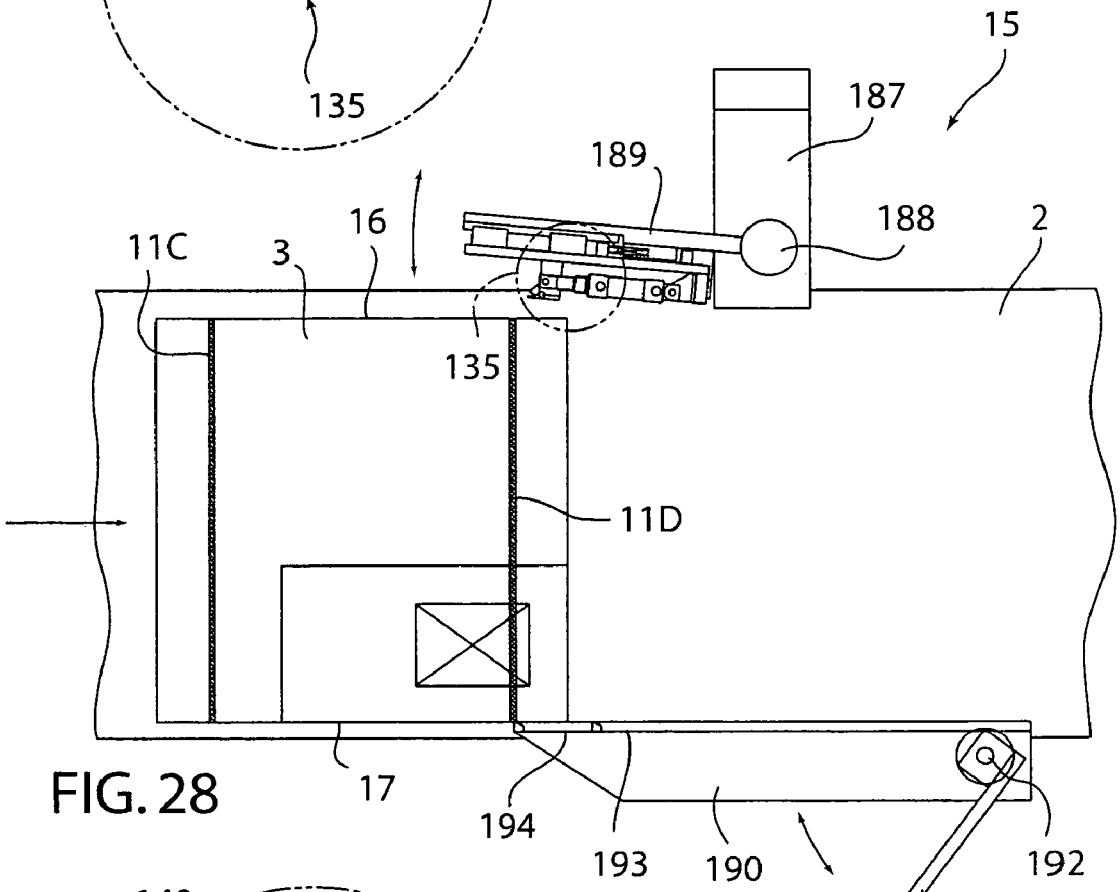
FIG. 28 is a fragmentary, partially schematic plan view of a de-banding station of the de-packaging machine of FIG. 1.
Figure 29:
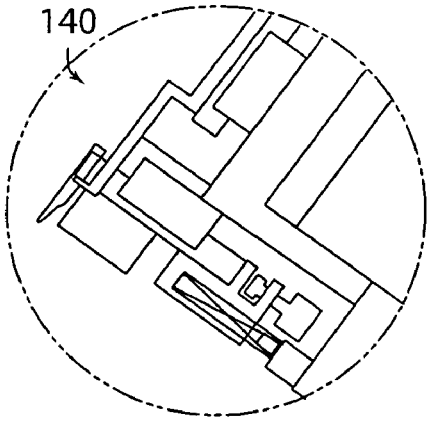
FIG. 29 is an enlarged view of the clamp shoe of FIG. 28.
Figure 29:
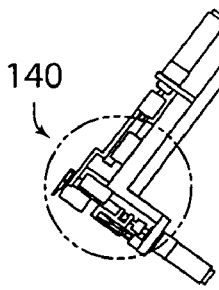

With further reference to FIGS. 28–30, after any bands 11 are removed at the first band cutting station 10, the package 3 is transported to the second band cutting station 15 by conveyor 2. Second band cutting station 15 includes a cutter head 135 and clamp head 140 that are substantially identical to the cutter head and clamp head described in detail above. Cutter head 135 is mounted on a base 187, and a powered rotary actuator 188 rotates the cutting head 135 on a support arm 189. As discussed below, base 187 is mounted on a powered guide that horizontally shifts support arm 189 to accommodate packages 3 of different widths. The clamp head 140 is mounted on a support arm 191 that is rotatably mounted to a base 190 by a powered rotary actuator 192. Base 190 includes a vertical plate 193 having an opening 194 therethrough having substantially the same configuration as the opening 178 in fence 176 described in more detail above. With further reference to FIGS. 31–33, as the package 3 is moved into the second band cutting station 15 by conveyor 2, powered actuator 188 rotates the cutting head 135 into contact with side 16 of package 3, and powered actuator 192 rotates clamp head 140 into contact with side 17 of package 3. With further reference to FIGS. 34–36, conveyor 2 continues to move the package 3 until cutter head 135 engages band 11, thereby causing cutter head 135 and plate 195 to shift relative to support arm 189, thereby generating a signal to the controller 32, at which time the controller stops movement of conveyor 2.

Figure 40:
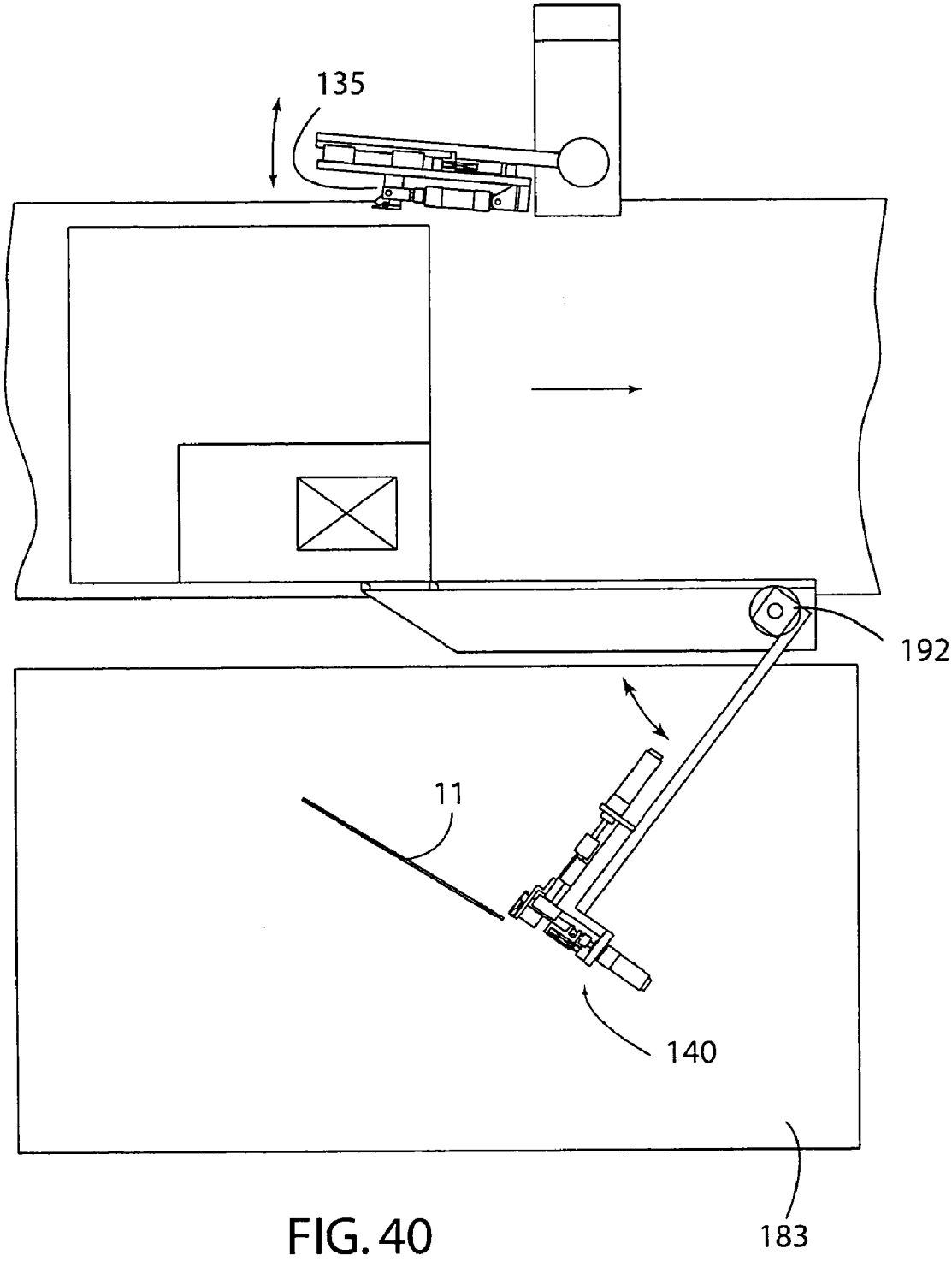
FIG. 40 is a fragmentary, partially schematic plan view of the de-banding station showing the cutter and clamp shoe in the retracted position away from the package.
Figure 41:
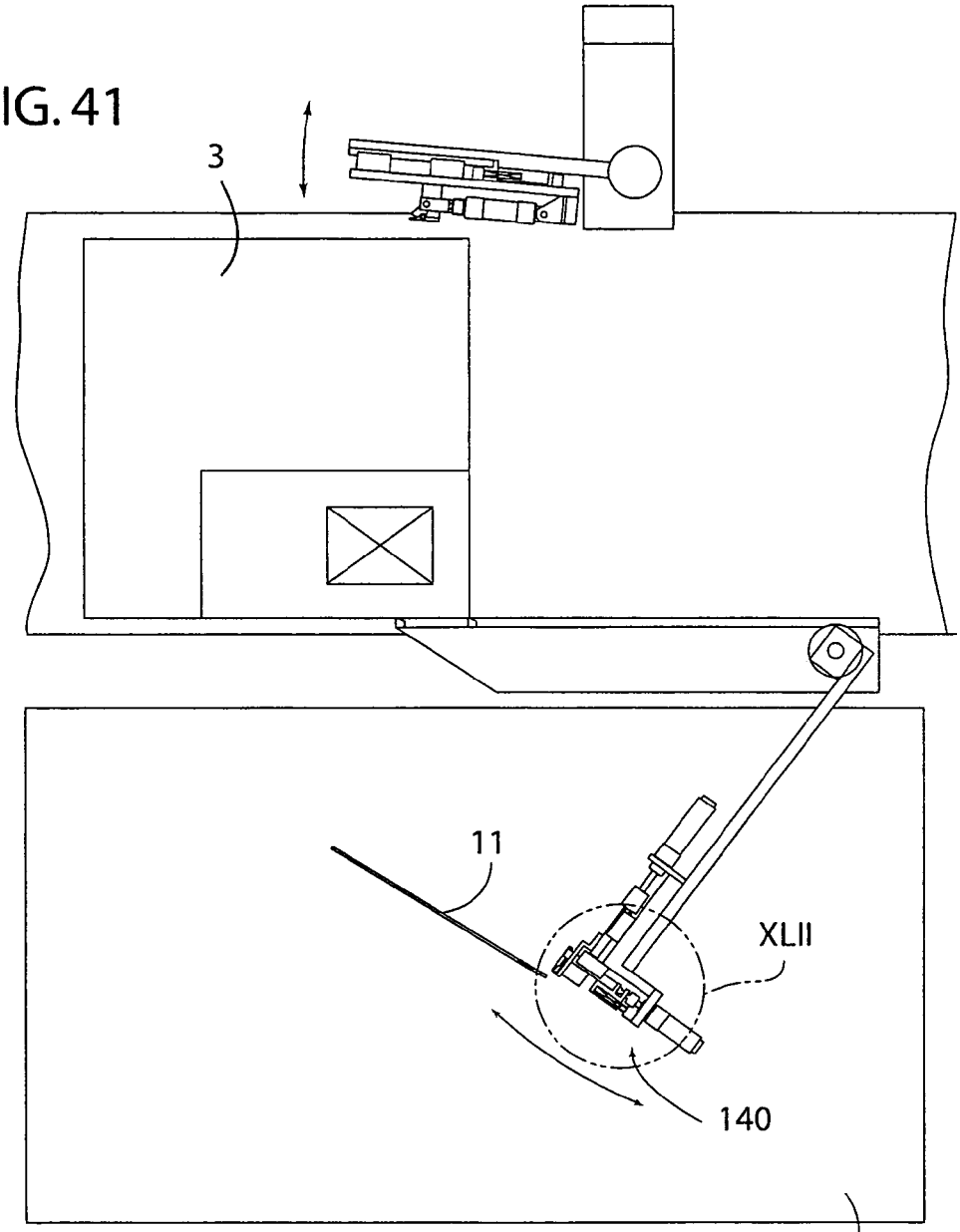
FIG. 41 is a fragmentary, partially schematic plan view of the de-banding station showing the clamp shoe stripping the band into a bin.
Figure 42:
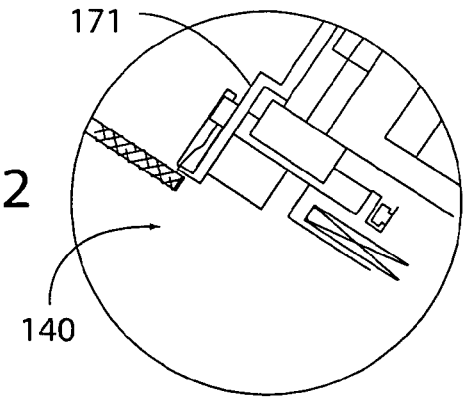
FIG. 42 is an enlarged view of the clamp shoe of FIG. 41.

With further reference to FIGS. 37–39, clamp head 140 is then actuated to the band 11, and cutter head 135 is actuated to cut the band 11 in substantially the same manner as described in more detail above. With further reference to FIG. 40, the cutter head 130 is then shifted away from package 3, and clamp head 140 is then rotated over a bin 183. With reference to FIGS. 41 and 42, the clamp head 140 is then unclamped, and the stripper member 171 is shifted to strip the band 11 from the clamp head 140, such that it falls into bin 183.

As illustrated in FIGS. 43 and 44, a fence 186 includes an opening 194 that permits the band 11 to be pulled therethrough, and the plate 193 retains the film against the package 3 while the band 11 is removed. The clamp shoe extends through the opening 194 to engage the band 11.

The cutter head 135 of second band cutting station 15 is mounted on a U-shaped support 196 (FIG. 43) which is mounted on a powered linear actuator 197, such that clamp head 135 can be horizontally shifted to account for packages 3 having different widths. A clamp foot 198 clamps packages 3 in place upon actuation of pneumatic cylinder 199. The pneumatic cylinder 199 is supported above the package 3 by a support structure 200.

Figure 46:
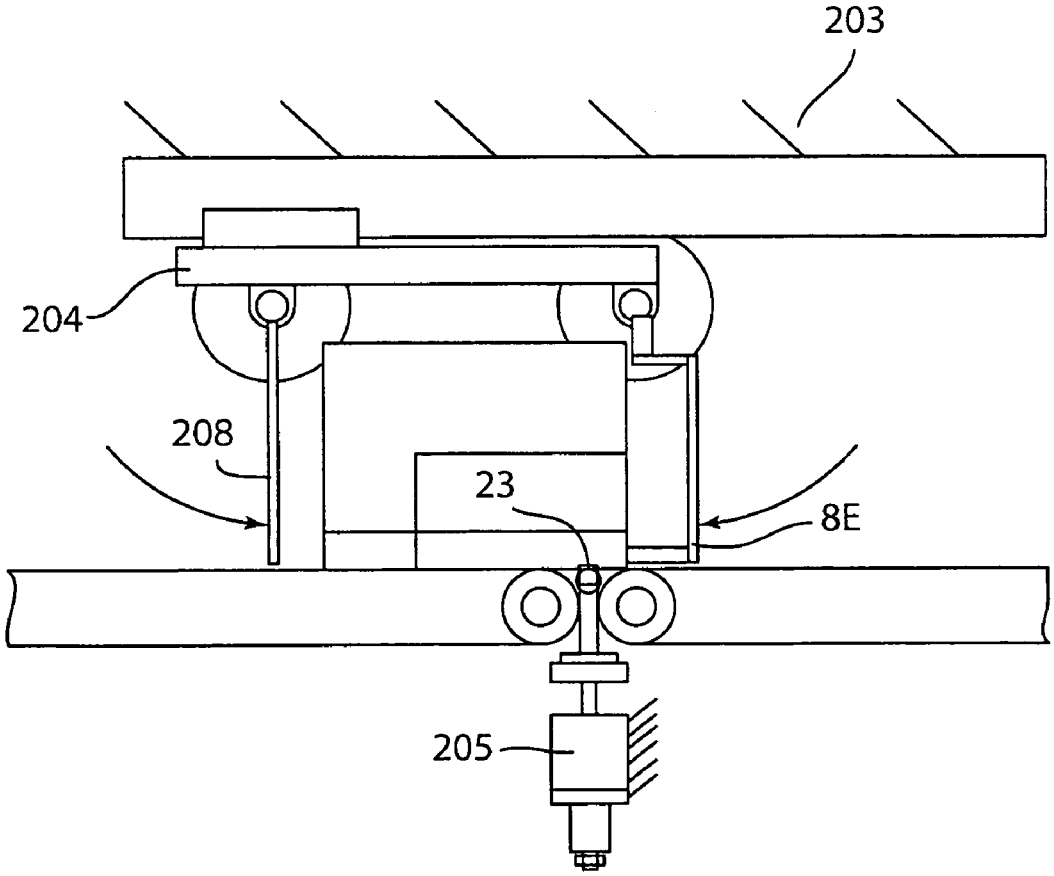
FIG. 46 is a fragmentary, partially schematic elevational view showing the push plate and front horizontal hot wire cutter in the lowered position.

With further reference to FIG. 45, after any bands 11 are removed at the second de-banding station 15, conveyor 2 moves the package 3 to the downstream end 5 of the first conveyor 2. A carriage structure 202 is mounted to a support structure 203 by a powered linear actuator 204 that shifts the carriage 202 back and forth along conveyors 2 and 22. Once the package 3 reaches the position shown in FIG. 45, powered actuators 205 shift friction members 23 upwardly into contact with the lower side 206 of package 3. Friction members 23 may be a rubber or other elastomeric material having high frictional characteristics. A powered rotary actuator 207 then rotates a push plate 208 downwardly to a position adjacent the rear side 13 of package 3 (see also FIG. 46). A horizontal hot wire cutter 8E is mounted on a support arm 209. A powered rotary actuator 210 rotates the horizontal hot wire cutter 8E into the position illustrated in FIG. 46. The wire cutting bow 8E provides a horizontal cut along the lower edge of the front side 12 of the package 3 at substantially the same height as the horizontal hot wire cutters 8A and 8B described above. With further reference to FIG. 45A, the horizontal cut 211 on front face 12 of package 3 is at substantially the same height as horizontal cuts 71 in the film along sides 16 and 17 of package 3. Also, at this stage, the package 3 will also have vertical cuts 212 in the film on the front side 12 of package 3 as illustrated in FIG. 45A.

Figure 47:
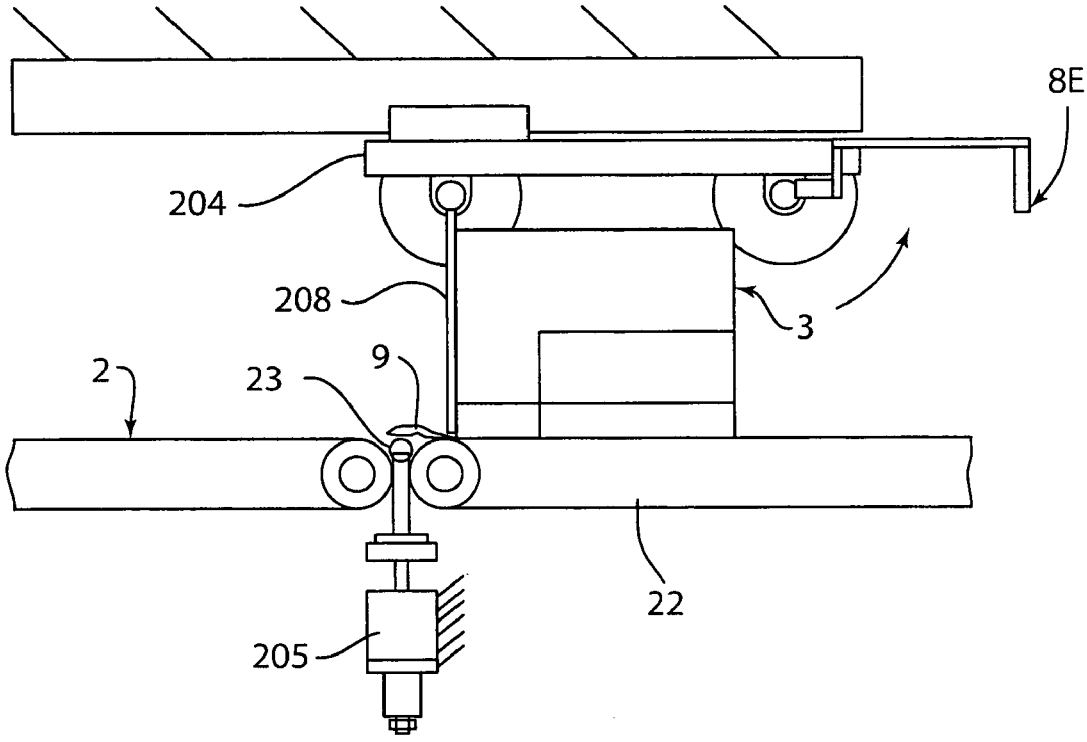
FIG. 47 is a fragmentary, partially schematic elevational view of the push mechanism showing the push plate in the lowered position and the front horizontal hot wire cutter in the raised position with the package positioned on the second conveyor.

With further reference to FIG. 47, hot wire cutter 8E is then rotated upwardly, and carriage 202 is shifted forwardly by powered linear actuator 204, and push plate 208 pushes the package 3 from first conveyor 2 to the second conveyor 22. As the package 3 is pushed from the first conveyor to the second conveyor, the friction members 23 engage the plastic film 9, and pull the film 9 from the bottom of the package 3, such that the bottom side of the package 3 is in direct contact with the second conveyor 22.

Figure 48:
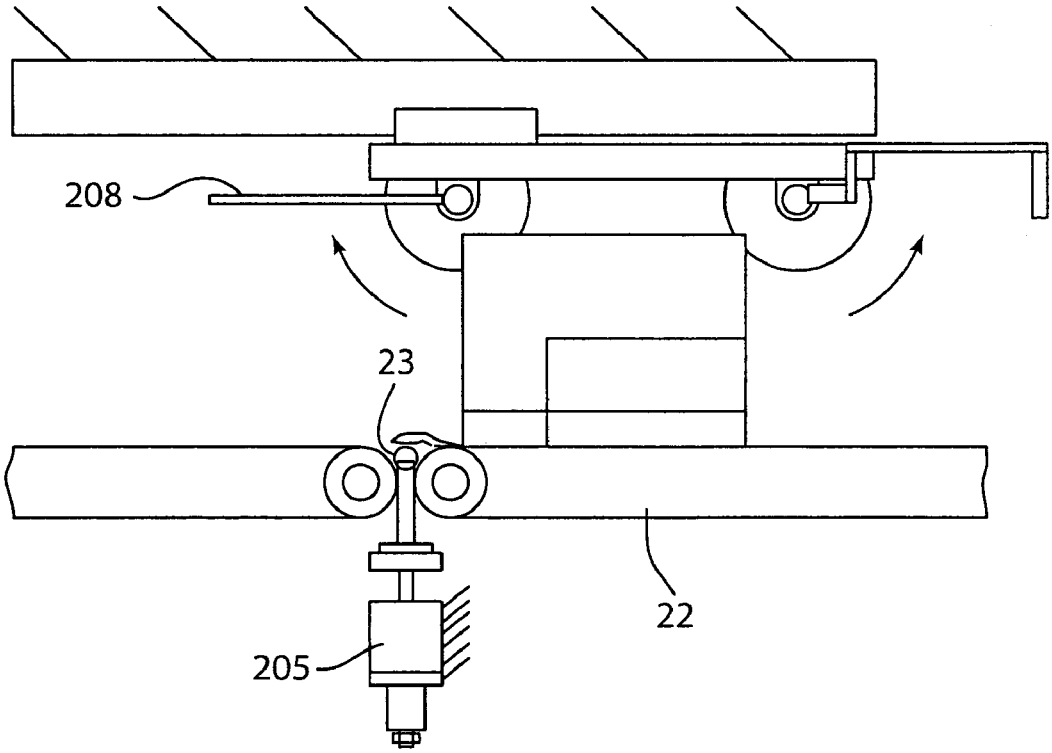
FIG. 48 is a fragmentary, partially schematic elevational view showing the push plate in the raised position.

With reference to FIG. 48, after the package 3 is shifted to the second conveyor 22, the push plate 208 is rotated upwardly, and the second conveyor 22 moves the package 3 to the next station. Also, the actuator 205 lowers the friction members 23.

Figure 50:
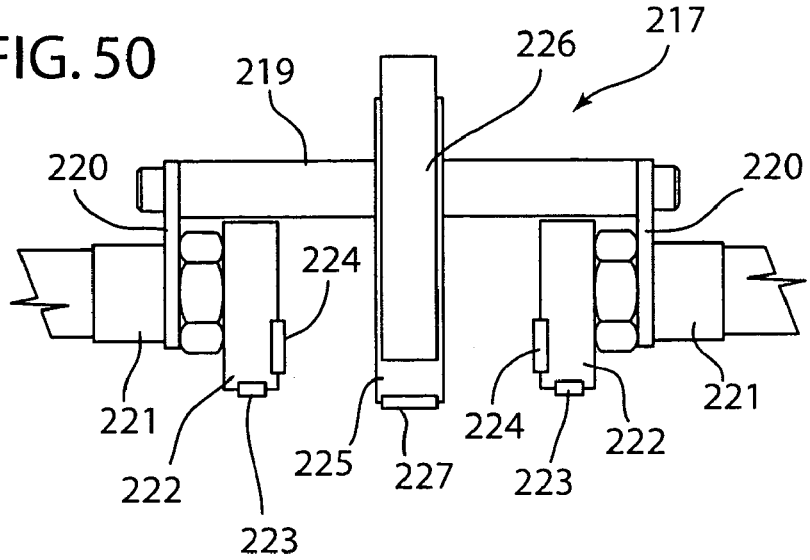
FIG. 50 is a fragmentary, enlarged view of the pick up head of the pinch mechanism of FIG. 49.
Figure 49:
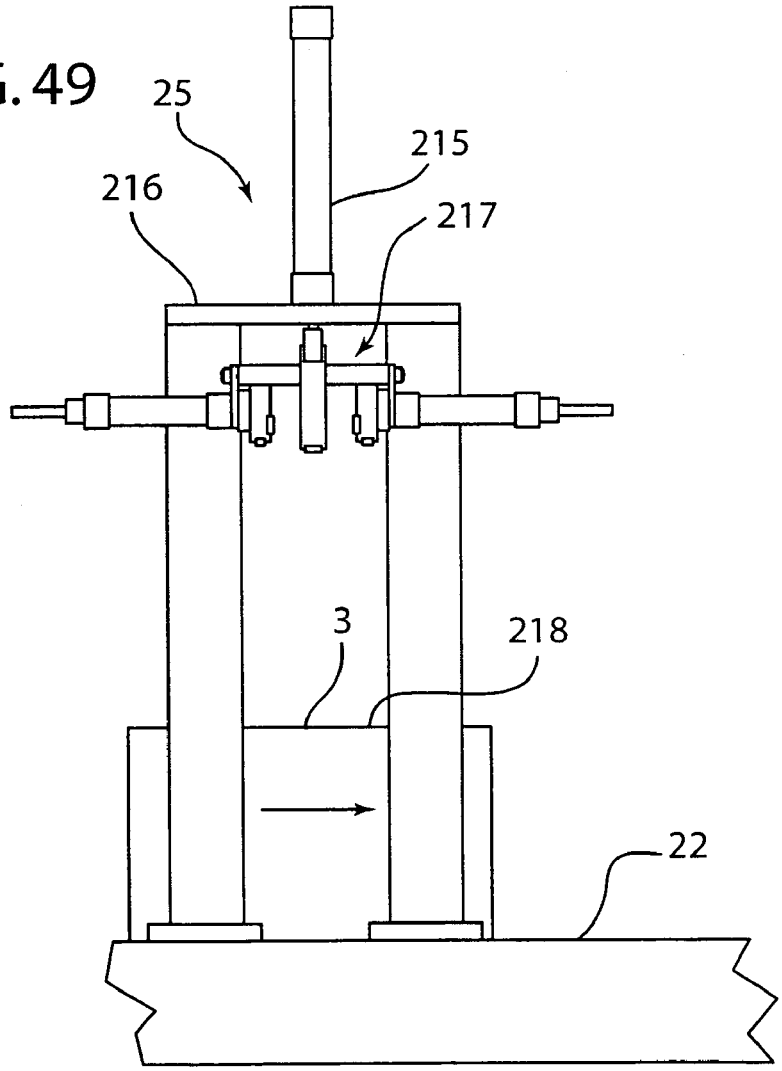
FIG. 49 is a fragmentary elevational view of a pinch mechanism of the de-packaging machine of FIG. 1 that grips and removes film from the packages.

With further reference to FIGS. 49 and 50, the package 3 is then moved to the pinch mechanism 25. Pinch mechanism 25 includes a pneumatic cylinder 215 mounted to support structure 216 above conveyor 2. Pneumatic cylinder 215 shifts a pinch head 217 vertically into contact with upper side 218 of package 3. Pinch head 217 includes a horizontal plate member 219, and a pair of downwardly extending support members 220 to which powered actuators such as pneumatic cylinders 221 are mounted. Pinch members or blocks 222 are mounted to the actuators 221, and shift horizontally towards one another upon actuation of cylinders 221. Pinch blocks 222 include elastomeric blocks 223 and 224 made of a high friction material to help grip the film. A foot 225 is movably mounted to the plate 219, and a compression spring 226 biases the foot downwardly.

Figure 52:
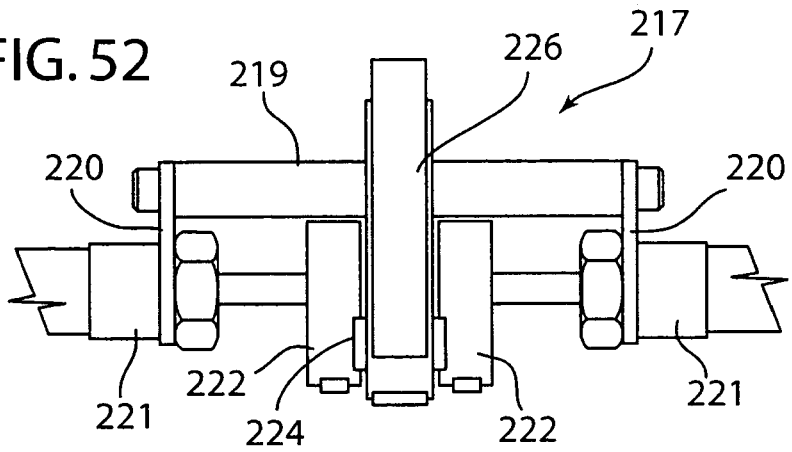
FIG. 52 is an enlarged view of the pick up head of FIG. 51 showing the pinch blocks pinching film.
Figure 51:
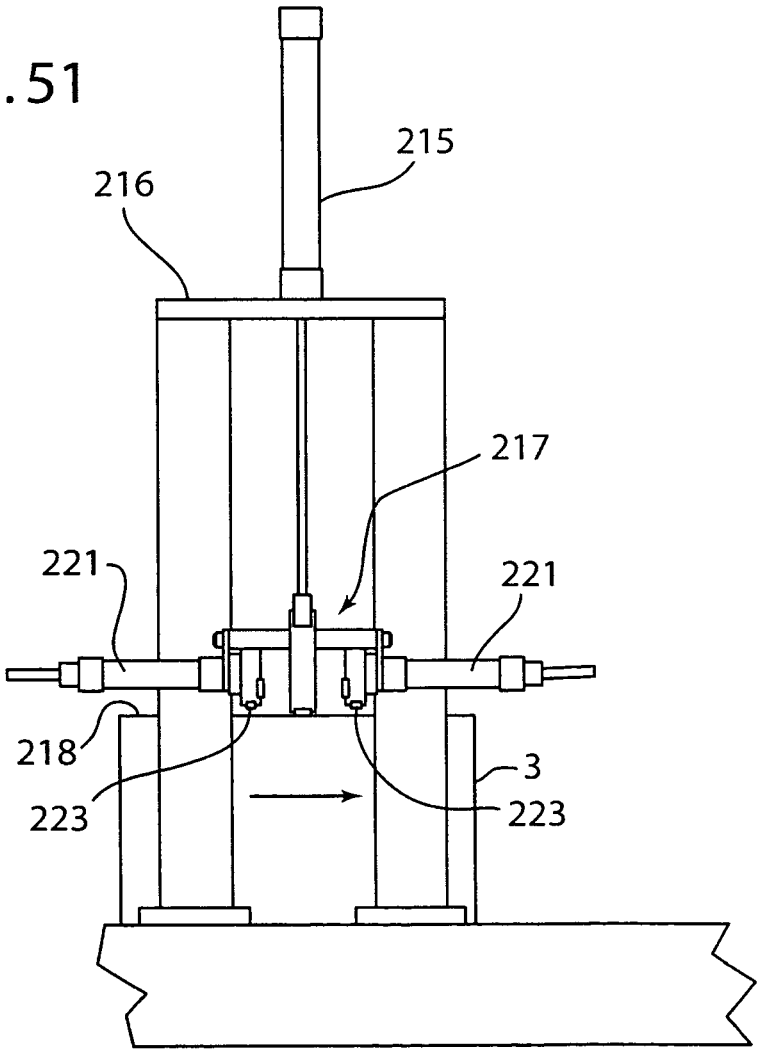
FIG. 51 is a fragmentary, partially schematic elevational view of the pinch mechanism of FIG. 49 showing the pinch head in the lowered position against the top of a package.
Figure 54:
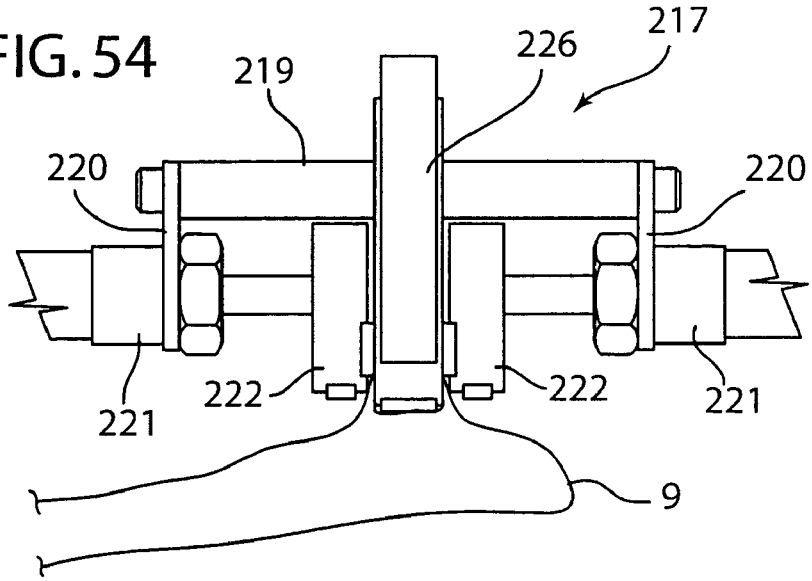
FIG. 54 is an enlarged view of the pinch head of FIG. 53.
Figure 53:
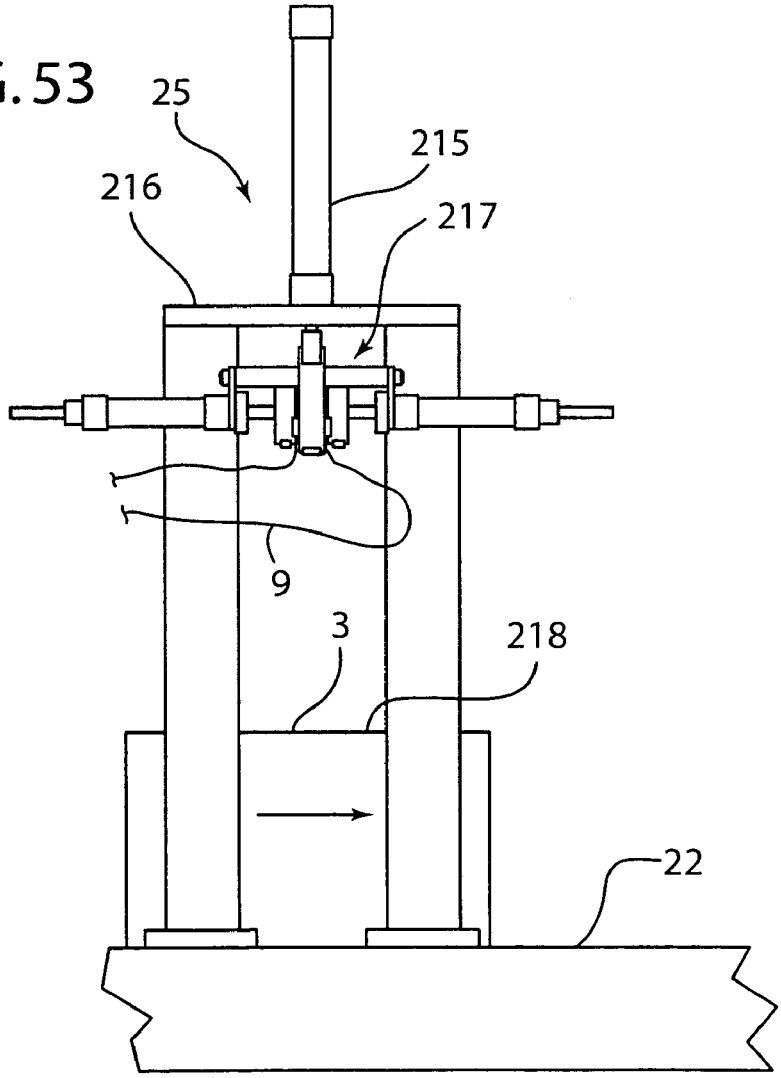
FIG. 53 is a fragmentary, partially schematic side elevational view showing the pinch head in the raised position with the film removed from the package.
Figure 56:
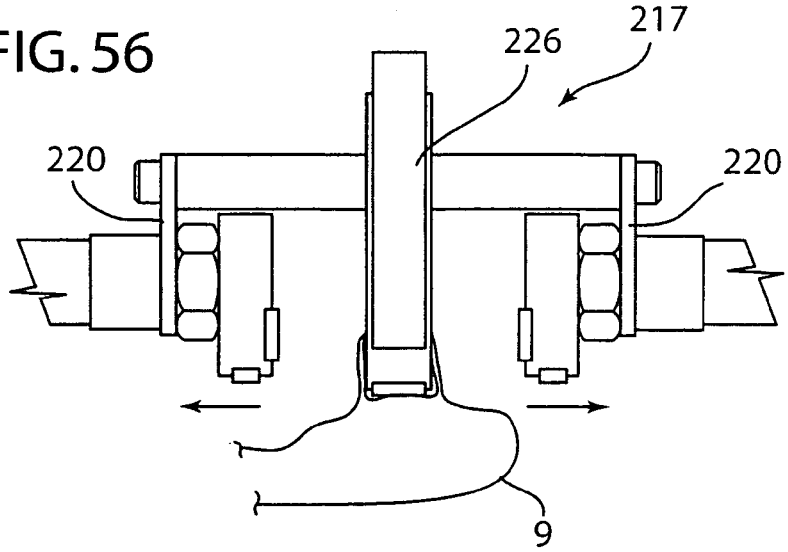
FIG. 56 is an enlarged view of the pinch head of FIG. 55.
Figure 55:
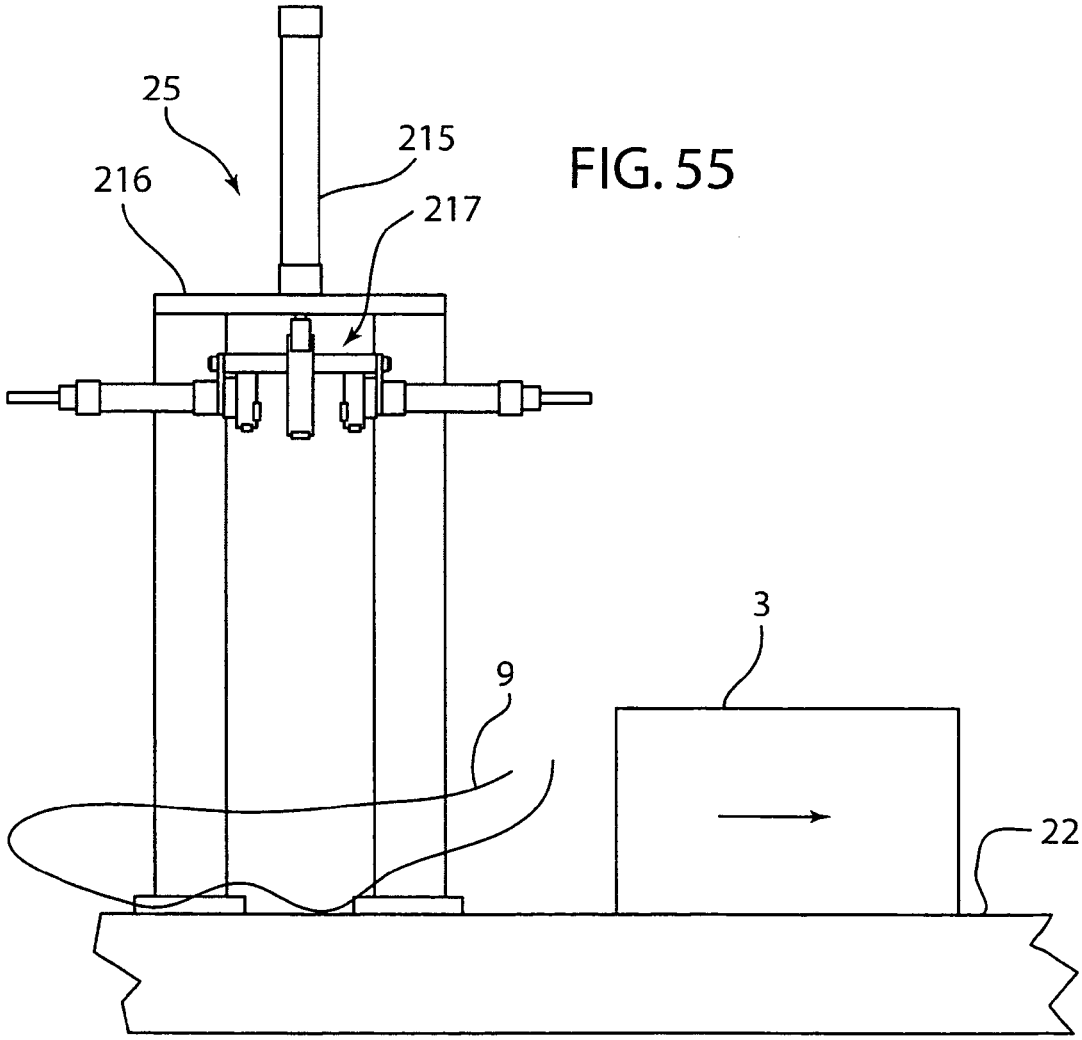
FIG. 55 is a fragmentary, partially schematic elevational view of the pinch mechanism with the pinch members retracted to release the film so it falls on the second conveyor behind the package.

With further reference to FIGS. 51 and 52, pneumatic cylinder 215 is actuated to bring the pinch head 217 downwardly, such that elastomeric block 227 of foot 225 contacts the upper surface 218 of package 3, as do the elastomeric blocks 223 on pinch blocks 222. Pneumatic cylinders 221 are then actuated to shift the pinch blocks 222 to the position illustrated in FIG. 52, thereby pushing folds 228 of film 9 upwardly, and the folds 228 are clamped against head 225 by elastomeric blocks 224. With further reference to FIGS. 53 and 54, pneumatic cylinder 215 is then actuated to lift the pinch head 217, thereby pulling the film 9 from around the package 3. Once the film 9 is removed, the conveyor 22 is actuated to move the package 3 from the pinch mechanism 25. With further reference to FIGS. 55 and 56, after the package 3 has moved from the pinch mechanism 25, the pneumatic cylinders 221 are retracted, and the film 9 falls onto the conveyor 22 behind the package 3.

Figure 57:
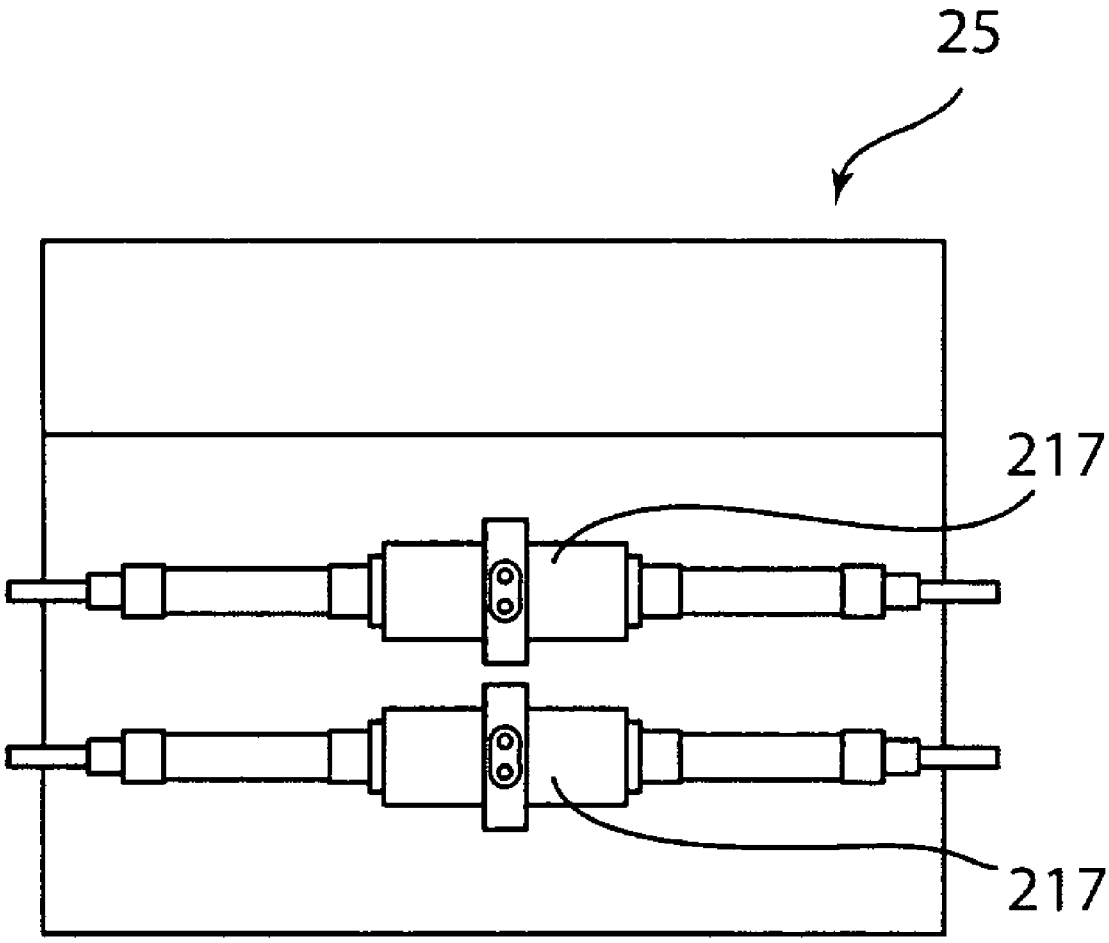
FIG. 57 is a partially schematic plan view of a pinch head according to another aspect of the present invention, including multiple grab heads.

With reference to FIG. 57, pinch mechanism 25 may include multiple pinch heads 217 if additional gripping power is required for a particular application.

After the film 9 is dropped onto the conveyor 22, an operator 26 (FIG. 1) removes the package 3 and places it on a cart 27, and the conveyor 22 moves the film 9 until it is dropped into a bin 30 at the downstream end 29 of second conveyor 22.

Figure 58:
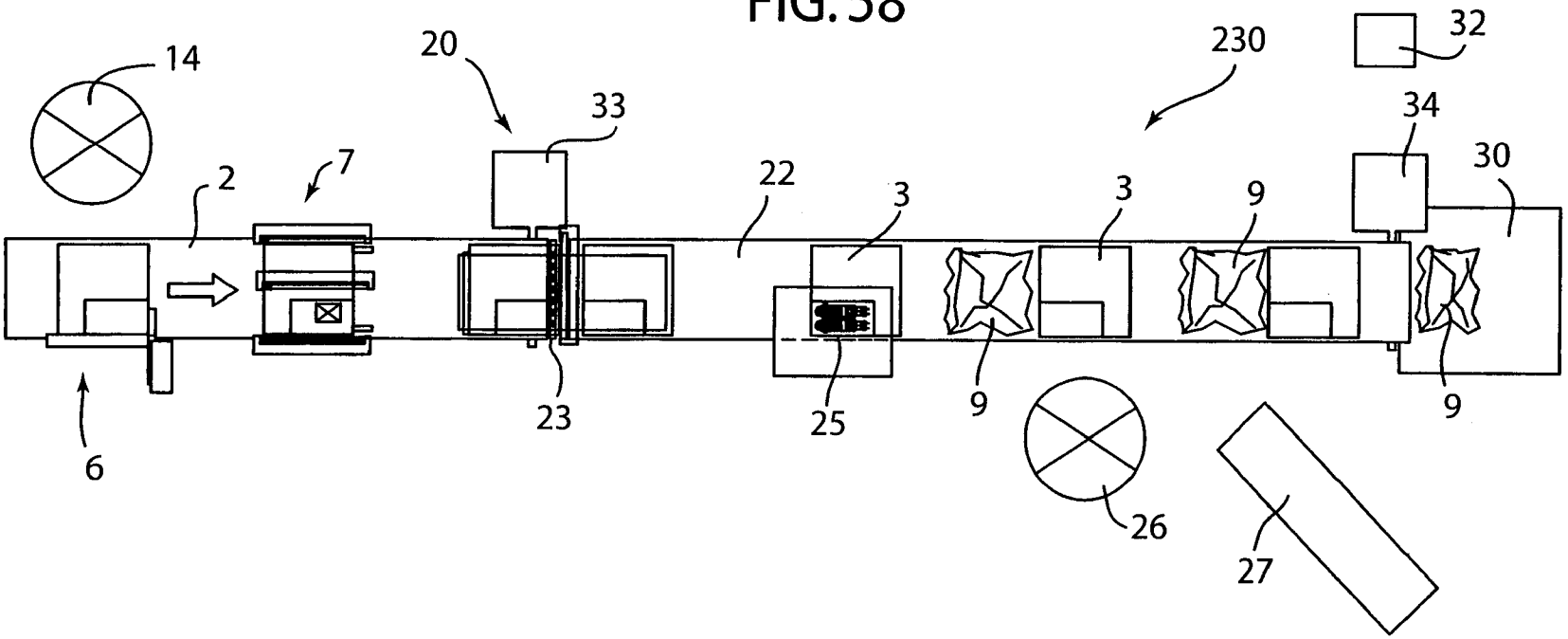
FIG. 58 is a partially schematic plan view of a de-packaging machine for removing film from packages that do not require de-banding.

With further reference to FIG. 58, a de-packaging machine for removal of shrink wrap from packages that do not have banding may also be utilized if required for a particular application. De-packaging machine 230 is substantially similar to the de-packaging machine 1 of FIG. 1, except that it does not include a first band cut station 10 or a second band cut station 15. De-packaging machine or system 230 does include a loading station, film cut station 7, film removal device 20, and pinch mechanism 25 that have substantially the same construction and operate in substantially the same manner as described in detail above in connection with FIGS. 1–57.

FIGS. 59–81 show a de-packaging machine according to yet another aspect of the present invention. The de-packaging machine 240 includes a first station 241 wherein the packages 3 are loaded onto a first or main conveyor 248, and a hot wire cutter 249 cuts the plastic wrap 9 on a first side 17 of the package 3. As discussed above, the packages 3 may be formed by a stack of magazines or the like. The individual magazines or other items forming the package 3 tend to slide relative to one another as the packaging is removed. The hot wire cutter 249 cuts the wrap 9 at a slight angle relative to horizontal to assist in keeping the bundle of individual magazines together after the wrap 9 is cut. As discussed in more detail below, the angle of the cut may be in the range of about 5° to 10°.

Figures 59, 59A:
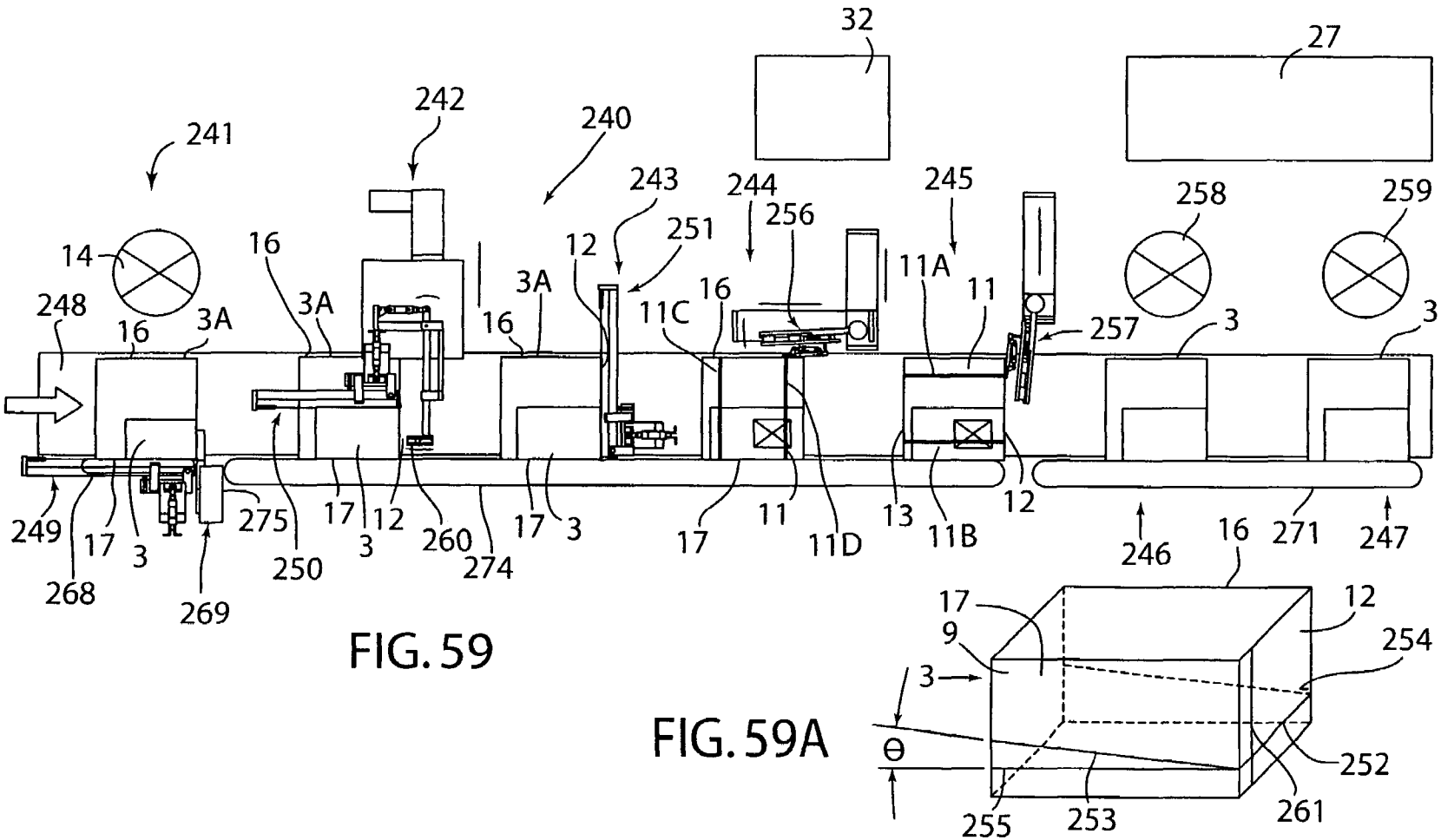
FIG. 59 is a plan view of a de-packaging machine according to another aspect of the present invention, wherein the view is taken perpendicular to the main conveyor.
FIG. 59A is a partially schematic perspective view of a package showing the cuts in the wrapping material.

The de-packaging machine 240 of FIG. 59 also includes a second station 242 having a second hot wire cutter 250 that cuts the wrap 9 along an opposite side 16 of the package 3. The hot wire cutter 250 also cuts at a slight angle relative to horizontal, and preferably cuts the wrap 9 at the same height and angle as the first hot wire cutter 249. A vertically extending hot wire cutter 260 at second station 242 makes a vertical cut in the wrap 9 on a front face 12 of package 3.

After the cutting operation of the second station 242, the conveyor 248 moves the packages 3 to a third station 243 having a third hot wire cutter 251 that cuts the wrap 9 across a front side 12 of a package 3.

With further reference to FIG. 59A, the hot wire cutter 249 of station 241 forms a cut 253 in the wrap 9 on a first side 17 of the package 3, the hot wire cutter 250 (station 242) forms a cut 254 in the wrap 9 on a side 16 of package 3, and hot wire cutter 260 (station 242) makes a vertical cut 261 in the wrap 9 on the front face 12 of package 3. The cuts 253 and 254 are preferably at a slight angle θ relative to a horizontal line 255 that is in the range of about 5° to 10°. As discussed above, the angle θ helps prevent sliding of adjacent magazines in the stack during the de-packaging thereof. Hot wire cutter 251 of station 243 forms a cut 252 along the front side 12 of package 3 that extends between and interconnects the cuts 253 and 254, and also crosses vertical cut 261.

Figure 61:
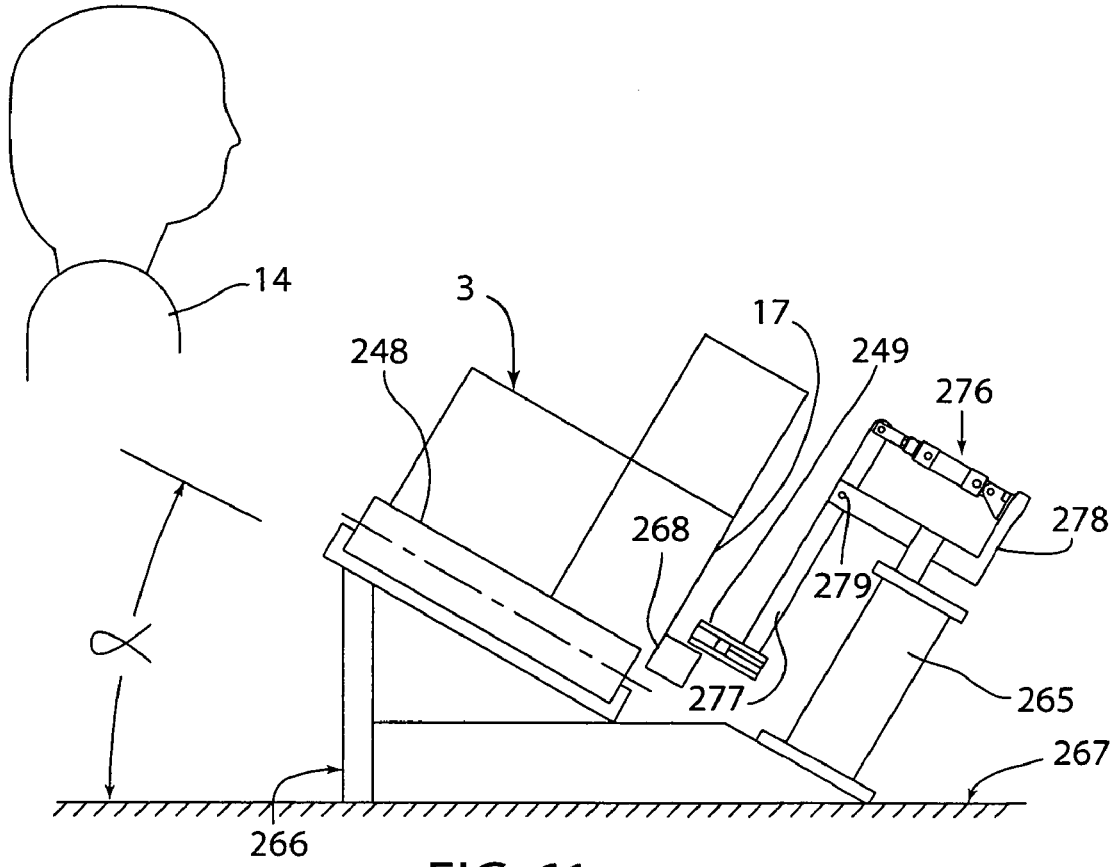
FIG. 61 is an end view of the station of FIG. 60 taken from the upstream end of the conveyor.

With further reference to FIG. 61, the first hot wire cutter 249 is mounted to a base 265 that is mounted to a support structure 266. The support structure 266 supports the base 265 and conveyor 248 at an angle α relative to a floor surface 267. The angle α may be in the range of about 15° to about 45°. In the illustrated example, α is about 30°. The surface of conveyor 248 is relatively low friction, such that packages 3 will tend to slide against a low profile conveyor 268 that contacts side 17 of package 3. The low profile conveyor 268 has a relatively high friction surface, such that conveyor 268 primarily moves and positions the package 3. The station 241 includes a retracting stop mechanism 269 having a movable stop member that can be retracted to the position indicated by the reference number 211.

With reference back to FIG. 59, the de-packaging machine 240 also includes a fourth station 244 having a cutter 256 that cuts bands 11. Although a single band 11 is utilized on a package 3, for purposes of illustration a first band 11C and 11D are shown to illustrate the range of possible positions of the band 11.

The conveyor 248 then moves the packages 3 to a fifth station 245 having a cutter 257 that cuts bands 11 that are oriented across the front side 12 and rear side 13 of the package 3. The band 11 may fall within the range illustrated by the bands 11A and 11B. It will be understood that the packages 3 have only a single band 11 that is manually removed at station 246 or station 247 by operators 258, 259.

After the bands are removed, the conveyor 248 moves the packages 3 to station 246 and/or station 247. The de-packaging machine 240 does not include a device for removing the wrapping 9, or for removing the bands 11 after the bands 11 are cut. Accordingly, operators 258 and/or 259 manually remove the wrap 9 and bands 11 from the packages 3 at stations 246 and 247. The packages 3 are then manually moved by the operators 258 and 259 to the cart 27 for further sorting and processing.

Figure 60:
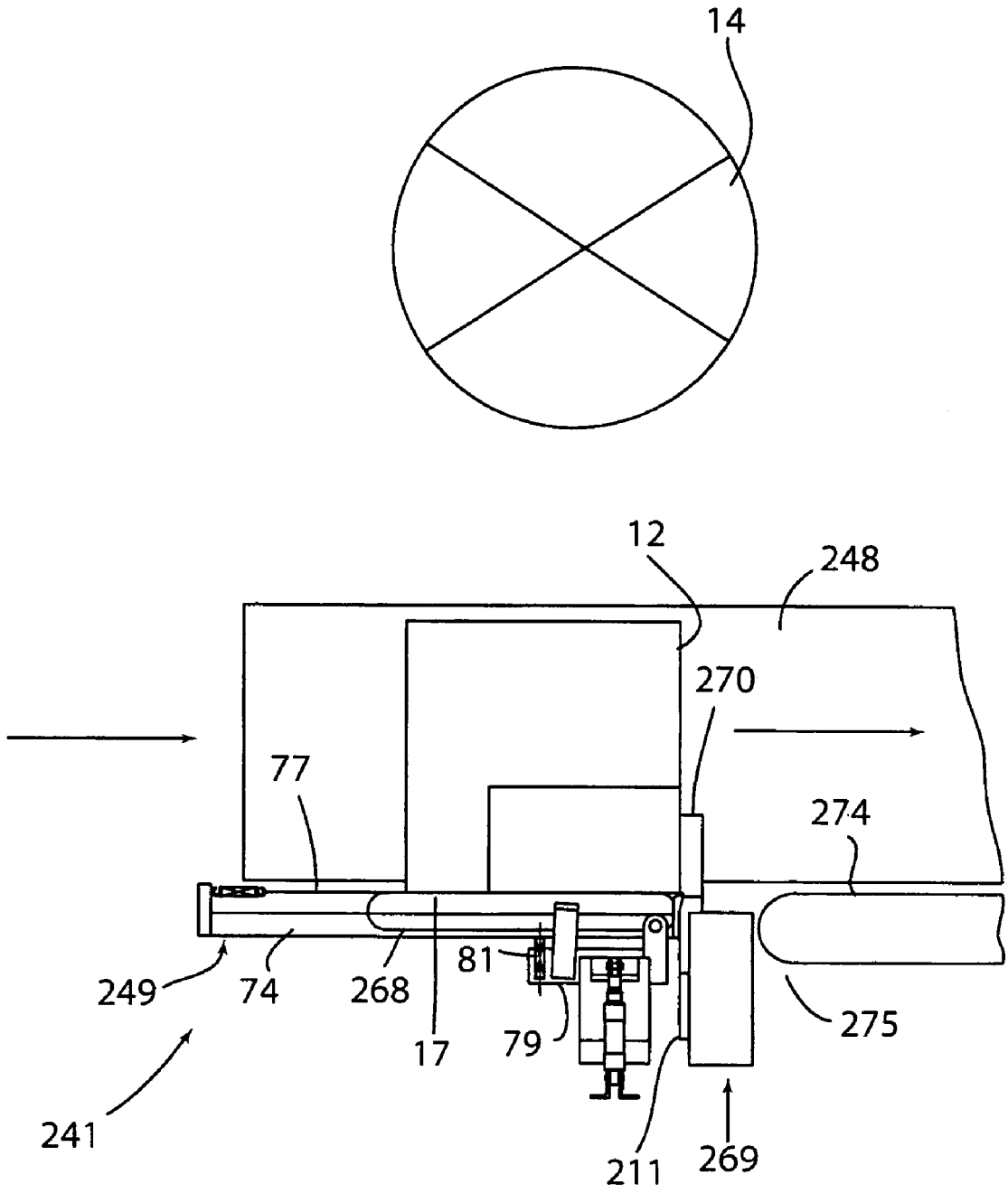
FIG. 60 is a fragmentary, plan view of the loading station of the de-packaging machine of FIG. 59, wherein the view is taken perpendicular to the main conveyor.

With further reference to FIG. 60, the hot wire cutter 249 includes an elongated support structure 74, wire 77, and other components that are substantially the same as the hot wire cutter 8 discussed above in connection with FIGS. 7 and 8. Alternately, the hot wire cutter 249 may have substantially the same construction as hot wire cutter 90 illustrated in FIGS. 9 and 10, or may, alternately have the construction of the hot wire cutter 110 illustrated in FIGS. 11 and 12 and described in detail above. Similarly, the hot wire cutters 250, 260 and 251 may have substantially the same configuration as the hot wire cutters discussed above in connection with FIGS. 7–12. Accordingly, the details concerning the construction of the hot wire cutters of de-packaging machine 240 will not be further described in detail. The stop mechanism 269 includes an air cylinder (not shown) that is operably connected to the stop member 270 to provide for movement thereof. The air cylinder is operably connected to the controller 32 and actuated via conventional solenoid-controlled valves or the like.

When the package 3 is loaded by the operator 14, the package 3 is placed against the low profile conveyor 268 and against stop member 270 to "qualify" the part. The gap between conveyors 268 and 274 provides clearance for movement of stop member 270 over conveyor 248. Upon retraction of stop 270, the conveyors will move the package 3 a specified distance to properly position the package 3 in the next station 242. The stations 241, 242, 243, 244, and 245 are spaced apart the same distance, such that movement of the conveyors by this distance properly positions the packages 3 in the succeeding stations. Also, because the package 3 is positioned utilizing the front side 12 and side 17, these sides of package 3 will be properly positioned in each of the succeeding stations. The conveyor 248 may be powered by an electrical servo-motor, and is operably coupled to the controller 32.

A second high friction side conveyor 274 has an upstream end 275 adjacent the stop mechanism 269. The conveyor 274 extends along the stations 242, 243, 244 and 245 (see also FIG. 59). The high friction conveyor 274 may also be driven by electric servo-motors or other suitable arrangement, and is operably connected to the controller 32. Because the conveyor 274 has a belt that has substantially higher friction characteristics than the conveyor 248, the conveyor 274 positions and moves the packages 3 along the de-packing machine 240, and the conveyor 248 primarily serves to support the weight of the packages 3.

During operation, after a package 3 is positioned in the loading station 241 against stop member 270, an air cylinder 276 is actuated by the controller 32. The hot wire cutter 249 is mounted on an arm 277 that is pivotally mounted to a bracket 278 on base 265, such that actuation of air cylinder 276 shifts the hot wire cutter 249 into contact with the wrap 9 on side 17 of package 3. The hot wire cutter 249 is then retracted, and the stop member 270 is also retracted. The conveyors 248, 268 and 274 are then actuated to move the package to station 242 for the next cutting operation.

Figure 62:
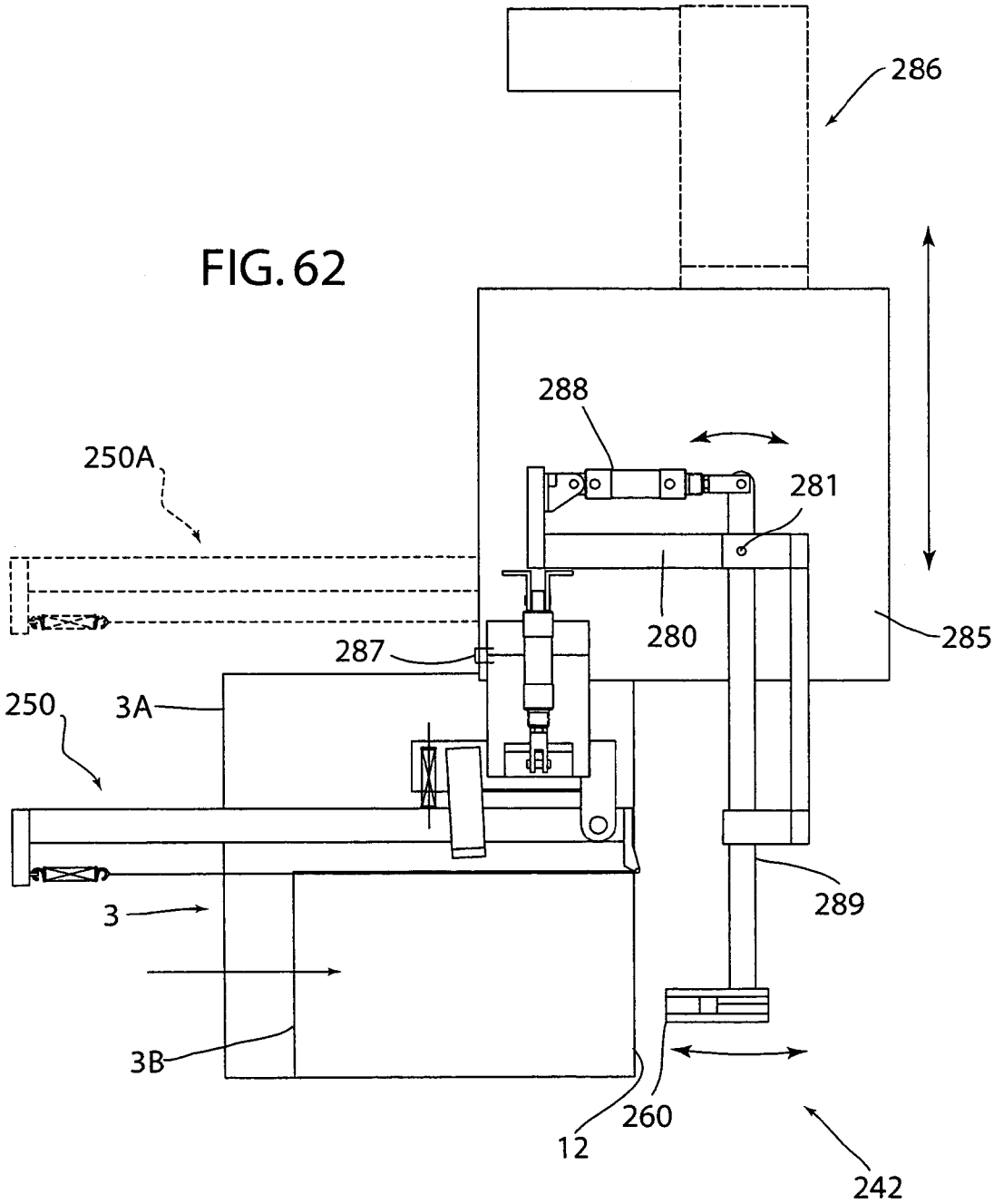
FIG. 62 is a plan view of the second station of the de-packaging machine of FIG. 59, wherein the view is taken perpendicular to the main conveyor.
Figure 63:
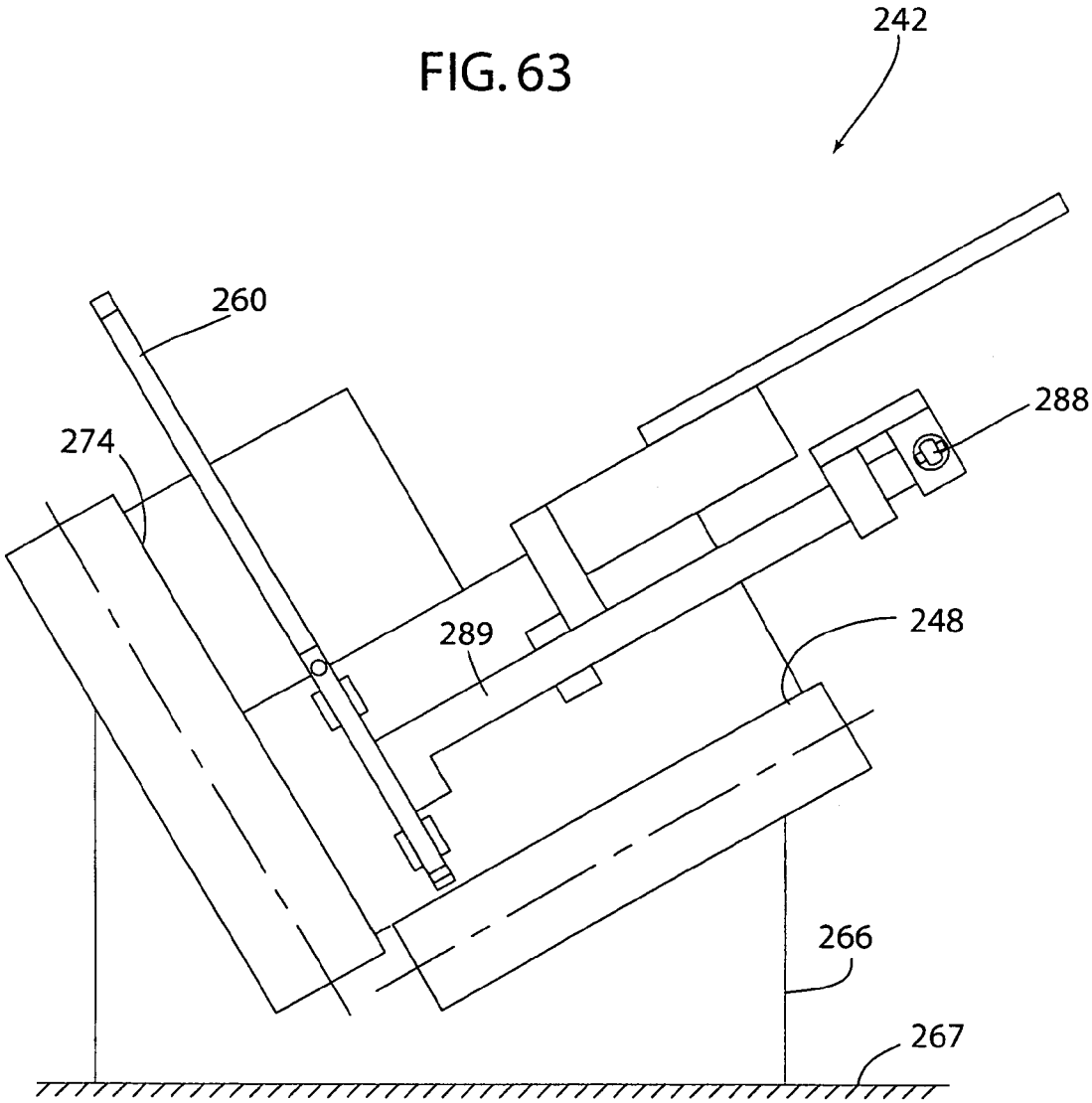
FIG. 63 is an end view of the station of FIG. 62 taken from the downstream end of the conveyor showing the vertical hot wire cutter.
Figure 64:
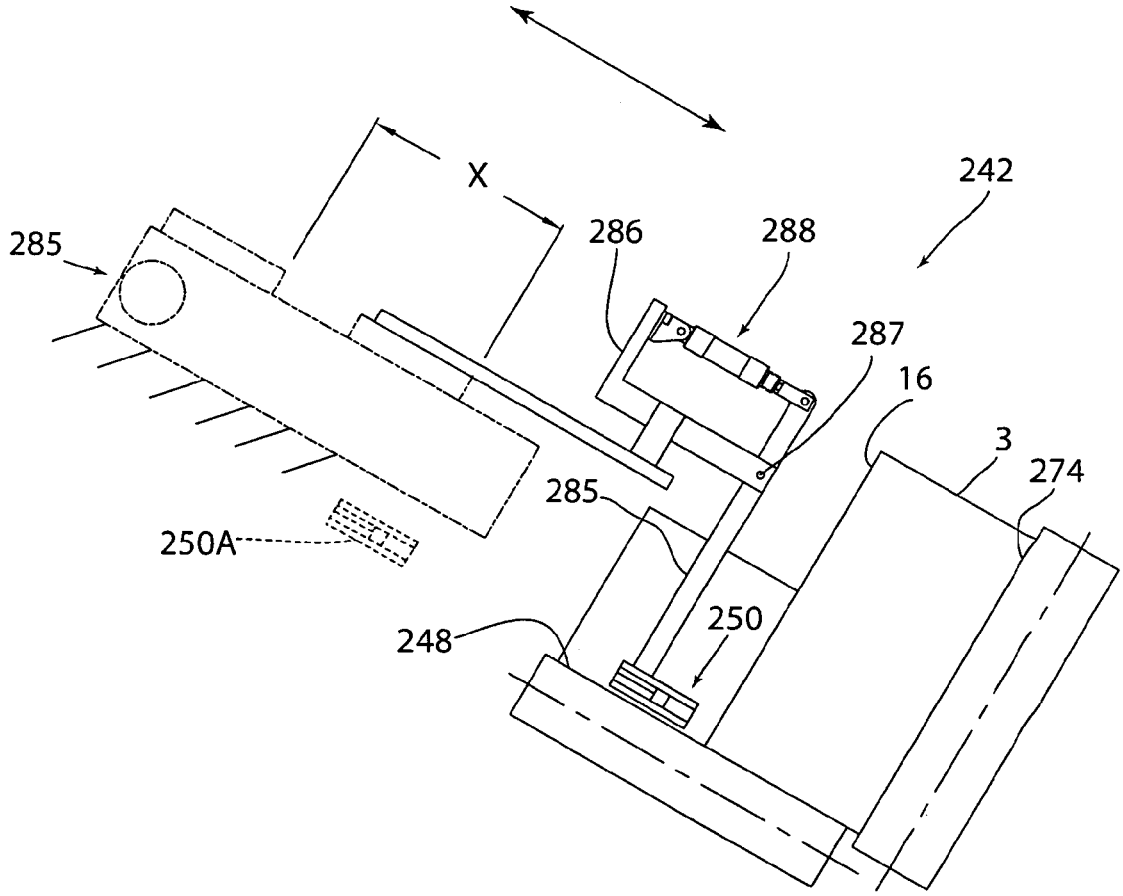
FIG. 64 is an end view of the station of FIG. 62 taken from the upstream end of the conveyor showing the horizontal hot wire cutter.

With further reference to FIGS. 62–64, the cutting bows 250 and 260 are mounted on a movable table 285 having an electric servo-motor 286 that shifts the hot wire cutters 250 and 260 to accommodate a range of package sizes that can vary between the size 3A and 3B (FIG. 62). The table 285 is mounted on conventional linear guides (not shown), and the electric servo-motor 286 is operably connected to the controller 32. A sensor 287 on table 285 generates a signal to the controller 32 when the table 285 is in the proximity of a package 3, and the controller 32 then stops the table 285 at the proper location. Table 285 shifts cutting bow 250 from the retracted position 250A to the extended position 250. The sensor 287 may be a conventional limit switch, proximity sensor, or the like as required for a particular application. Once the table 285 is in the proper position, an air cylinder 288 is actuated by the controller 32. Vertical cutter 260 is mounted on a arm 289 that is pivotally mounted to a base or bracket 280 about pivot 281, such that actuation of air cylinder 288 causes the vertical hot wire cutter 260 to move into contact with plastic wrap 9 on the front face 12 of package 3 to provide the vertical cut 261 illustrated above in connection with FIG. 59A.

With further reference to FIG. 64, horizontal wire cutter 250 is mounted on a pivot arm 285 that is pivotally mounted to a base or bracket 286 about a pivot point 287. Actuation of air cylinder 288 by controller 32 causes the hot wire cutter 250 to move into contact with plastic wrap 9 on side 16 of package 3 to thereby form the cut 254 illustrated above in FIG. 59A. The servo-motor 286 can retract the table 285 a distance "X", to thereby retract the hot wire cutter 250 to the position illustrated schematically by the part 250A.

Figure 65:
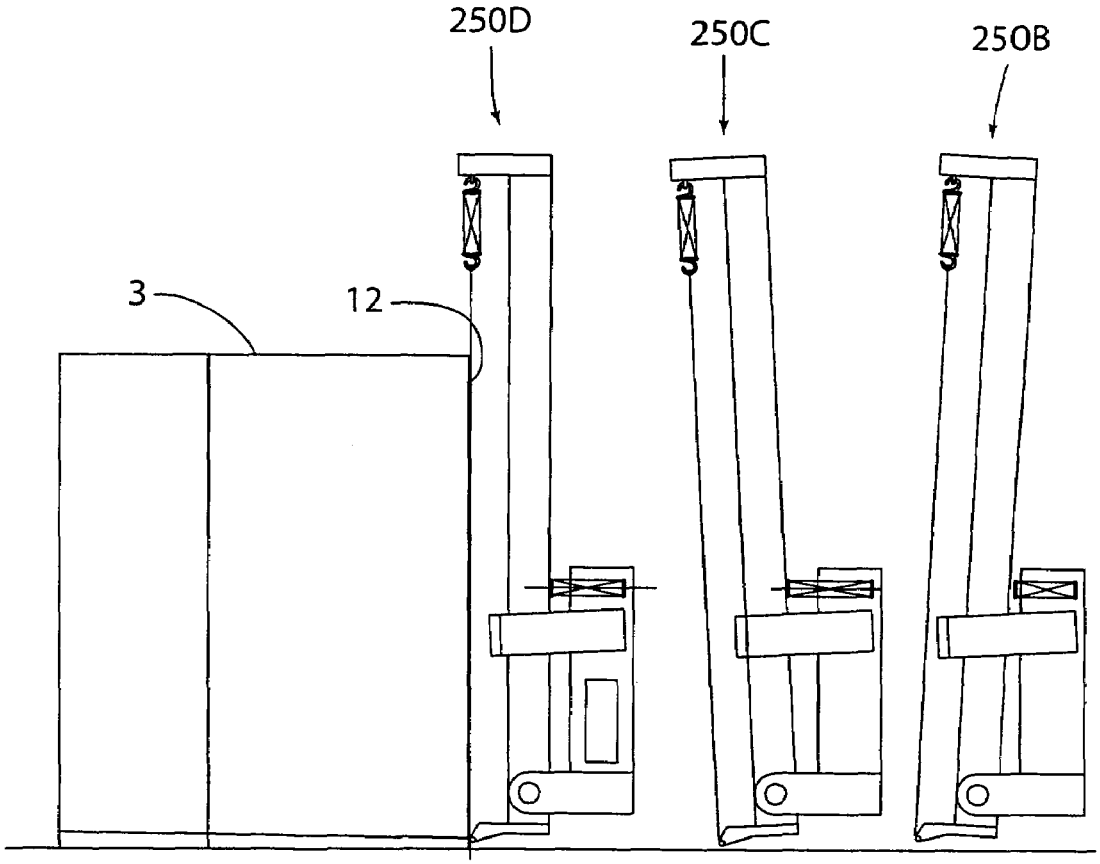
FIG. 65 is a schematic elevational view showing the vertical hot wire cutter of FIG. 62.
Figure 66:
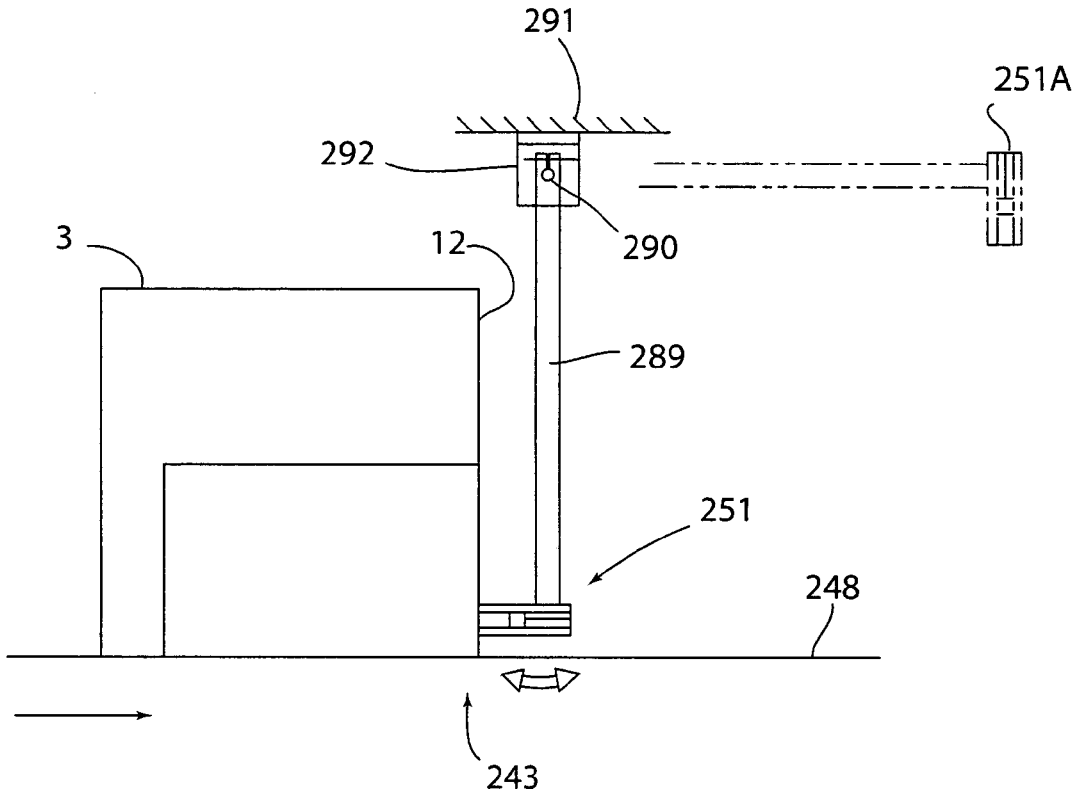
FIG. 66 is a side view of the third station of the de-packaging machine of FIG. 59 showing the horizontal hot wire cutter across the front of a package.
Figure 69:
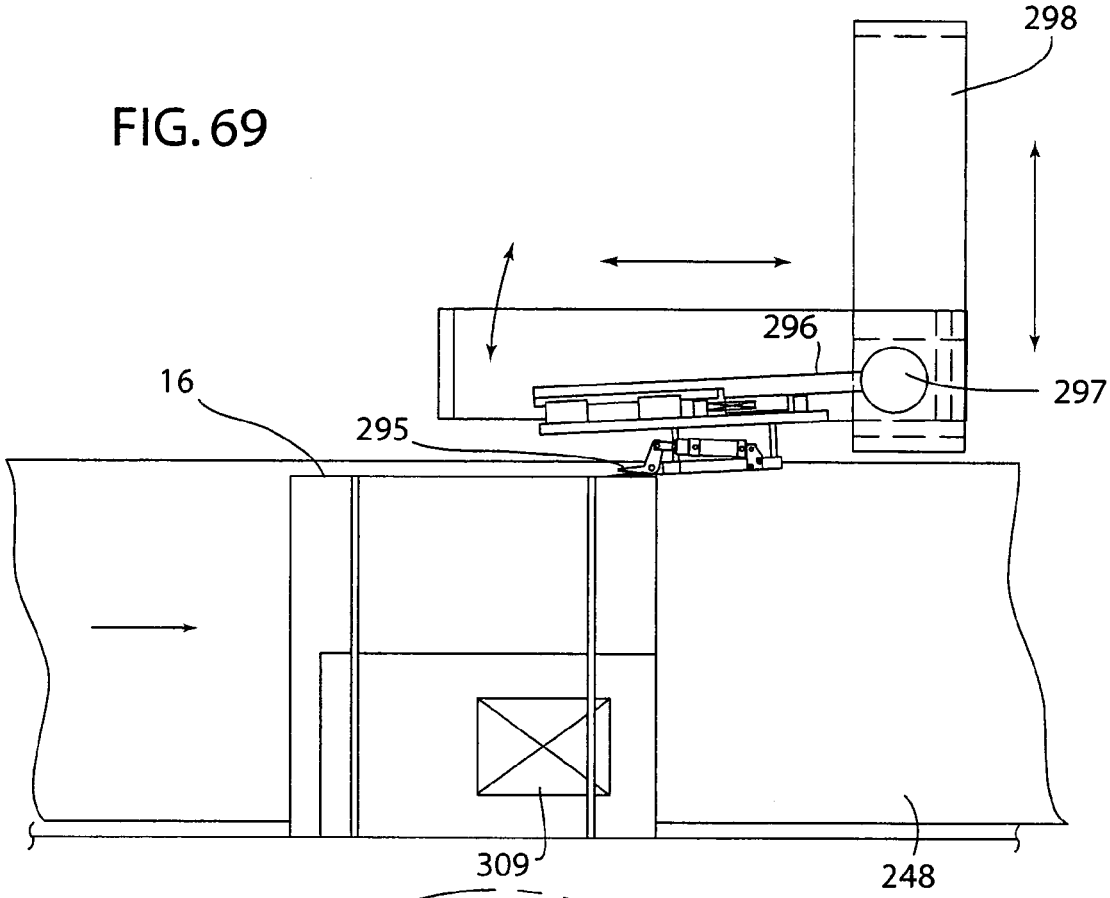
FIG. 69 is a plan view of the station of FIG. 67 wherein the cutting shoe is positioned against a side of a package, and wherein the view is taken perpendicular to the main conveyor.

With further reference to FIG. 65, the hot wire cutter 250 is pivotally mounted, and can therefore rotate to the positions illustrated by the reference numbers 250B, 250C and 250D to accommodate variations in the front face 12 of package 3. The hot wire cutter 250 rotates in substantially the same manner as the hot wire cutter discussed above in connection with FIG. 6. With further reference to FIG. 66, after the hot wire cutting operation at station 242 is completed, the conveyors move the package 3 to the third station 243. The hot wire cutter 251 is mounted to an arm 289 that is pivotally mounted to an overhead structure or frame 91 at a pivot 290. A powered rotary actuator 292 may be of a conventional pneumatic or electric configuration, and rotates the arm 289 to bring the hot wire cutter 251 into contact with the front face 12. The powered actuator 292 is then actuated to raise the hot wire cutter 251 to the position indicated by the dashed lines marked 251A to provide clearance for the package to move to the next station.

Figure 70:
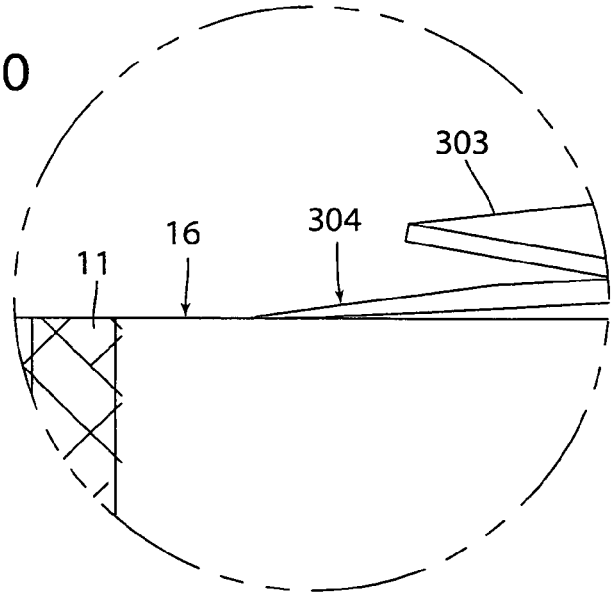
FIG. 70 is an enlarged view of the band cutter of FIG. 69.
Figure 72:
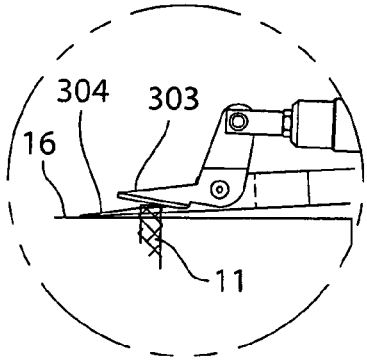
FIG. 72 is an enlarged view of the cutter of FIG. 71.
Figure 71:
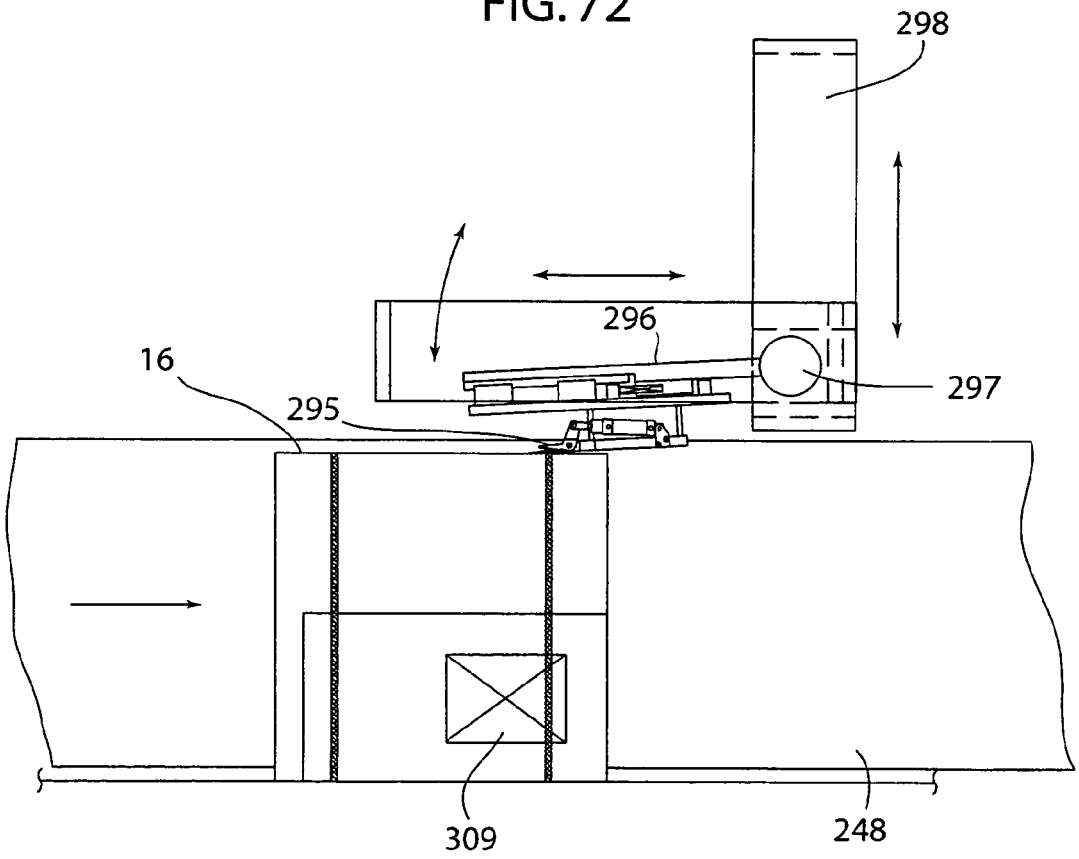
FIG. 71 is a plan view of the station of FIG. 67 wherein the cutting shoe is in position to cut a band, and wherein the view is taken perpendicular to the main conveyor.
Figure 73:
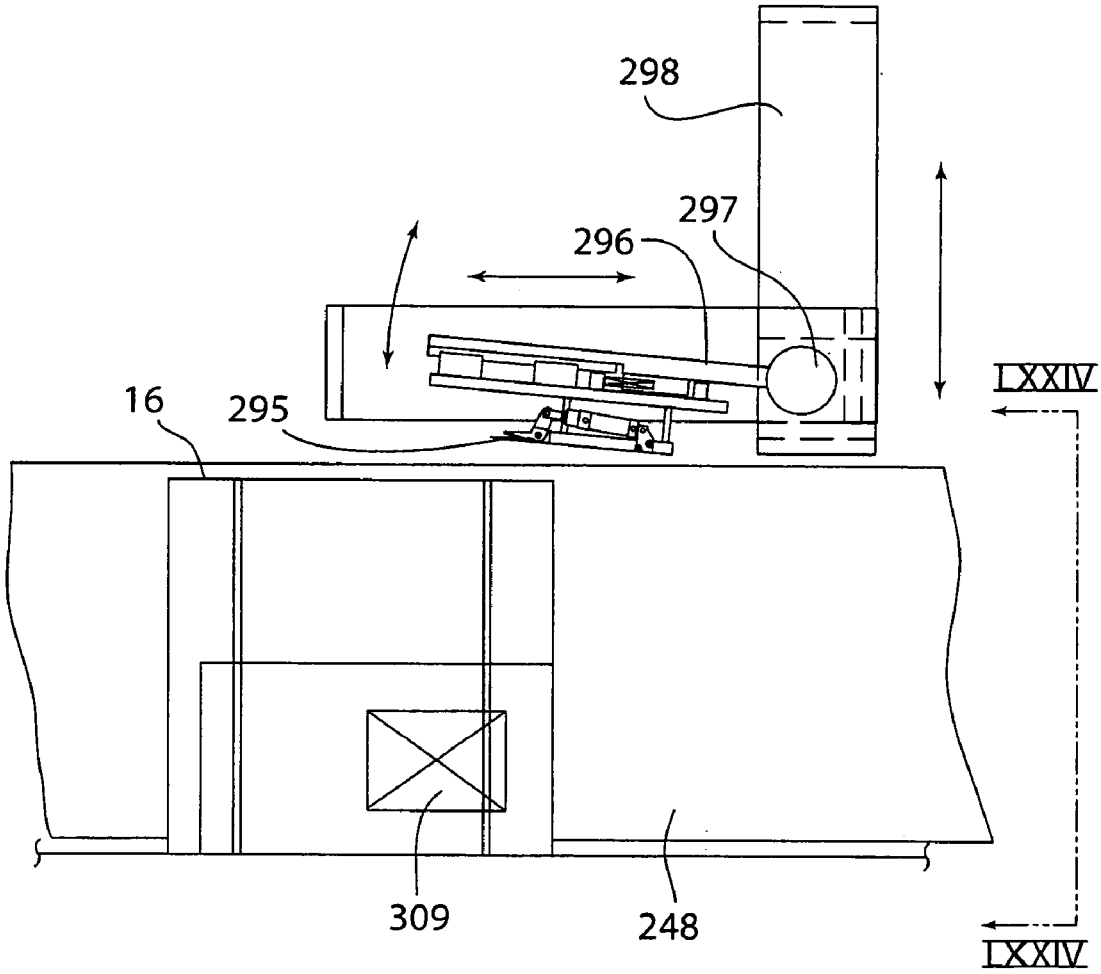
FIG. 73 is a plan view of the station of FIG. 67, wherein the cutting shoe is retracted, and wherein the view is taken perpendicular to the main conveyor.
Figure 74:
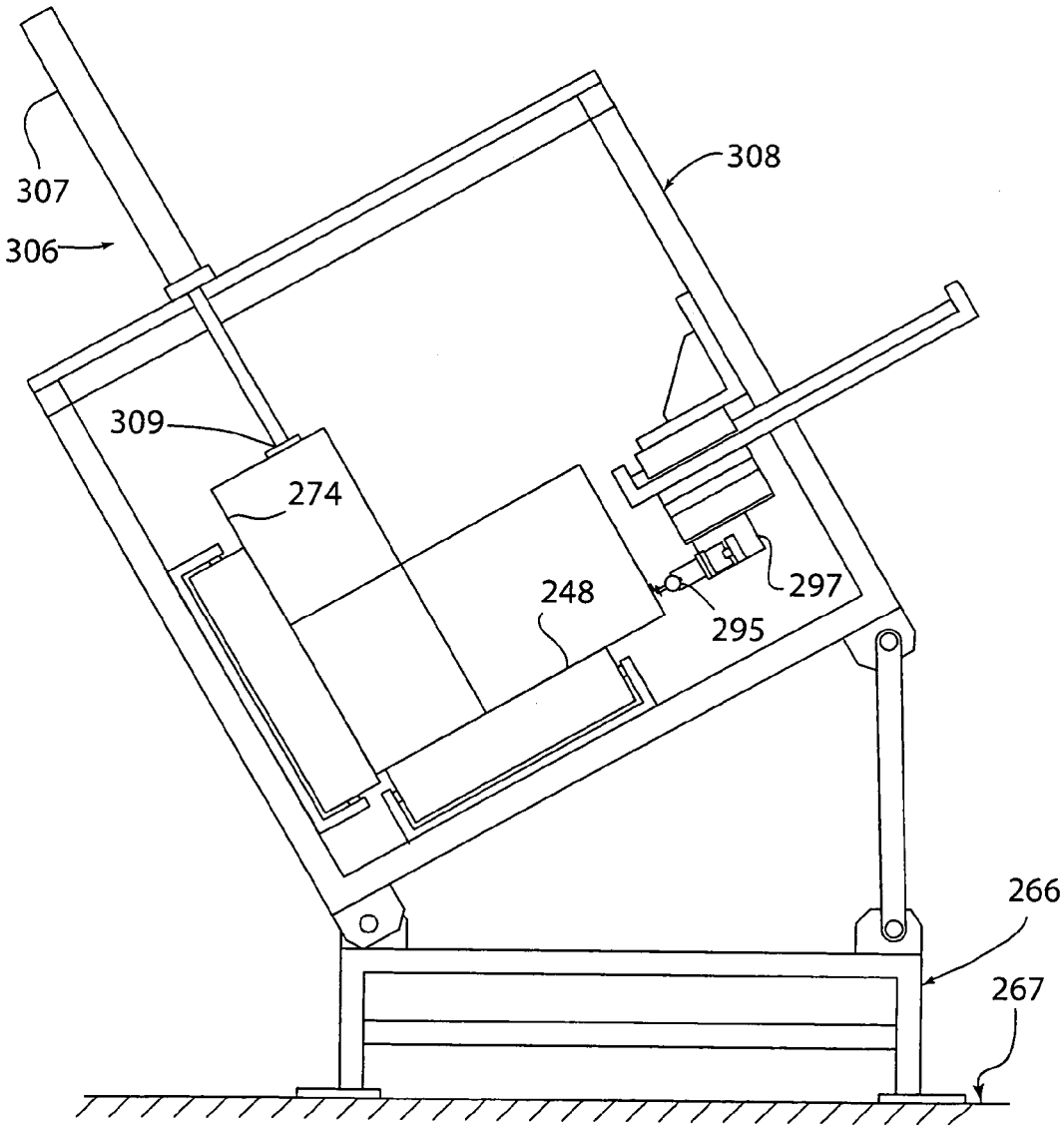
FIG. 74 is a view of the station of FIG. 73 taken along the line LXXIV—LXXIV.
Figure 75:
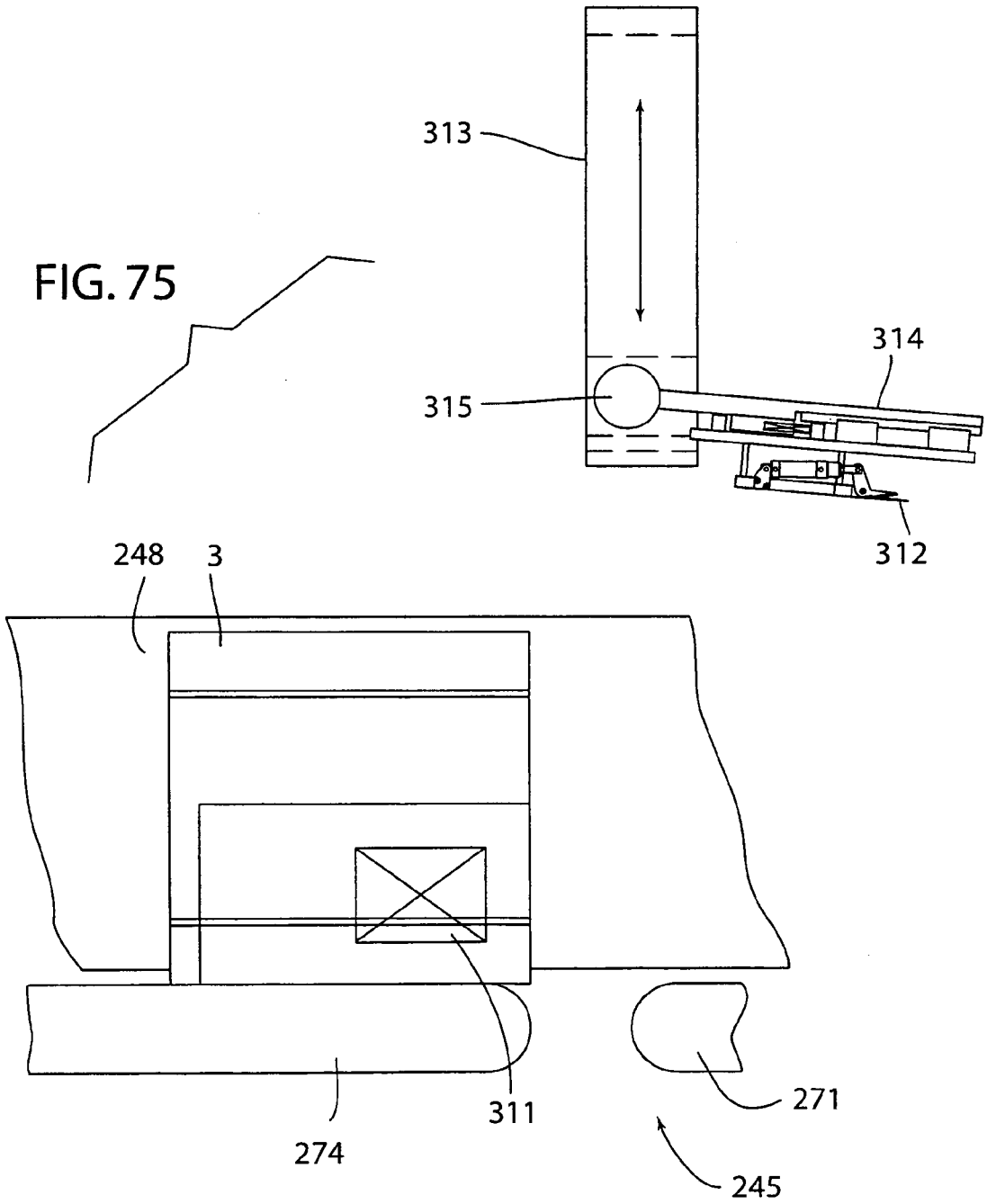
FIG. 75 is a partially fragmentary, schematic plan view of station five of the de-banding machine of FIG. 59, wherein the view is taken perpendicular to the main conveyor.
Figure 77:
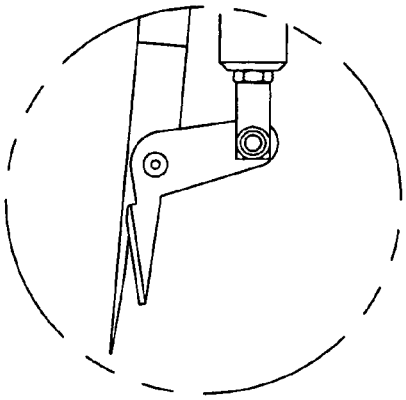
FIG. 77 is an enlarged view of the cutter of FIG. 76.

With further reference to FIGS. 67–74, the packages are then moved to the station 244 for cutting of band 11. As discussed above, a single band 11 is utilized on a package, and may fall within the range indicated by the bands marked 11C and 11D when the package 3 is oriented such that the bands wrap around the sides 16 and 17 of package 3. A powered cutting shoe 295 is mounted on an arm 296 that is rotatably mounted to a powered slide or base 298 via a powered rotary actuator 297 that is operably coupled to the controller 32. An upper powered slide 294 is mounted on powered slide 298. The cutter 295 is mounted to the arm 296 via a plate 299 or the like that slides relative to arm 296. A spring 300 biases the cutter 295 to the end 301 of arm 296, and a switch (not shown) generates a signal to the controller 32 when the cutter 295 shifts relative to the arm 296 to thereby signal that the cutter 295 has encountered a band 11. During operation, the conveyors stop to position package 3 in station 244, and the upper slide 294, actuator 297, arm 296 and cutter 295 are shifted horizontally by slide 298 until the cutter 295 is positioned adjacent the side 16 of a package 3. A sensor (not shown) determines when the cutter 295 is proximate the side 16 of a package 3. The rotary actuator 297 is then actuated to bring the cutting shoe 295 into contact with side 16 of package 3. The rotary actuator 297 may be a pneumatic actuator or the like, such that the cutting shoe 295 is biased into contact with side surface 16 of package 3 to ensure that the cutting shoe 295 remains in contact therewith. Slide 294 is then actuated, to slide the cutting shoe 295 along the side 16 of package 3 until it encounters a band 11, thereby causing the cutting shoe 295 to shift relative to arm 296, generating a signal to the controller 32 that a band 11 is present. The slide 294 is then stopped, and air cylinder 302 of cutting shoe 295 is actuated to rotate the movable cutting blade 303 into engagement with "fixed" cutting blade 304. As illustrated in FIG. 70, the tip 305 of blade 304 is sharp enough to pierce plastic wrap 9, and is also sharp enough to get under the edge of band 11. However, the tip 305 is radiused upward away from side 16 of package 3 slightly in a manner somewhat similar to the tip of a snow ski, to thereby prevent the tip 305 from digging into the magazines forming the package 3. A clamp 306 is mounted to an overhead structure 308, and includes a powered actuator such as an air cylinder 307 that shifts the clamp shoe 309 into contact with the package 3 to secure the package 3 in position on the conveyors 274 and 248 during the band cutting operation.

Figure 76:
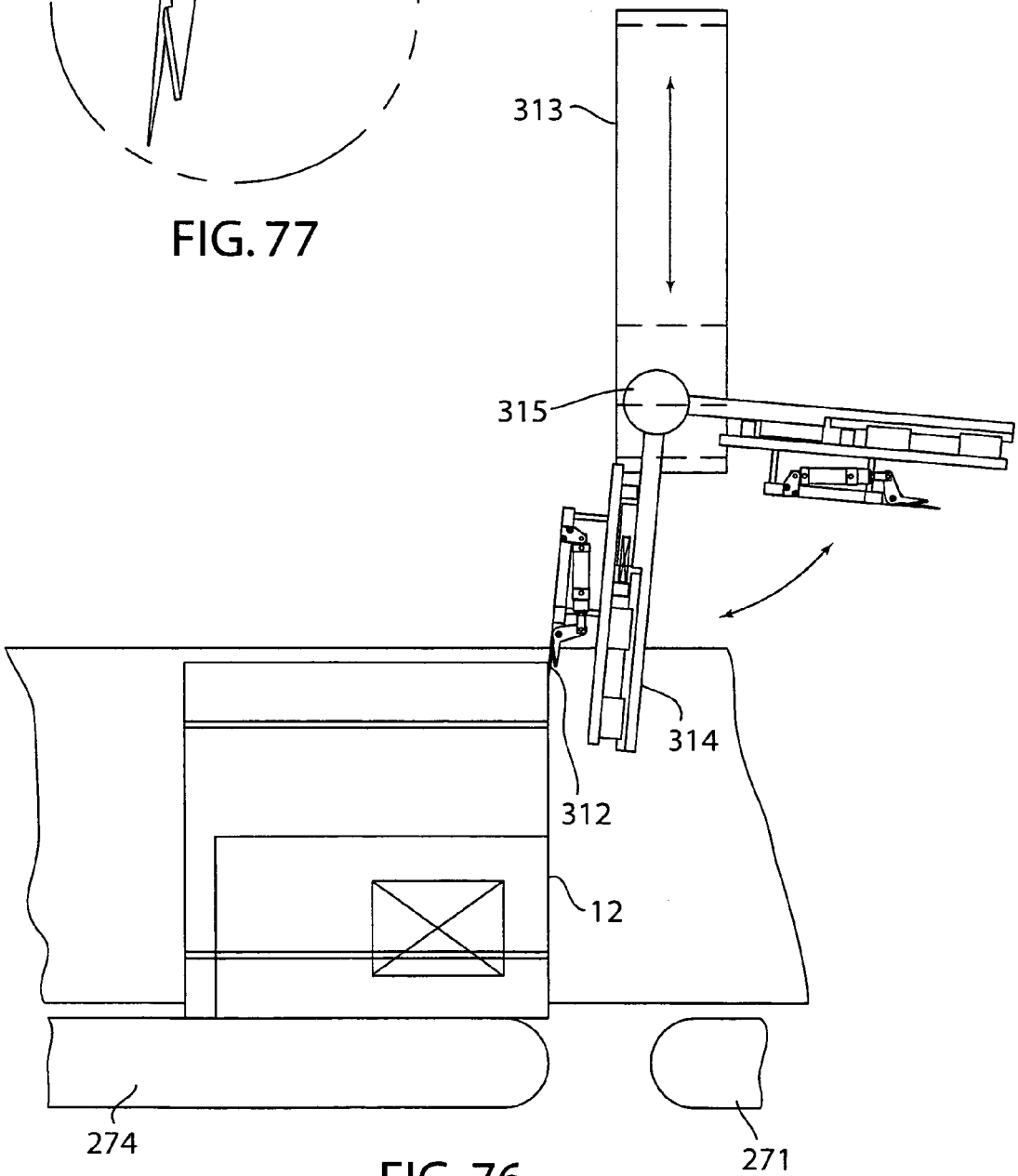
FIG. 76 is a partially fragmentary, schematic plan view of the station of FIG. 75 wherein the cutting shoe is positioned against the front side of a package, and wherein the view is taken perpendicular to the main conveyor.
Figure 79:
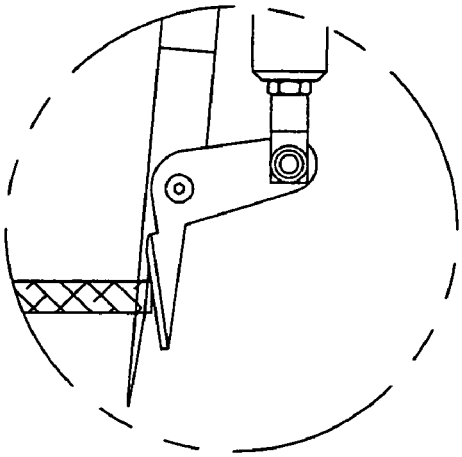
FIG. 79 is an enlarged view of the cutter of FIG. 78.
Figure 78:
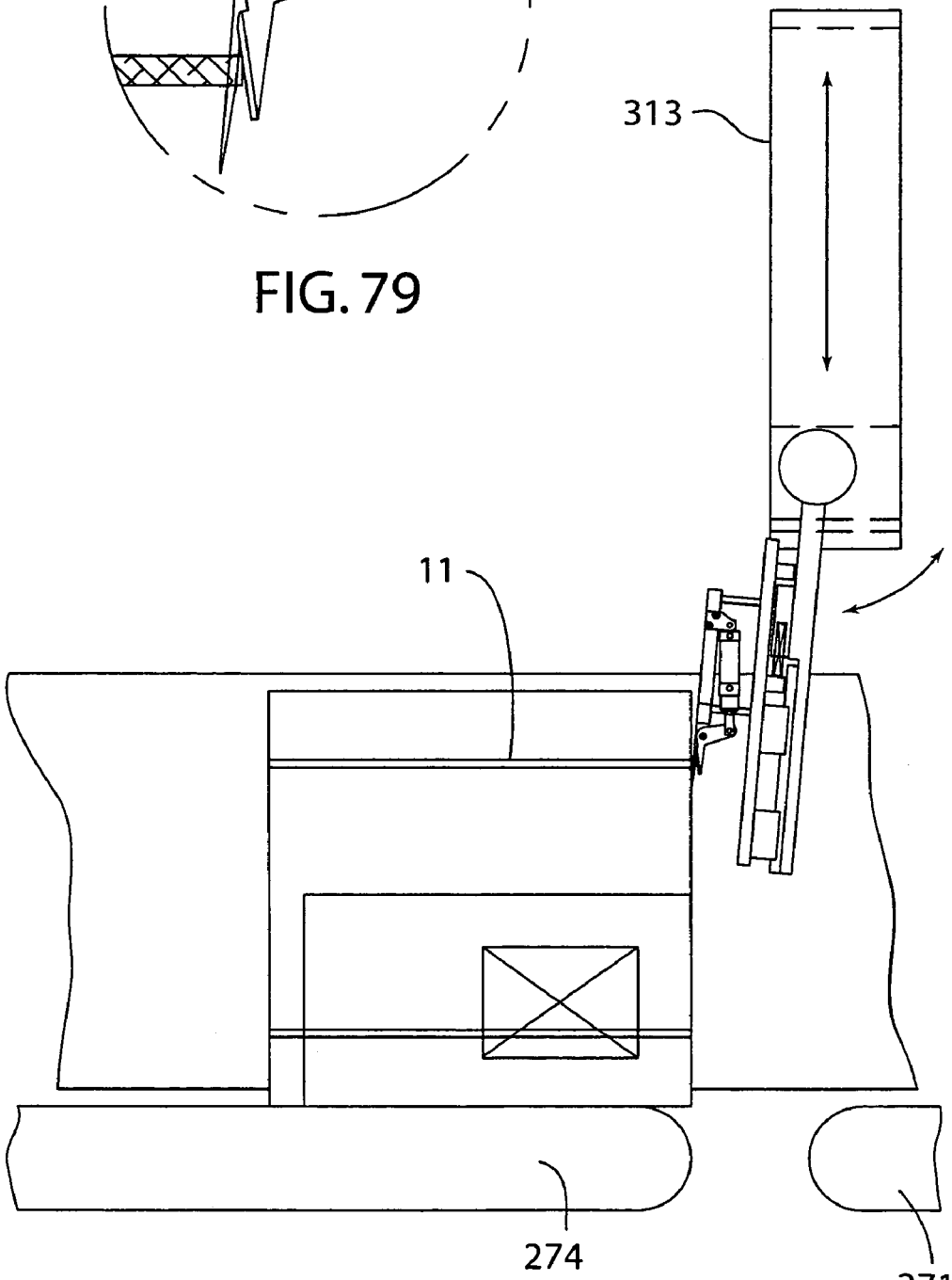
FIG. 78 is a partially fragmentary, schematic plan view of the station of FIG. 76 wherein the cutting shoe is in position to cut a band of a package, and wherein the view is taken perpendicular to the main conveyor.
Figure 80:
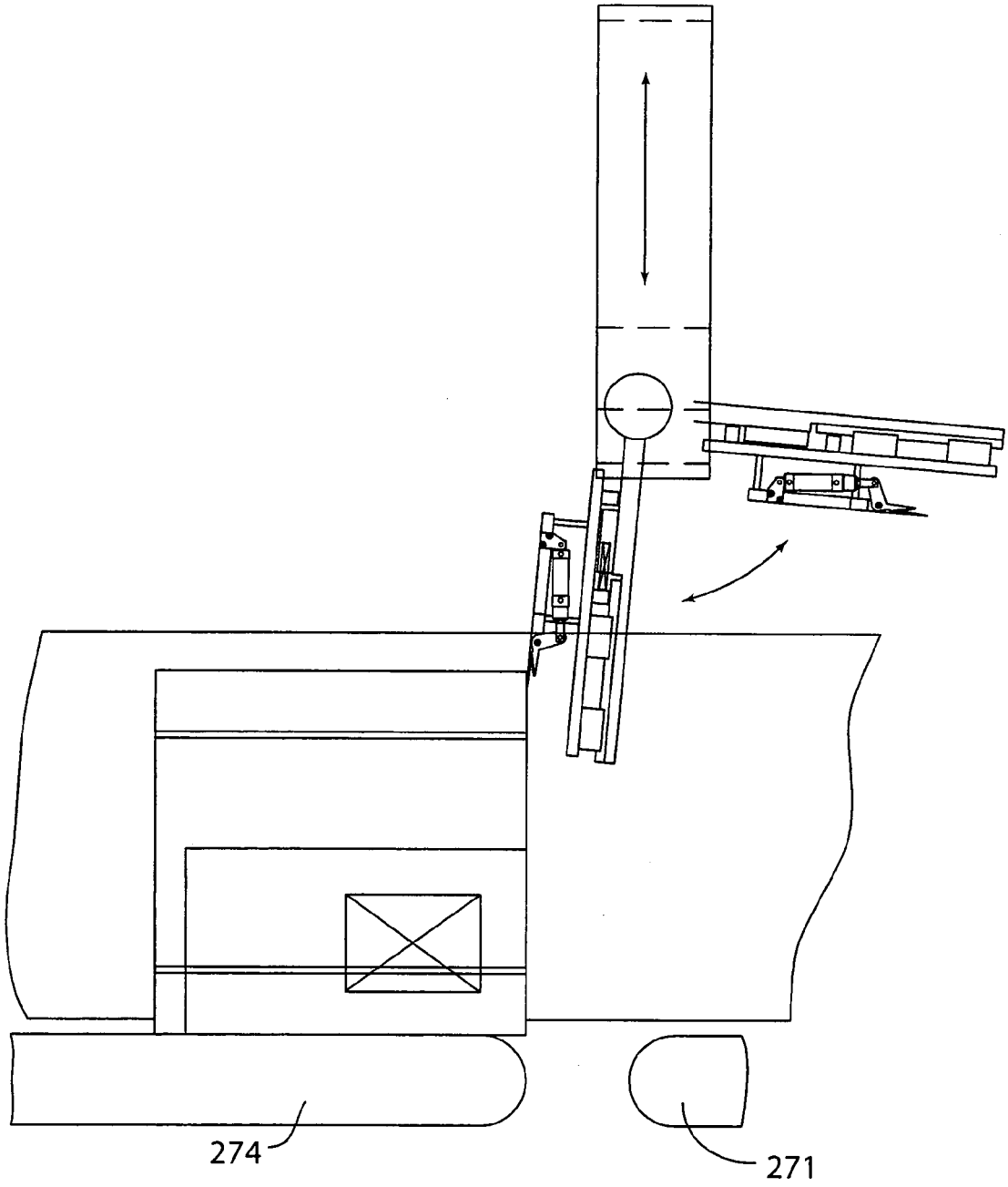
FIG. 80 is a partially fragmentary, schematic plan view of the station of FIG. 76 wherein the cutting shoe is retracted, and wherein the view is taken perpendicular to the main conveyor.
Figure 81:
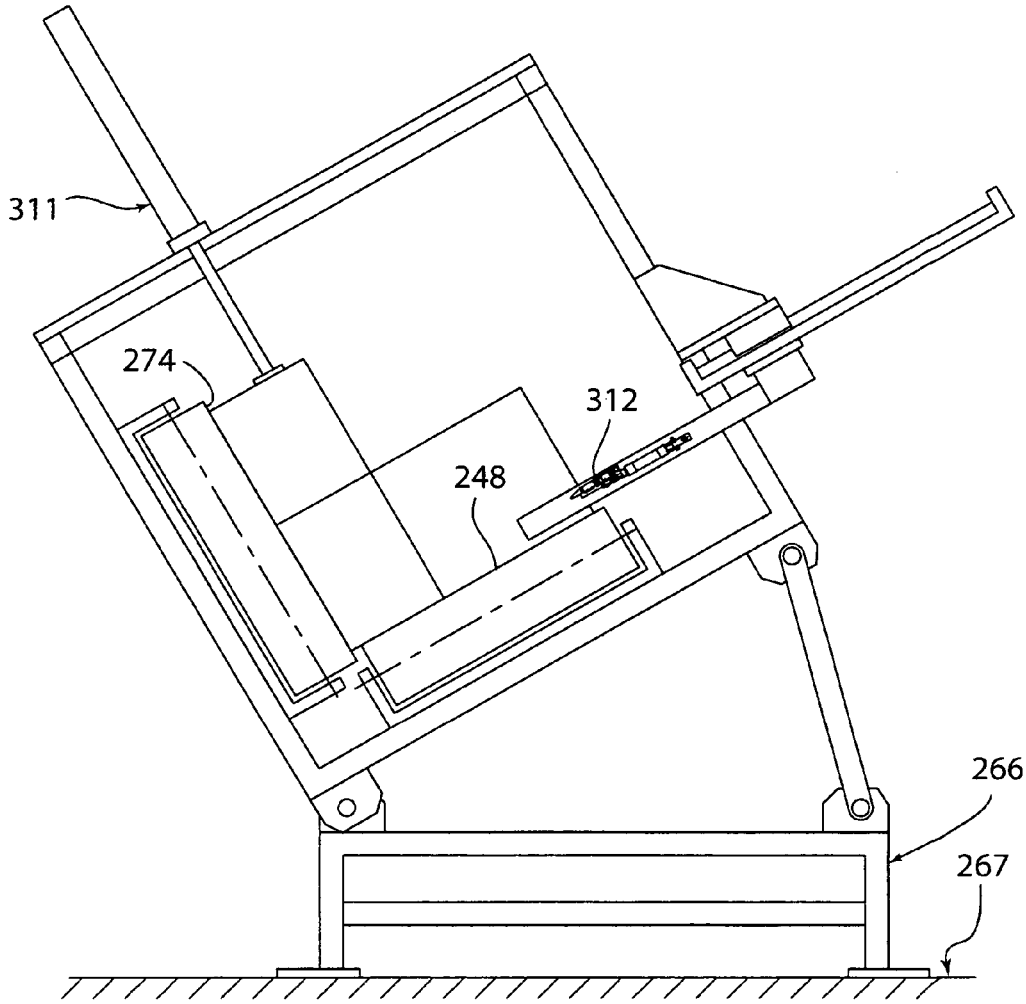
FIG. 81 is an end view of the station of FIG. 80 taken from the downstream end of the conveyor.

With further reference to FIGS. 75–81, the conveyors are then actuated to move packages 3 to the fifth station 245. A clamp 311 having substantially the same construction as clamp 306 then clamps the package 3. A cutting shoe 312 is rotatably mounted to a slide or base 313 via an arm 314 and rotary powered actuator 315. After the package 3 is clamped in position, the slide 313 shifts the cutting shoe 312, arm 314 and rotary actuator 315 towards the package 3, until a sensor (not shown) on the slide 313 senses that it is positioned adjacent a package 3. The rotary actuator 315 is then actuated to bring the cutting shoe 312 into position against front side 12 of package 3 as illustrated in FIG. 76. The powered slide 313 is then actuated until the cutting shoe 312 comes into contact with a band 11 as illustrated in FIG. 78. The cutting shoe 312 is substantially the same as the cutting shoe 295 described in detail above, and is mounted on arm 314 utilizing a slide, spring and sensor that is substantially the same as described above in connection with the cutting shoe 295. When the cutting shoe 312 engages a band 11, the cutting head 312 shifts slightly relative to the arm 314, thereby generating a signal to the controller 32, and the controller 32 then stops movement of the slide 313. Controller 32 then actuates cutter 312 to cut the band 11, and the arm 314 is then rotated to a retracted position by actuator 315, and by translation of slide 313 away from the package 3. The gap between conveyors 271 and 274 provides clearance for cutting shoe 312 and/or arm 314 if the band 11 is positioned to the side of package 3 adjacent side conveyor 274. The clamp 311 is then retracted, and conveyors 248, 274 and 271 are then actuated to move the package to the sixth station 246 and/or the seventh station 247. Operators 258 and 259 manually remove the bands 11 and plastic wrap 9 from the packages 3, and move the packages 3 to a cart 27 for further sorting/processing.

The conveyor 271 has a high friction surface to thereby position and move the packages 3. Because the conveyor 248 of the de-packaging machine 240 is angled, the packages 3 are biased into engagement with the side conveyors 268, 274 and 271. Because the side conveyors have a high co-efficient of friction for the belts thereof, the packages 3 remain accurately positioned in the de-packaging machine 240 as they are moved between the subsequent stations. Also, because the packages are qualified or positioned in the loading station by the conveyor 268 and stop 269, the position of the packages 3 in the subsequent stations can be controlled by moving the conveyors the proper amount. Side conveyors 268, 274 and 271 may all be driven by a single motor, in unison, to provide for proper positioning of the packages.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A de-packaging system for removing film from packages, comprising:

a conveyor configured to move packages along the de-packaging system;

first and second horizontal hot wire cutters adjacent the conveyor that make horizontal cuts in film on opposite sides of a package;

first and second vertical hot wire cutters adjacent the conveyor that make vertical cuts on a front side of a package;

a third horizontal hot wire cutter adjacent the conveyor that makes horizontal cuts across a front side of a package at substantially the same height as the first and second horizontal hot wire cutters;

at least one friction member adjacent the conveyor that engages film on a bottom of a package to pull the film off the packages.

2. The de-packaging system of claim 1, wherein:

the conveyor comprises a first conveyor defining a downstream end; and including:

a second conveyor defining an upstream end that is proximate the downstream end of the first conveyor;

a pushing device that moves packages from the first conveyor to the second conveyor.

3. The de-packaging system of claim 2, wherein:

the friction member is positioned between the first and second conveyors.

4. The de-packaging system of claim 3, including:

a powered actuator that shifts the at least one friction member into contact with film on the bottom of a package.

5. The de-packaging system of claim 4, including:

a pinch mechanism downstream of the at least one friction member, the pinch mechanism having a movable pick up head assembly and a powered actuator that shifts the pick up head assembly from a retracted position to an engaged position adjacent a package on the second conveyor, the pick up head assembly including gripper members, at least a first one of the gripper members comprising a movable gripper member, and wherein at least one of the gripper members includes a high-friction pad to grip film.

6. The de-packaging system of claim 1, wherein:

the first, second and third horizontal hot wire cutters and the first and second vertical hot wire cutters each include a pair of generally parallel wires.

7. The de-packaging system of claim 6, wherein:

at least one of the first and second hot wire cutters can be shifted horizontally to cut film on packages of different sizes.

8. The de-packaging system of claim 7, wherein:

the first and second horizontal hot wire cutters and the first and second vertical hot wire cutters include a base member and an elongated structural wire support member pivotably mounted to the base member.

9. The de-packaging system of claim 8, wherein:

the elongated structural member is rotatably biased for rotation relative to the base member.

10. The de-packaging system of claim 9, wherein:

each of the hot wire cutters include springs that tension the wires.

11. A de-packaging system, comprising:

a first conveyor configured to move packages along the de-packaging system, the first conveyor defining a downstream end;

a film cutting station associated with the first conveyor, the film cutting station including a plurality of hot wire cutters, each having an elongated heated wire that cuts film on packages, wherein the cutters are configured to cut film across a front side of packages and across opposite side faces, wherein at least one of the hot wire cutters shifts transverse to the first conveyor to accommodate packages of different size;

a second conveyor having an upstream end adjacent the downstream end of the first conveyor;

a device that applies force to packages to move packages from the first conveyor to the second conveyor; and at least one friction member positioned between the first and second conveyors to strip film from packages as they are moved from the first conveyor to the second conveyor.

12. The de-packaging system of claim 11, including:

a pinch device downstream of the at least one friction member that pulls film from packages.

13. The de-packaging system of claim 11, wherein:

a band cutting station associated with the first conveyor, the band cutting station including a cutting blade for cutting bands wrapped around packages;

a clamp device configured to clamp bands on packages for removal of the bands.

* * * * *